US009905151B2

(12) United States Patent
Suzuki et al.

(10) Patent No.: US 9,905,151 B2
(45) Date of Patent: Feb. 27, 2018

(54) DISPLAY PANEL HAVING DAISY-CHAIN-CONNECTED PIXELS, PIXEL CHIP, AND ELECTRONIC APPARATUS

(71) Applicant: SONY CORPORATION, Tokyo (JP)

(72) Inventors: Hideyuki Suzuki, Kanagawa (JP); Toshiyuki Miyauchi, Kanagawa (JP); Yosuke Ueno, Kanagawa (JP); Yoshifumi Miyajima, Kanagawa (JP); Masayuki Hattori, Kanagawa (JP); Kazukuni Takanohashi, Tokyo (JP); Haruo Togashi, Kanagawa (JP); Tamotsu Ikeda, Tokyo (JP); Hiizu Ootorii, Kanagawa (JP); Sachiya Tanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 121 days.

(21) Appl. No.: 14/758,892

(22) PCT Filed: Dec. 20, 2013

(86) PCT No.: PCT/JP2013/084200
§ 371 (c)(1),
(2) Date: Jul. 1, 2015

(87) PCT Pub. No.: WO2014/109207
PCT Pub. Date: Jul. 17, 2014

(65) Prior Publication Data

US 2015/0371591 A1 Dec. 24, 2015

(30) Foreign Application Priority Data

Jan. 11, 2013 (JP) ..... 2013-003646

(51) Int. Cl.
*G09G 3/20* (2006.01)
*G09G 3/3291* (2016.01)
(Continued)

(52) U.S. Cl.
CPC ..... *G09G 3/2085* (2013.01); *G09G 3/32* (2013.01); *G09G 3/3291* (2013.01);
(Continued)

(58) Field of Classification Search
CPC ..... G09G 3/3291; G09G 3/2085; G09G 3/32; G09G 3/2014; G09G 3/36; G09G 2310/027; G09G 2310/02; G09G 2230/00
See application file for complete search history.

(56) References Cited

U.S. PATENT DOCUMENTS 6,736,512 B2 * 5/2004 Balogh ..... G02B 27/2214 345/88
2001/0048415 A1 * 12/2001 Morii ..... G09G 3/3688 345/87
(Continued)

FOREIGN PATENT DOCUMENTS

JP 05-204328 8/1993
JP 07-168151 A 7/1995
(Continued)

*Primary Examiner* — Darlene M Ritchie
(74) *Attorney, Agent, or Firm* — Chip Law Group

(57) ABSTRACT

A display panel includes a plurality of first unit pixels, each including: a data input terminal, a data output terminal, a display element, and a waveform shaping section. The display element is configured to perform display based on data inputted to the data input terminal. The first waveform shaping section is provided on a signal path from the data input terminal to the data output terminal.

20 Claims, 50 Drawing Sheets

(51) Int. Cl.
*G09G 3/32* (2016.01)
*G09G 3/36* (2006.01)

(52) U.S. Cl.
CPC ..... *G09G 3/2014* (2013.01); *G09G 3/36* (2013.01); *G09G 2230/00* (2013.01); *G09G 2310/02* (2013.01); *G09G 2310/027* (2013.01)

(56) References Cited

U.S. PATENT DOCUMENTS

2002/0142504 A1* 10/2002 Feldman ..... G06F 3/147 438/30
2005/0052373 A1* 3/2005 Devos ..... G06F 3/1446 345/82
2005/0062711 A1* 3/2005 Kobayashi ..... G09G 3/20 345/100
2007/0080905 A1* 4/2007 Takahara ..... G09G 3/3233 345/76
2008/0088258 A1* 4/2008 Ng ..... H05B 33/0818 315/294
2009/0322649 A1* 12/2009 Hamer ..... G09G 3/20 345/1.3
2010/0207848 A1* 8/2010 Cok ..... G09G 3/2085 345/76
2011/0050658 A1* 3/2011 White ..... G09G 3/2085 345/205
2012/0206499 A1* 8/2012 Cok ..... G09G 3/3208 345/690
2013/0002626 A1* 1/2013 Washio ..... G09G 3/2085 345/205
2014/0267968 A1* 9/2014 Haga ..... G09G 3/18 349/43
2015/0062432 A1* 3/2015 Choo ..... G09G 5/008 348/540

FOREIGN PATENT DOCUMENTS

JP 08-101666 A 4/1996
JP 11-038925 A 2/1999
JP 11-282397 A 10/1999
JP 2000-020029 A 1/2000
JP 2001-312246 A 11/2001
JP 2001-331150 A 11/2001
JP 2001-350439 A 12/2001
JP 2012-032828 A 2/2012
WO 96/10244 A1 4/1996
WO 2009/001813 A1 12/2008

* cited by examiner

[ FIG. 1 ]
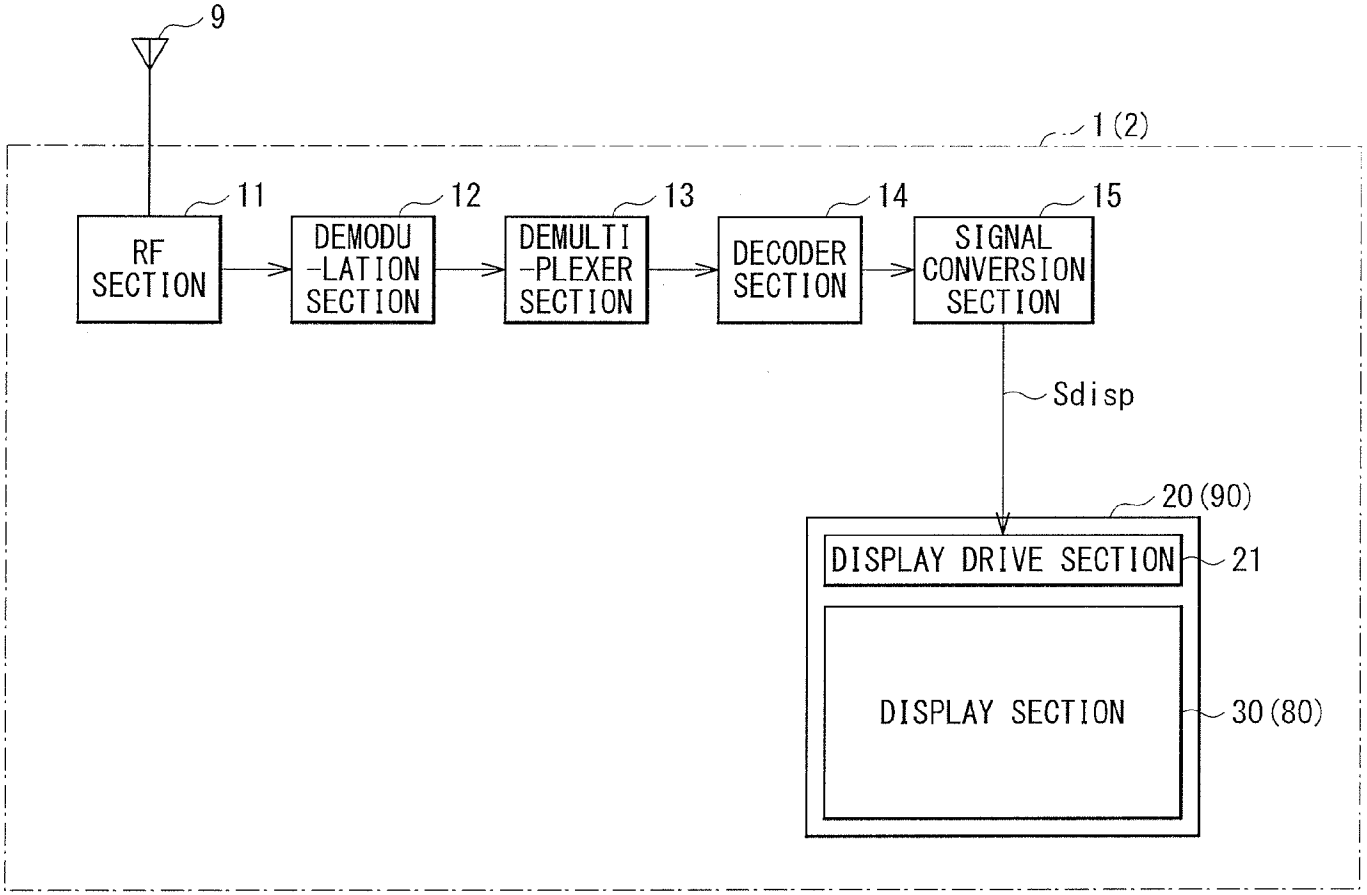

[ FIG. 2 ]
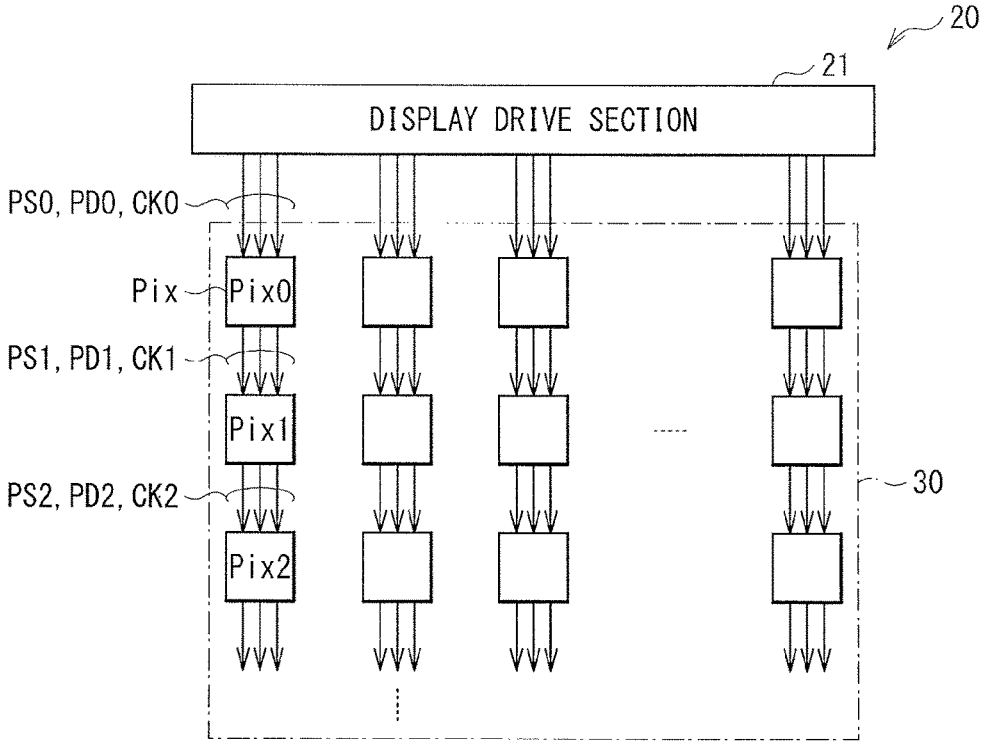
[ FIG. 3 ]
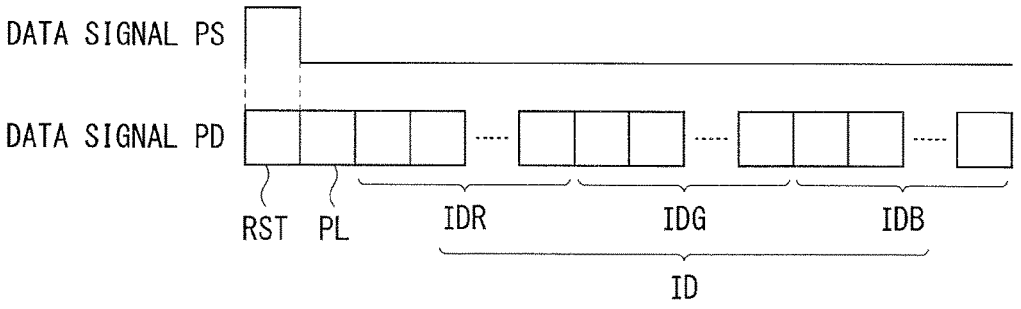

[ FIG. 4 ]
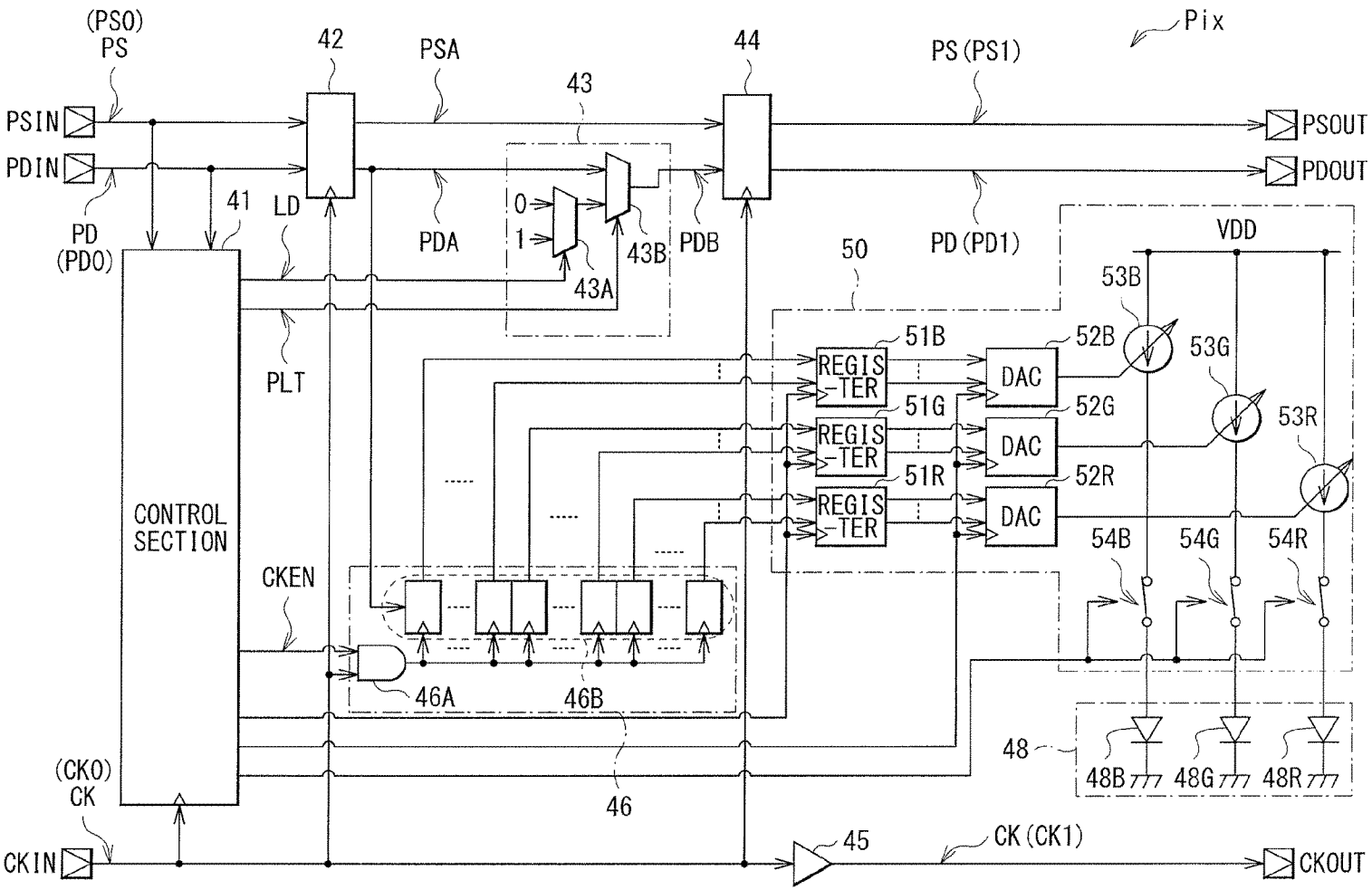

[ FIG. 5 ]
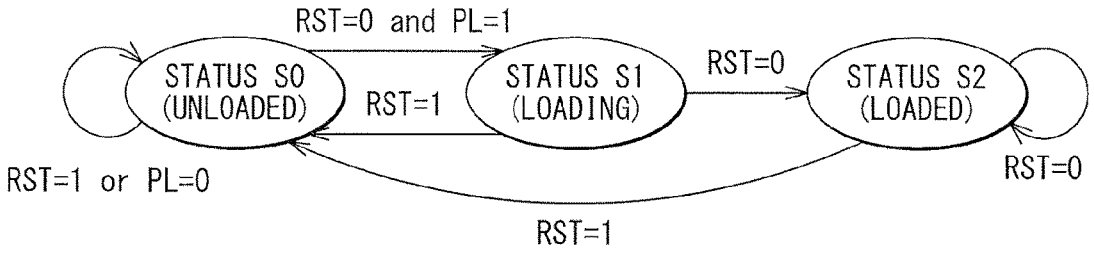

[ FIG. 6 ]
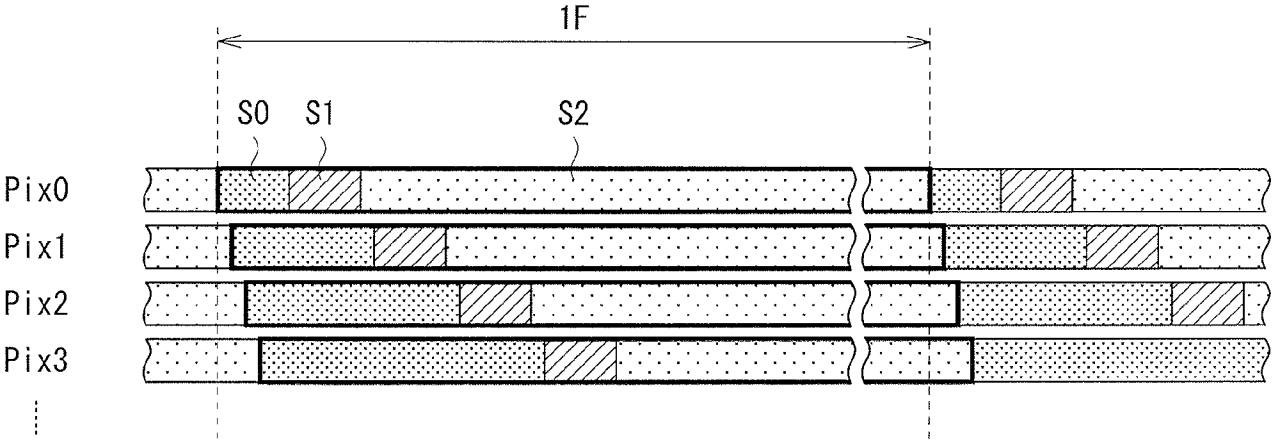

[ FIG. 7 ]
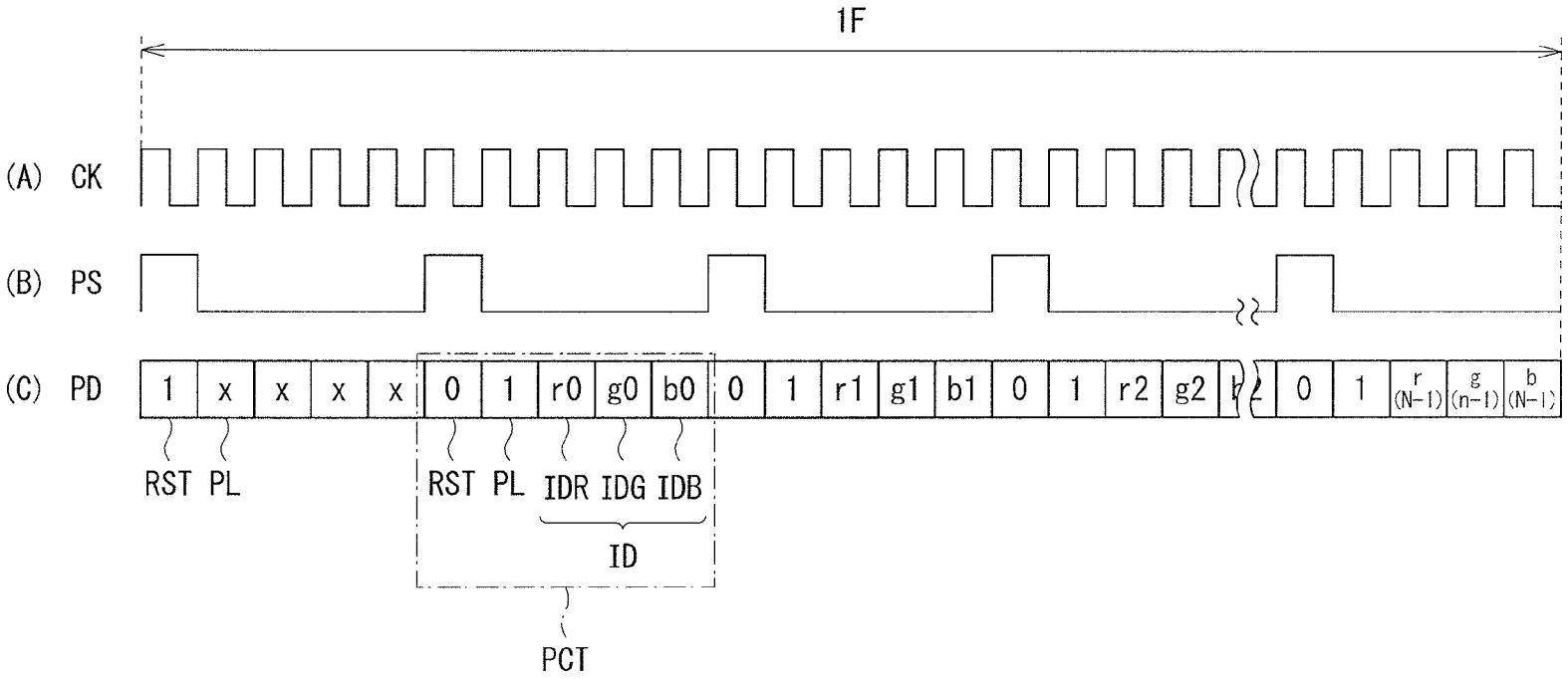

[ FIG. 8 ]
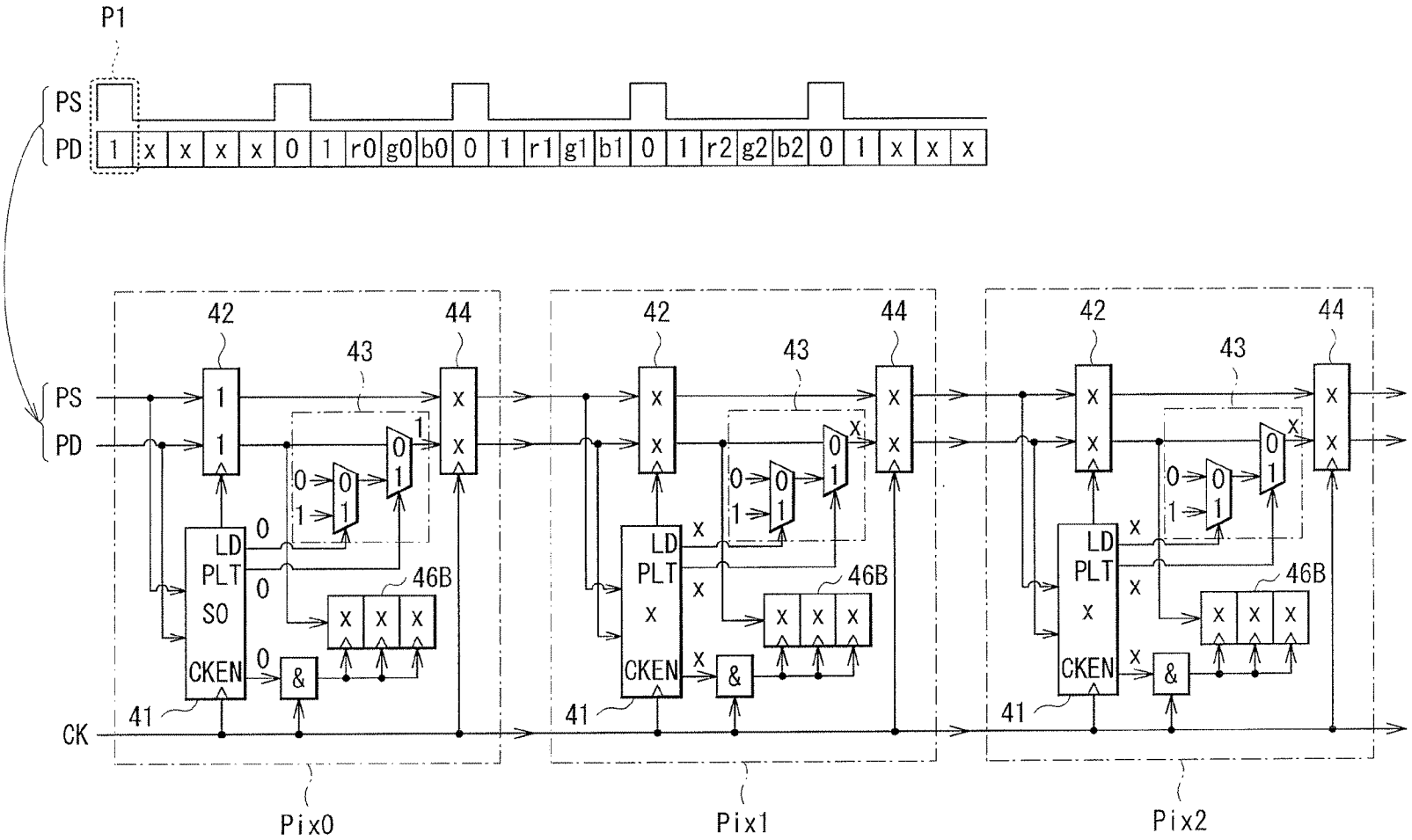

[ FIG. 9 ]
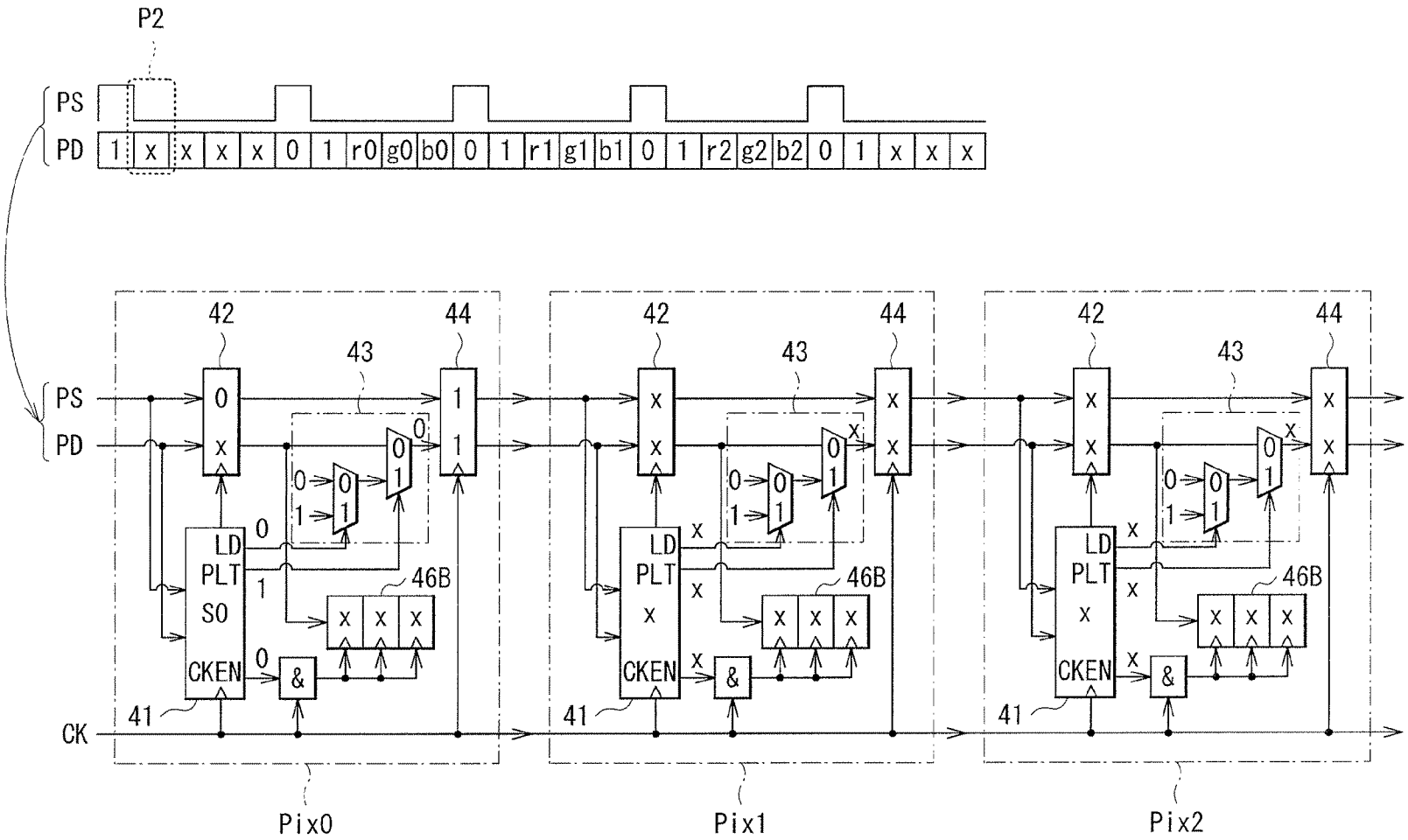

[ FIG. 10 ]
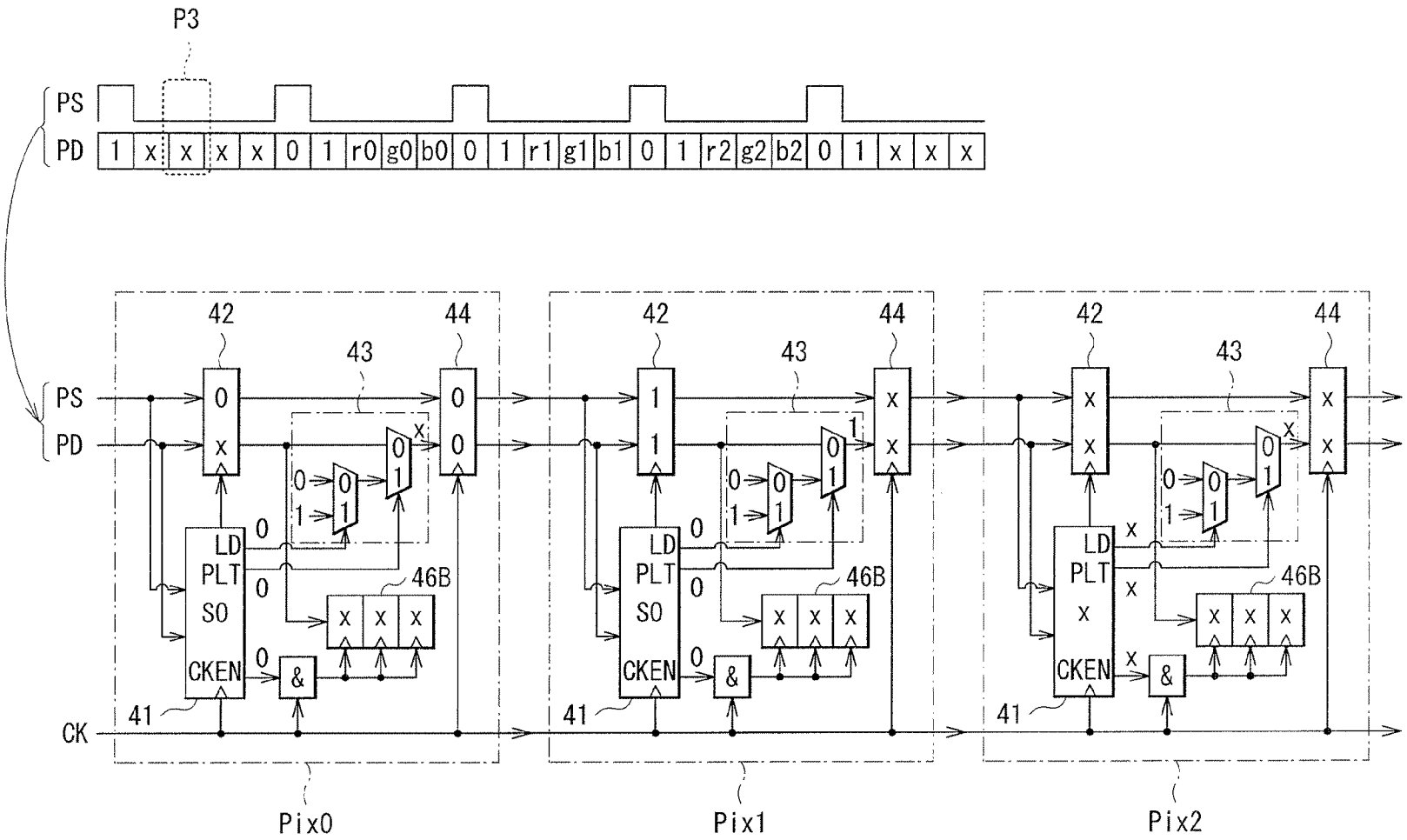

[ FIG. 11 ]
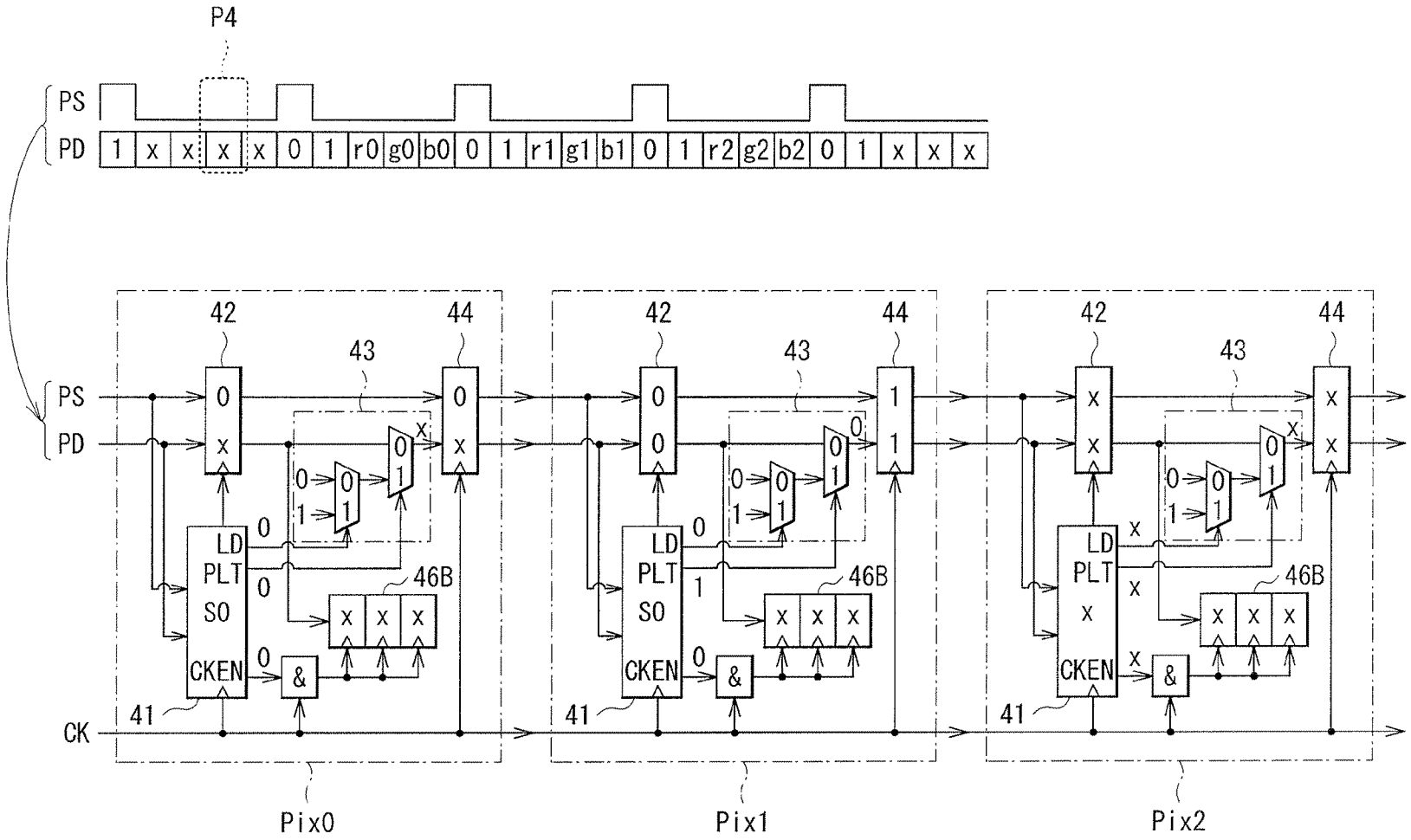

[ FIG. 12 ]
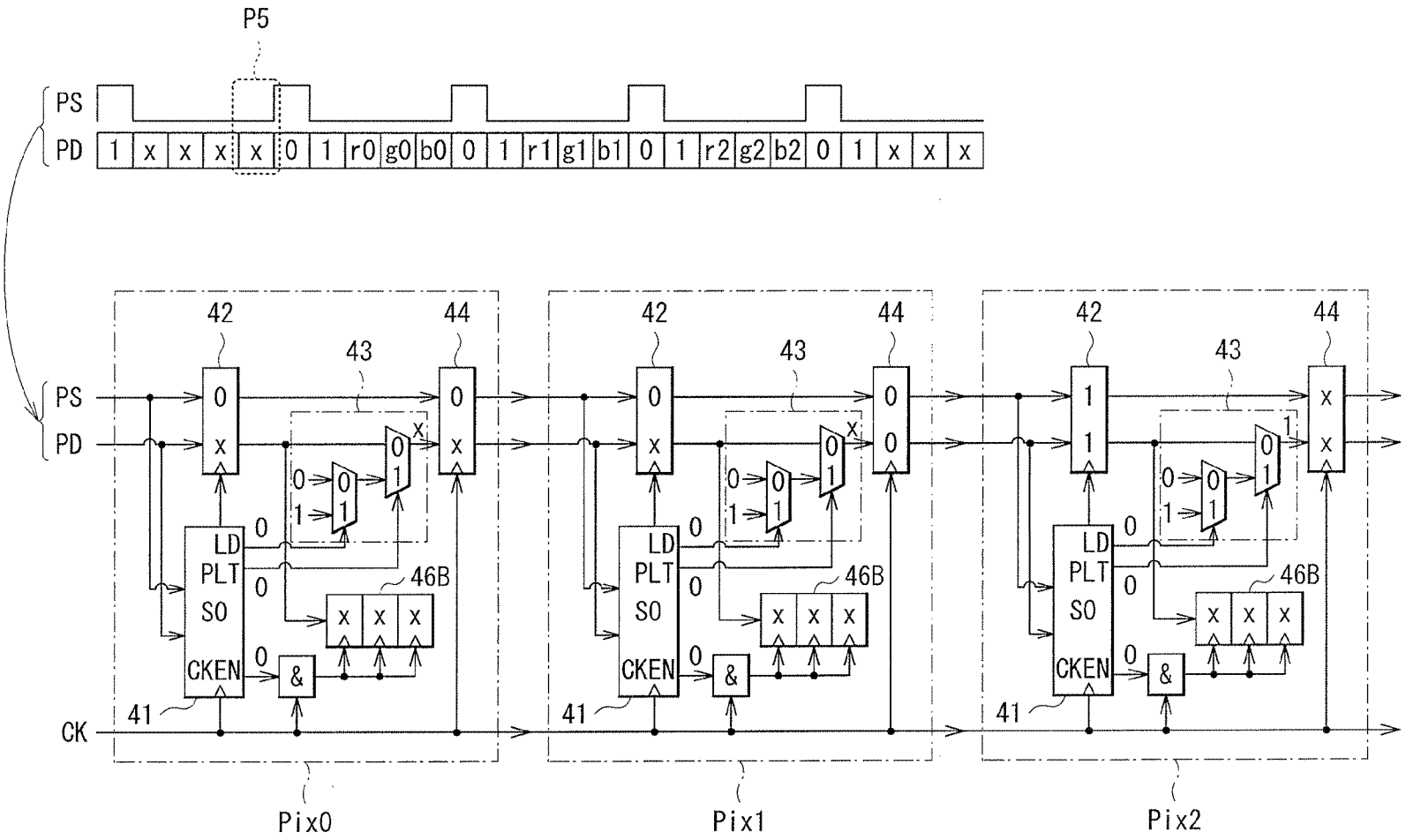

[ FIG. 13 ]
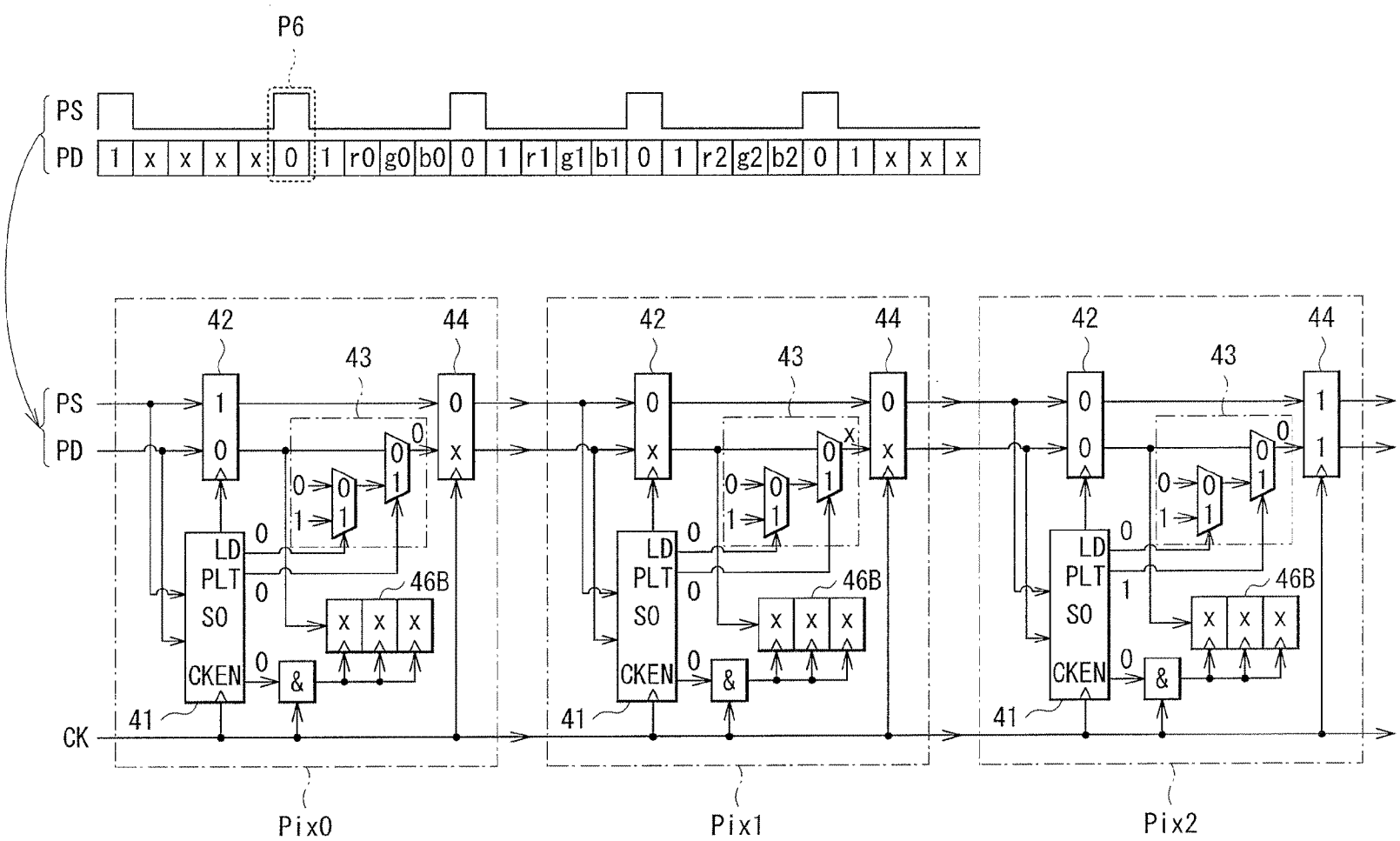

[ FIG. 14 ]
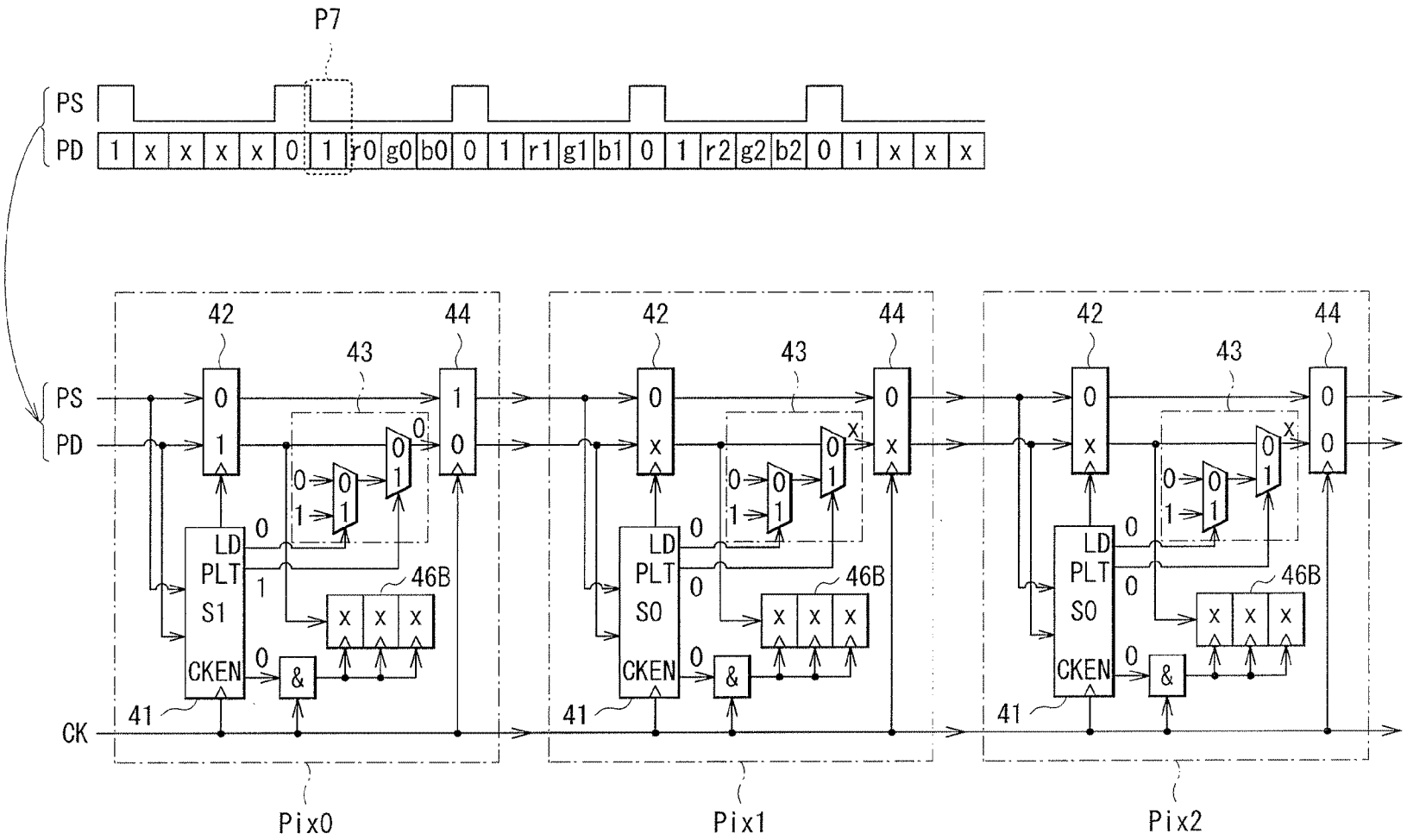

[ FIG. 15 ]
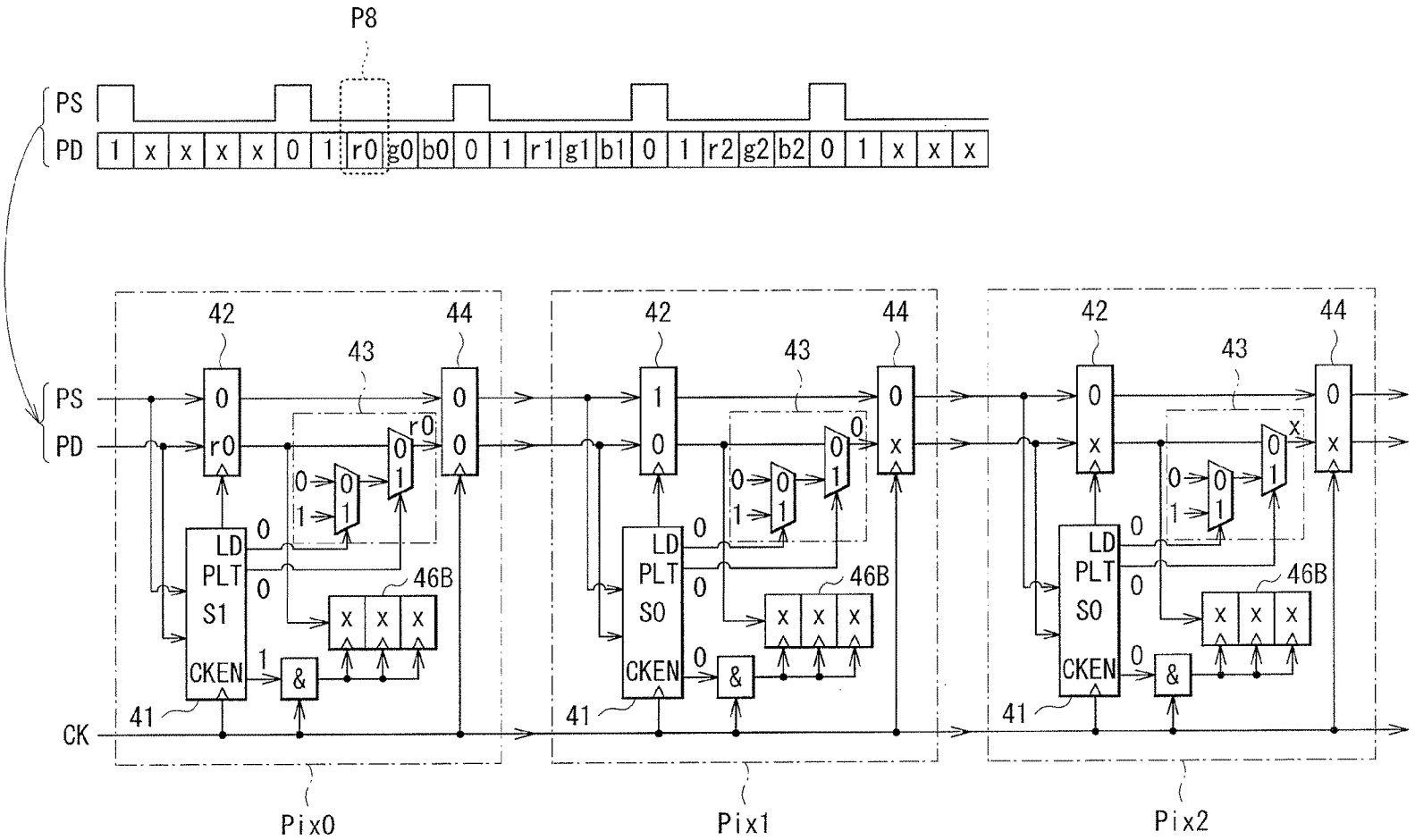

[ FIG. 16 ]
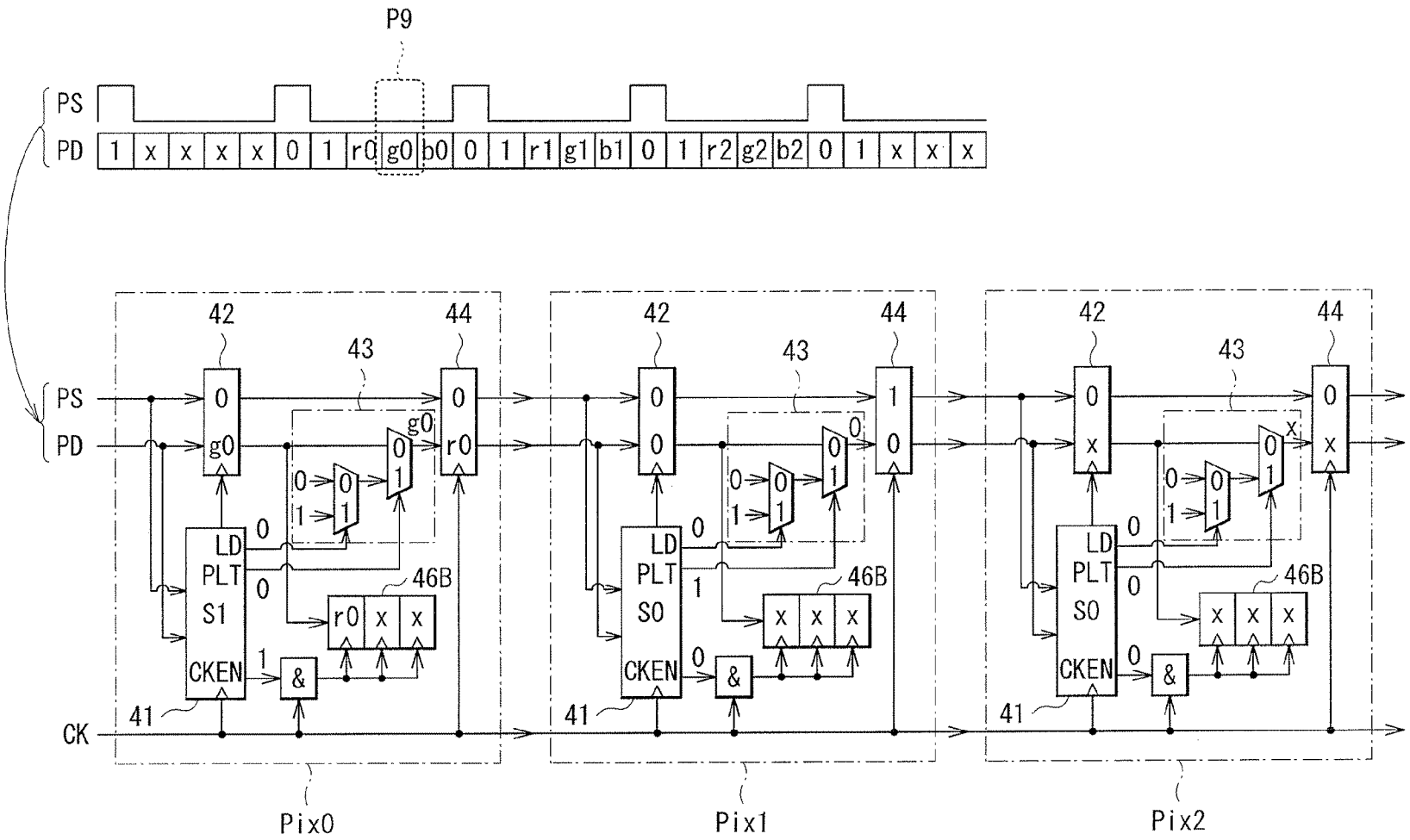

[ FIG. 17 ]
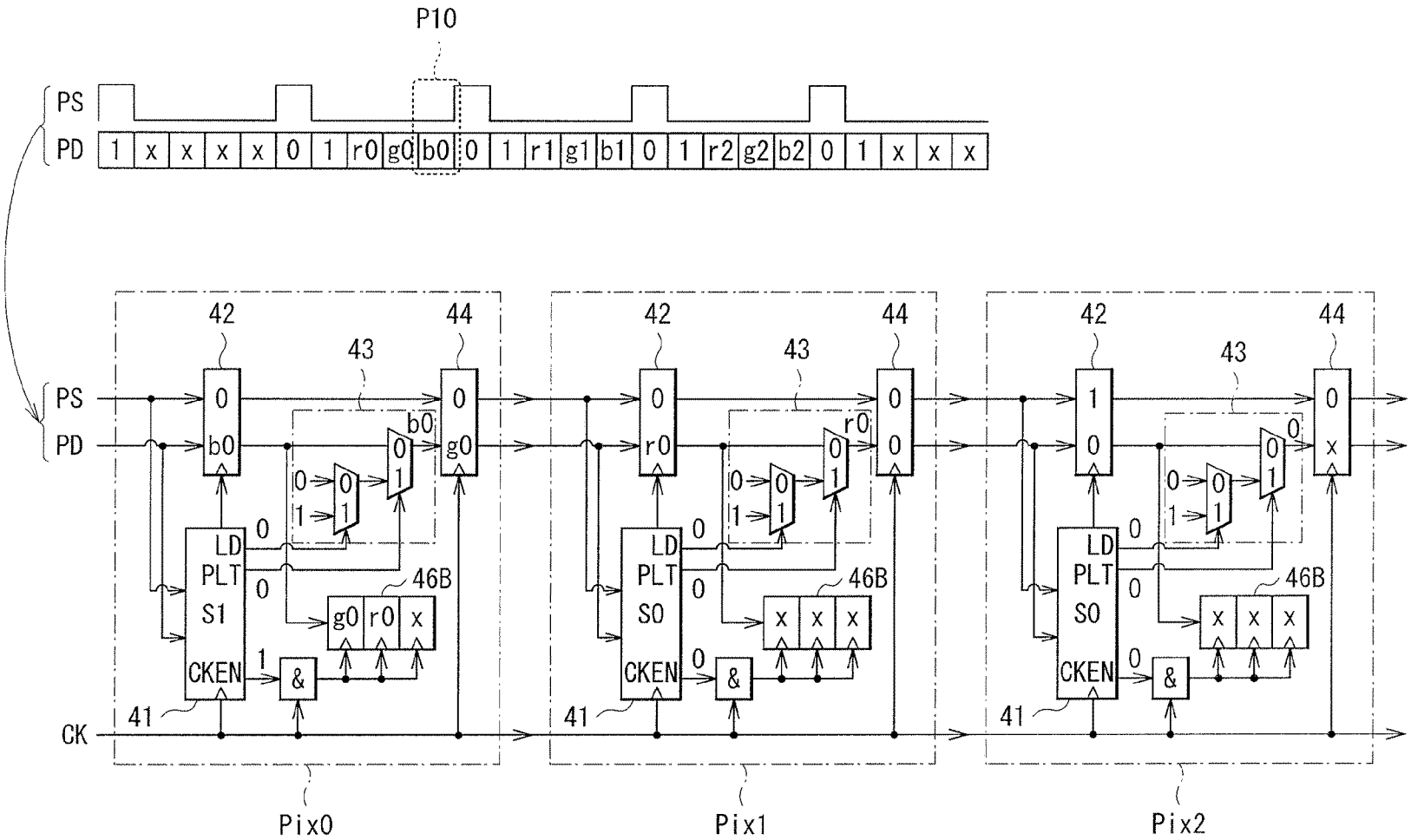

[ FIG. 18 ]
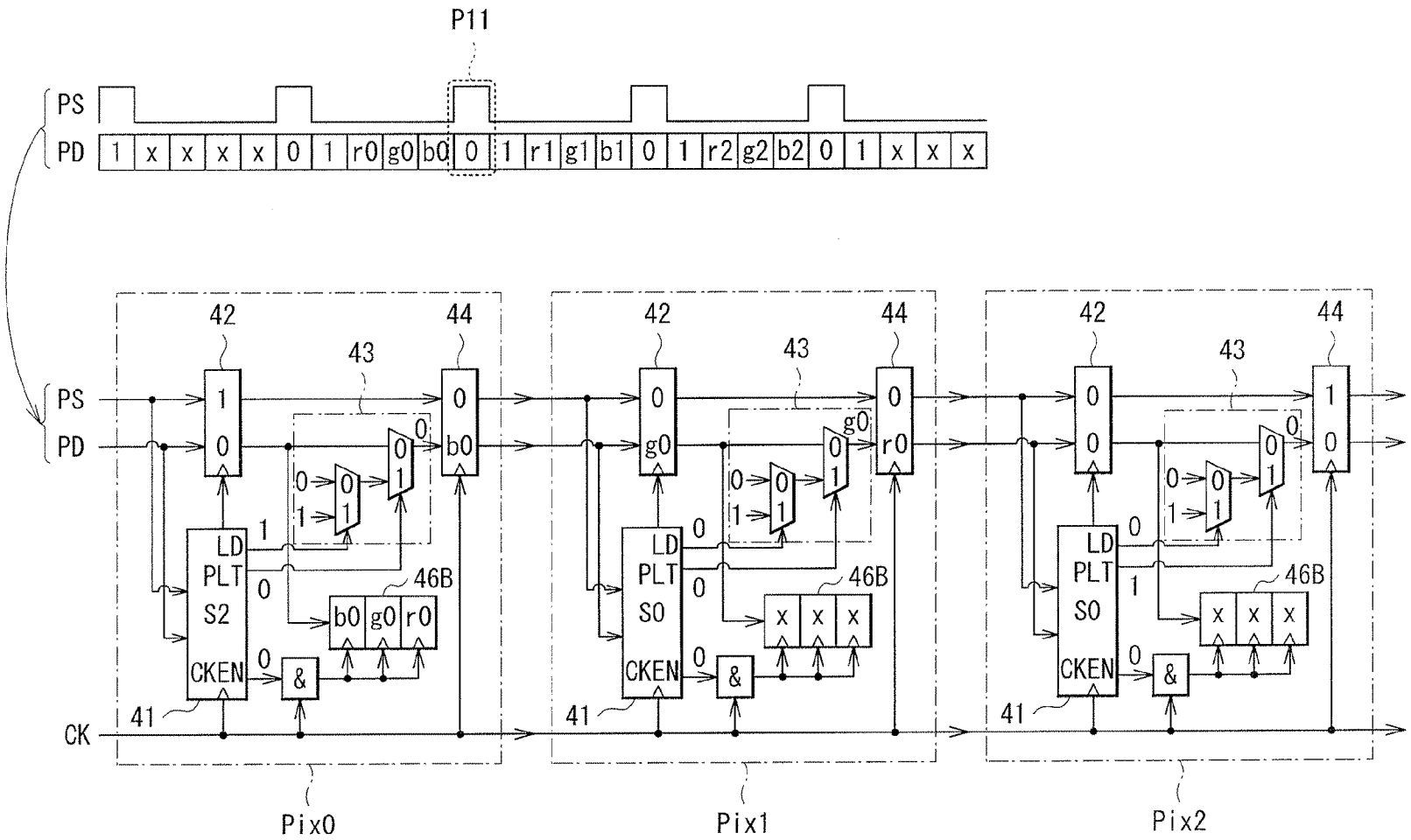

[ FIG. 19 ]
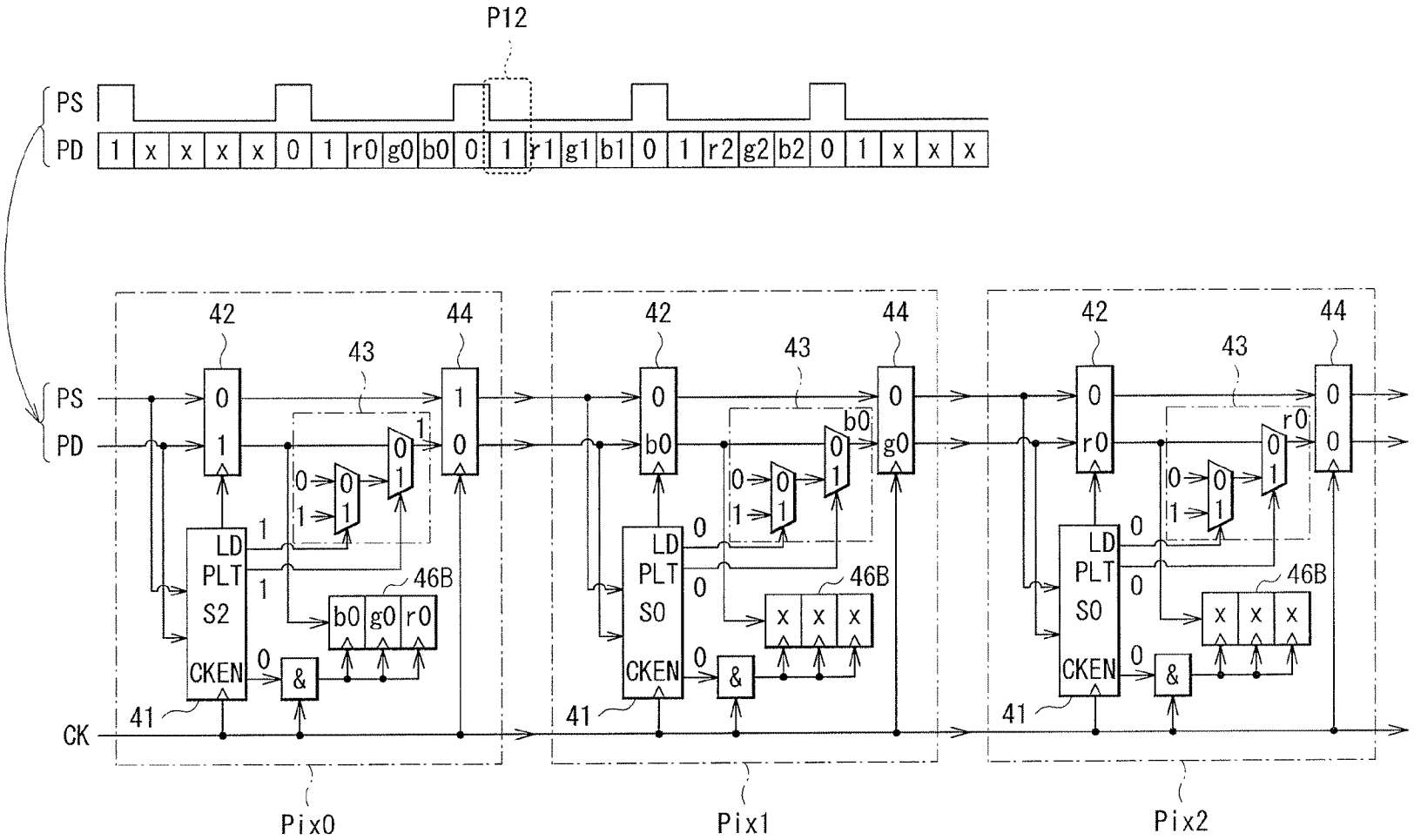

[ FIG. 20 ]
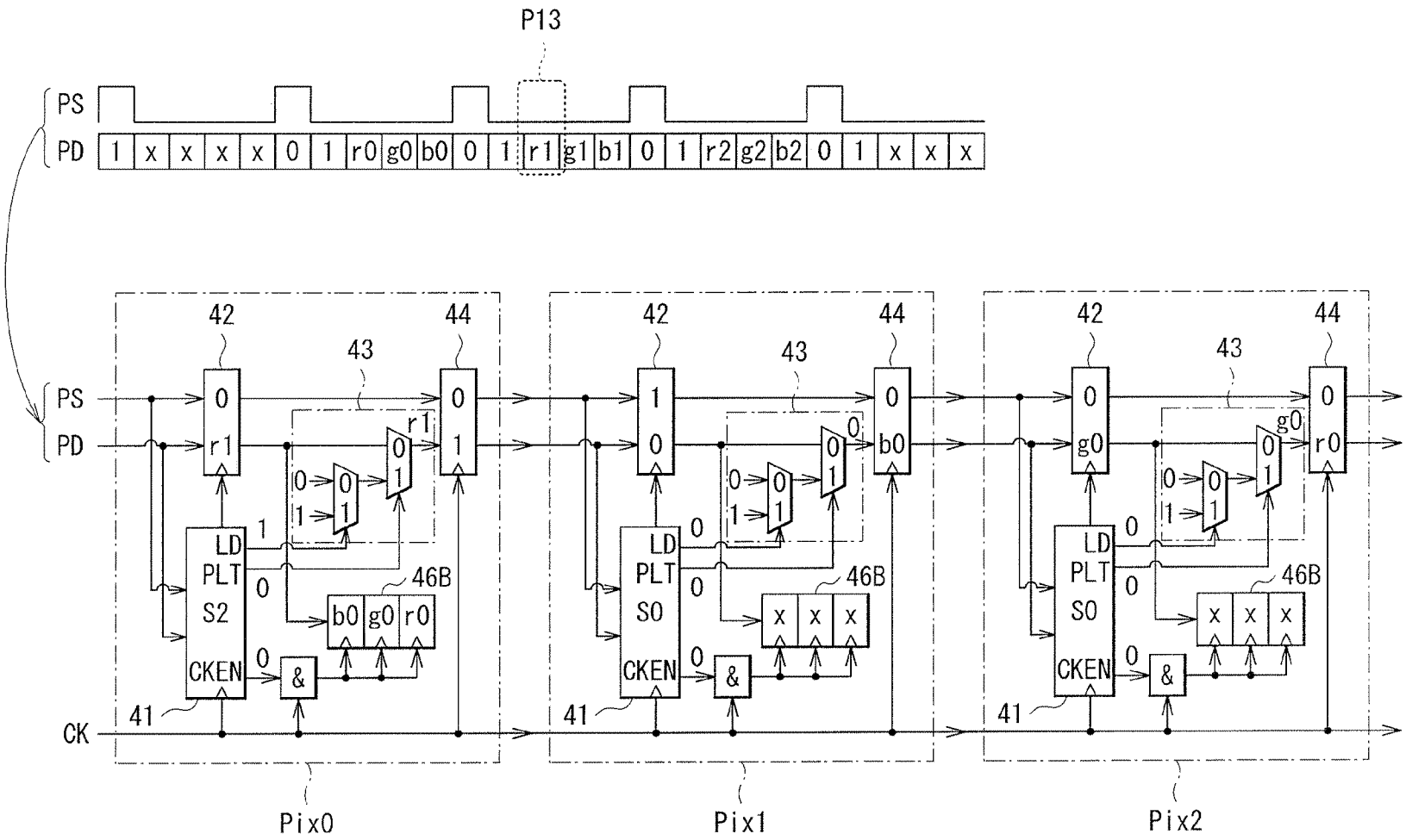

[ FIG. 21 ]
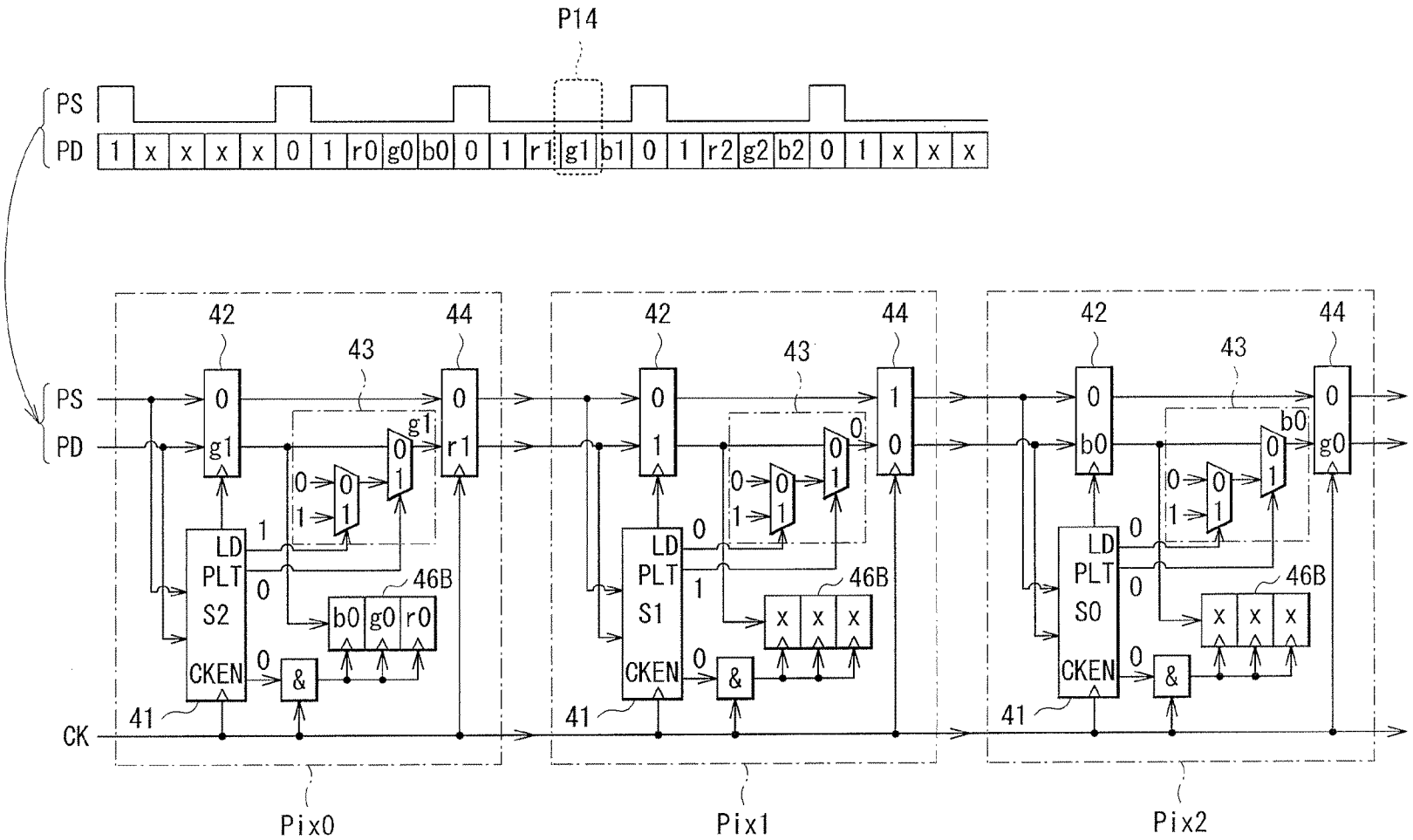

[ FIG. 22 ]
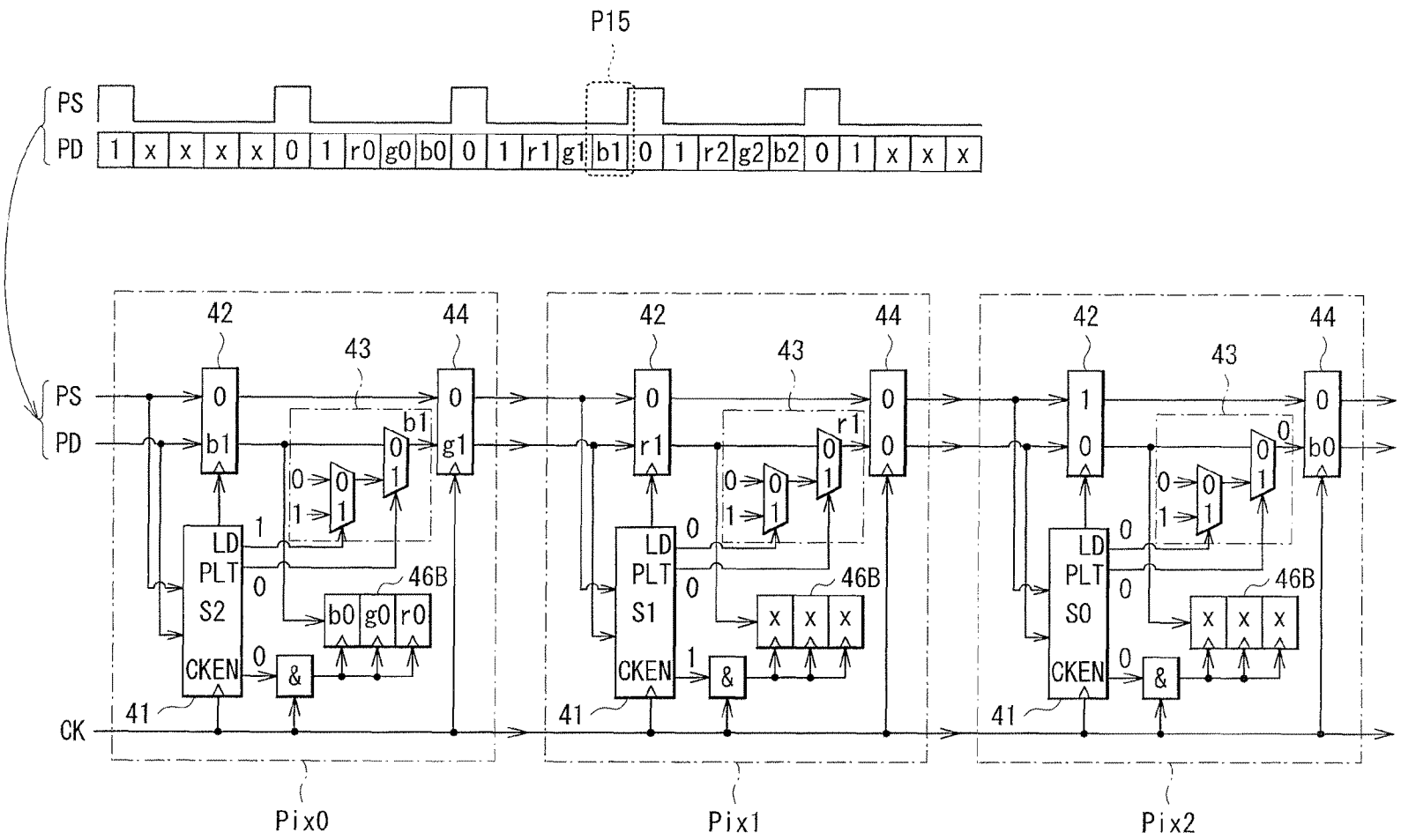

[ FIG. 23 ]
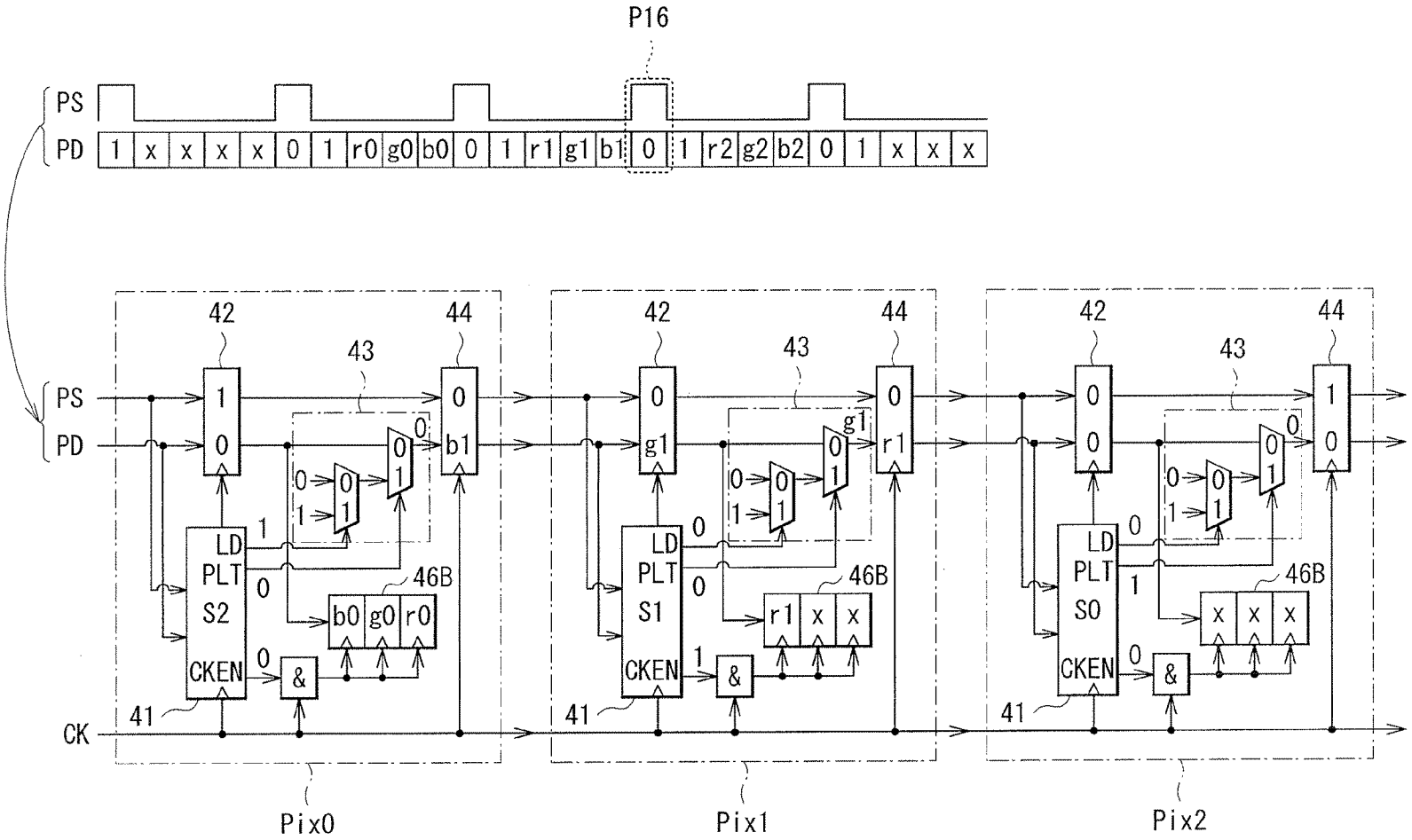
PS
PD
P16
1 x x x 0 1 r0 g0 b0 0 1 r1 g1 b1 0 1 r2 g2 b2 0 1 x x x
PS
PD
CK
Pix0
Pix1
Pix2
41
42
43
44
46B
LD
PLT
S2
S1
S0
CKEN
&
b0 g0 r0
r1
x x x
b1
g1
r1
0 1 0 1 0 1

[ FIG. 24 ]
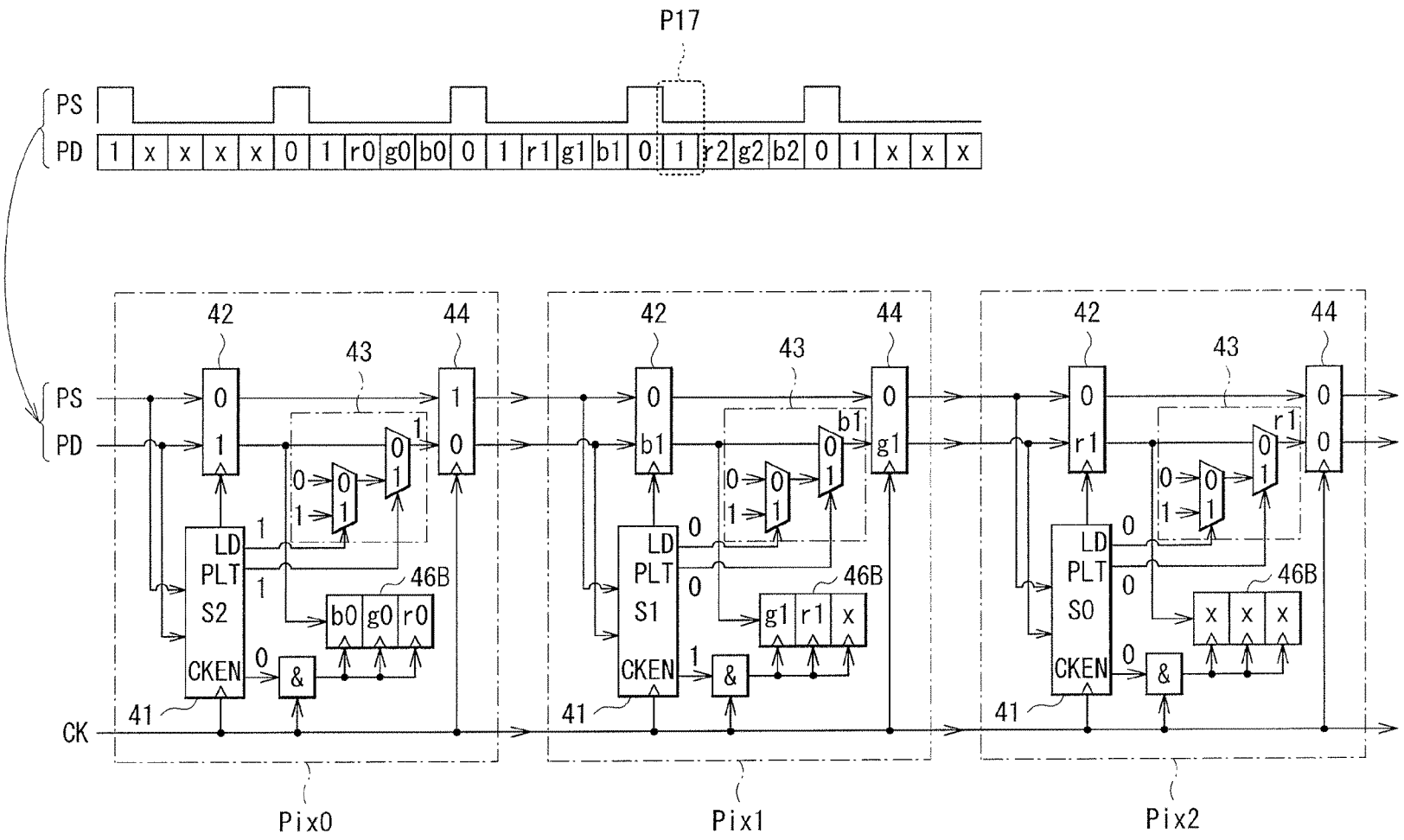

[ FIG. 25 ]
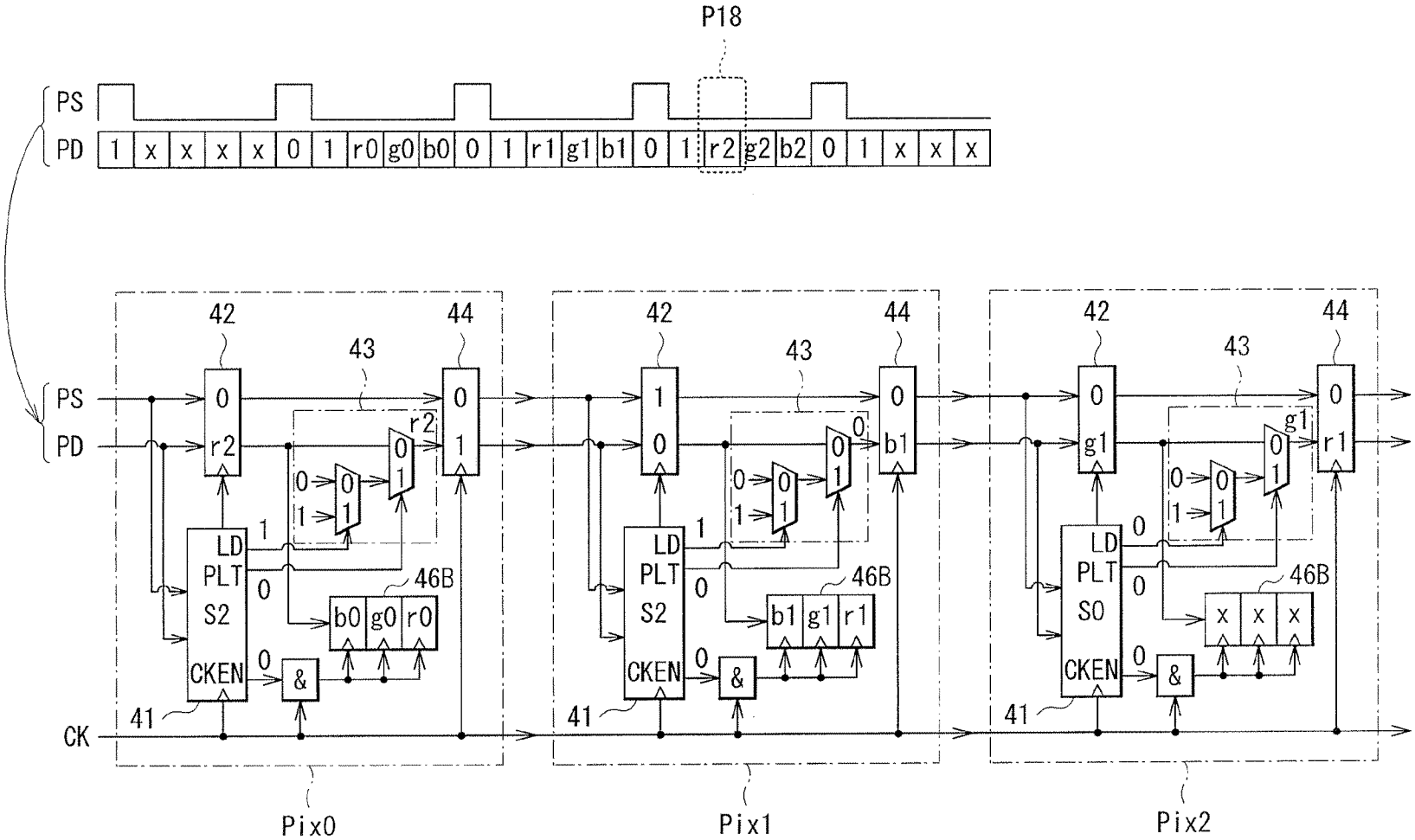

[ FIG. 26 ]
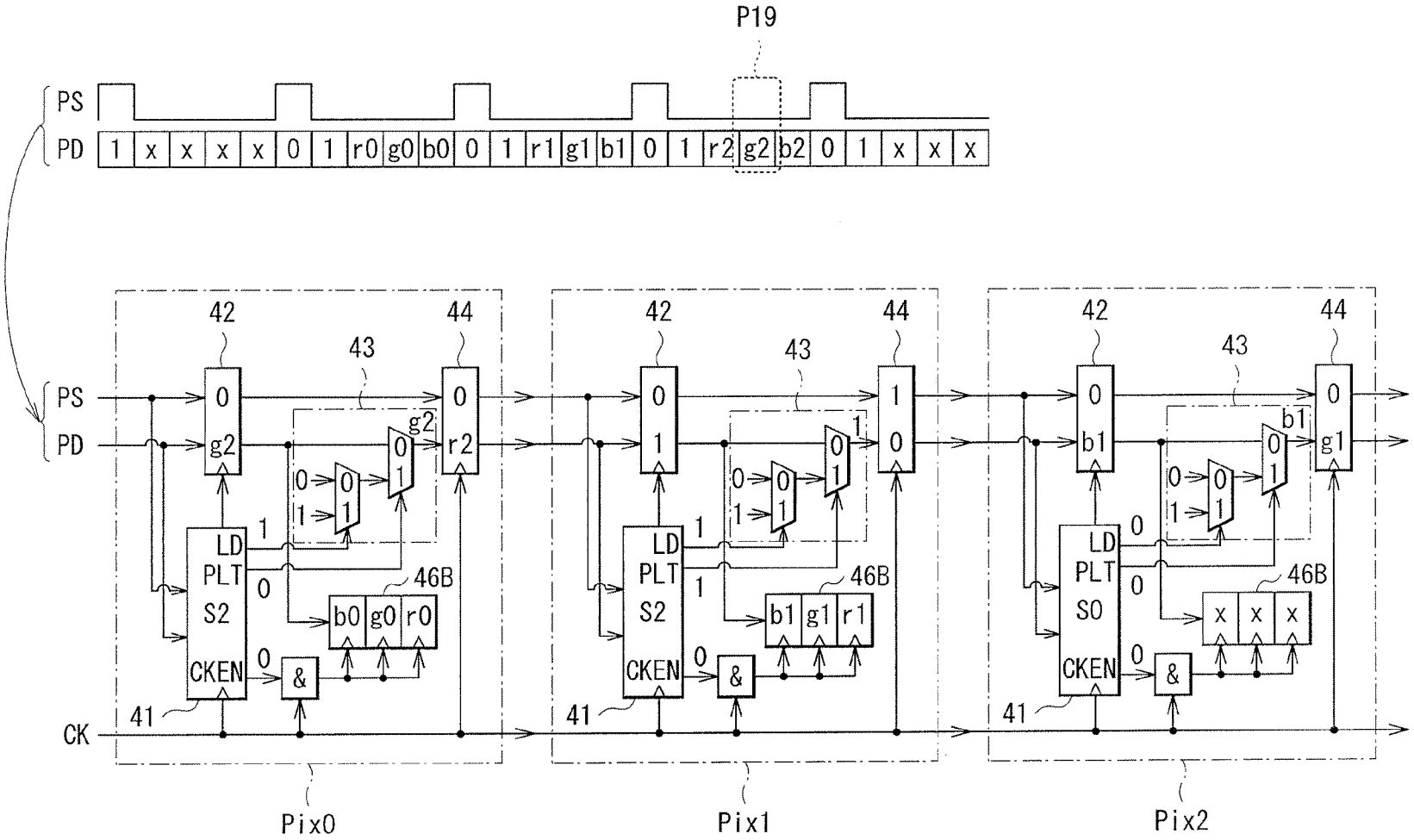

[ FIG. 27 ]
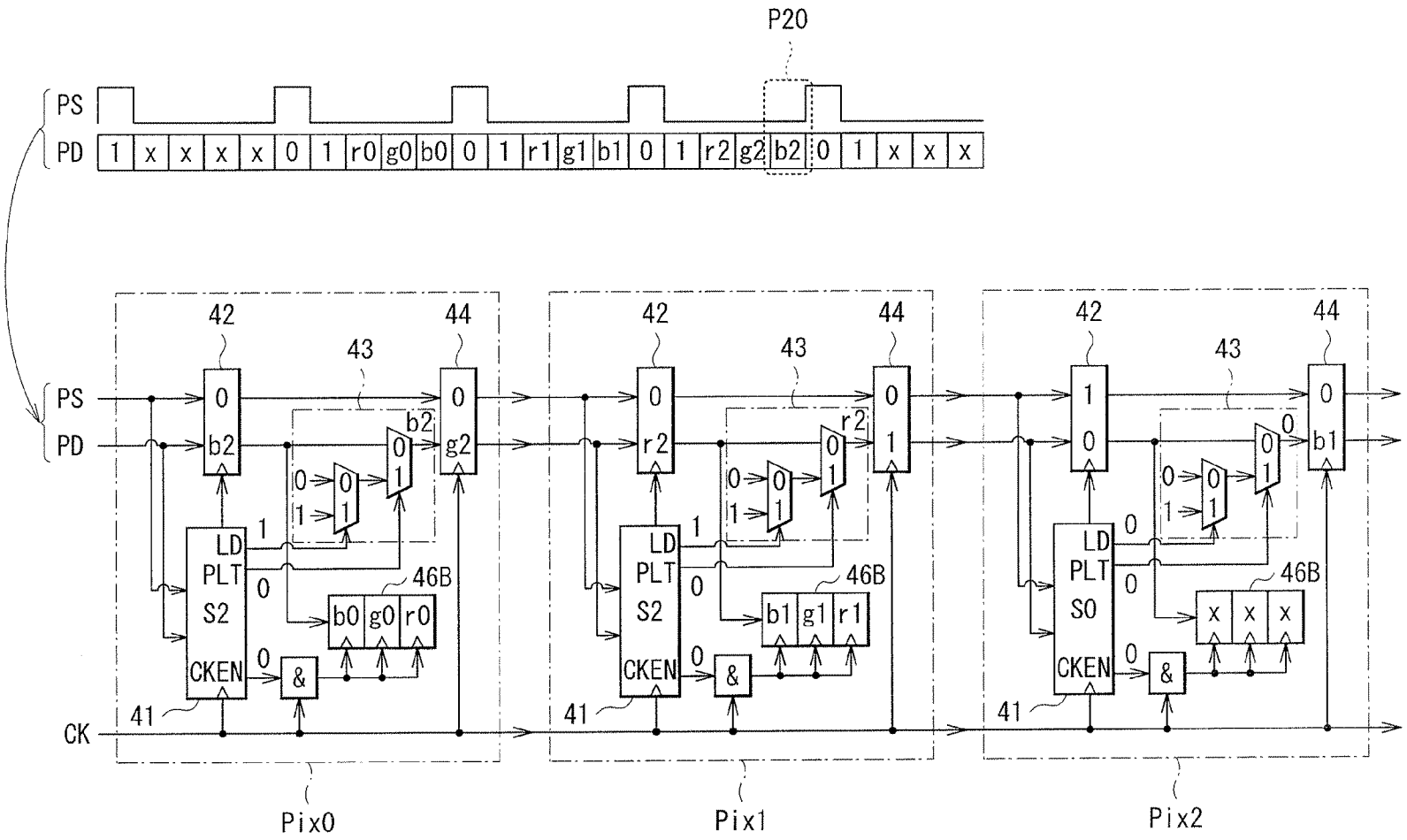

[ FIG. 28 ]
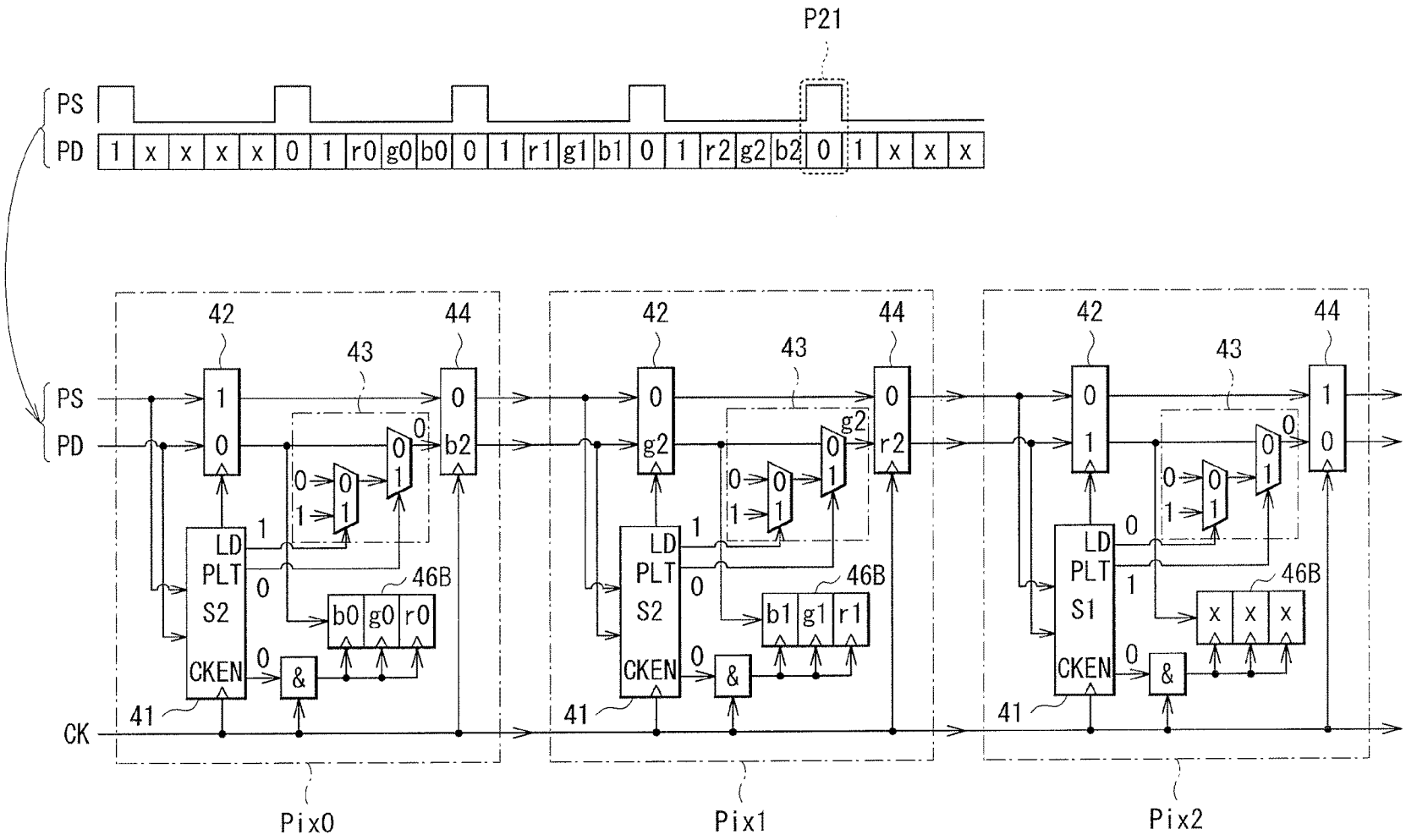

[ FIG. 29 ]
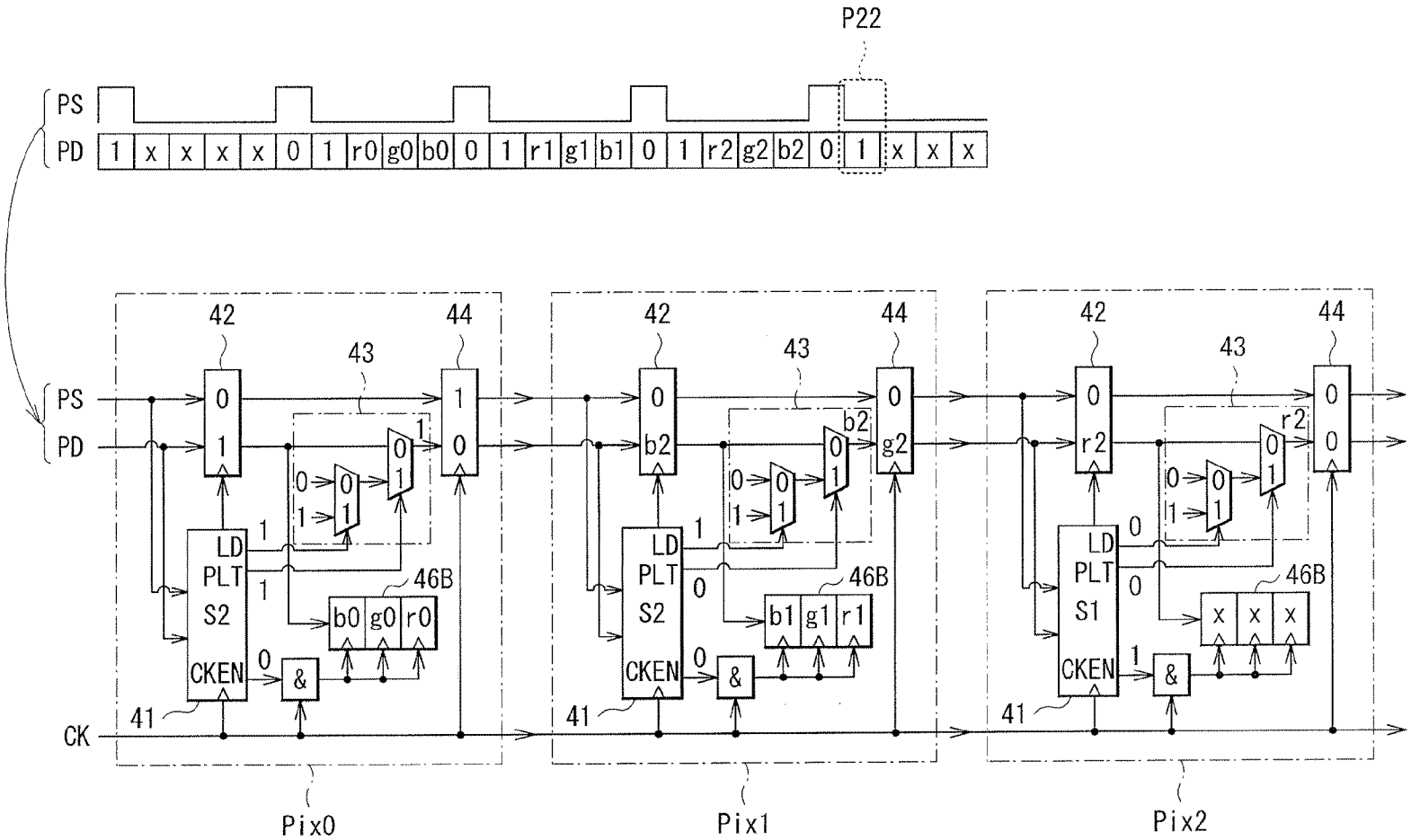

[ FIG. 30 ]
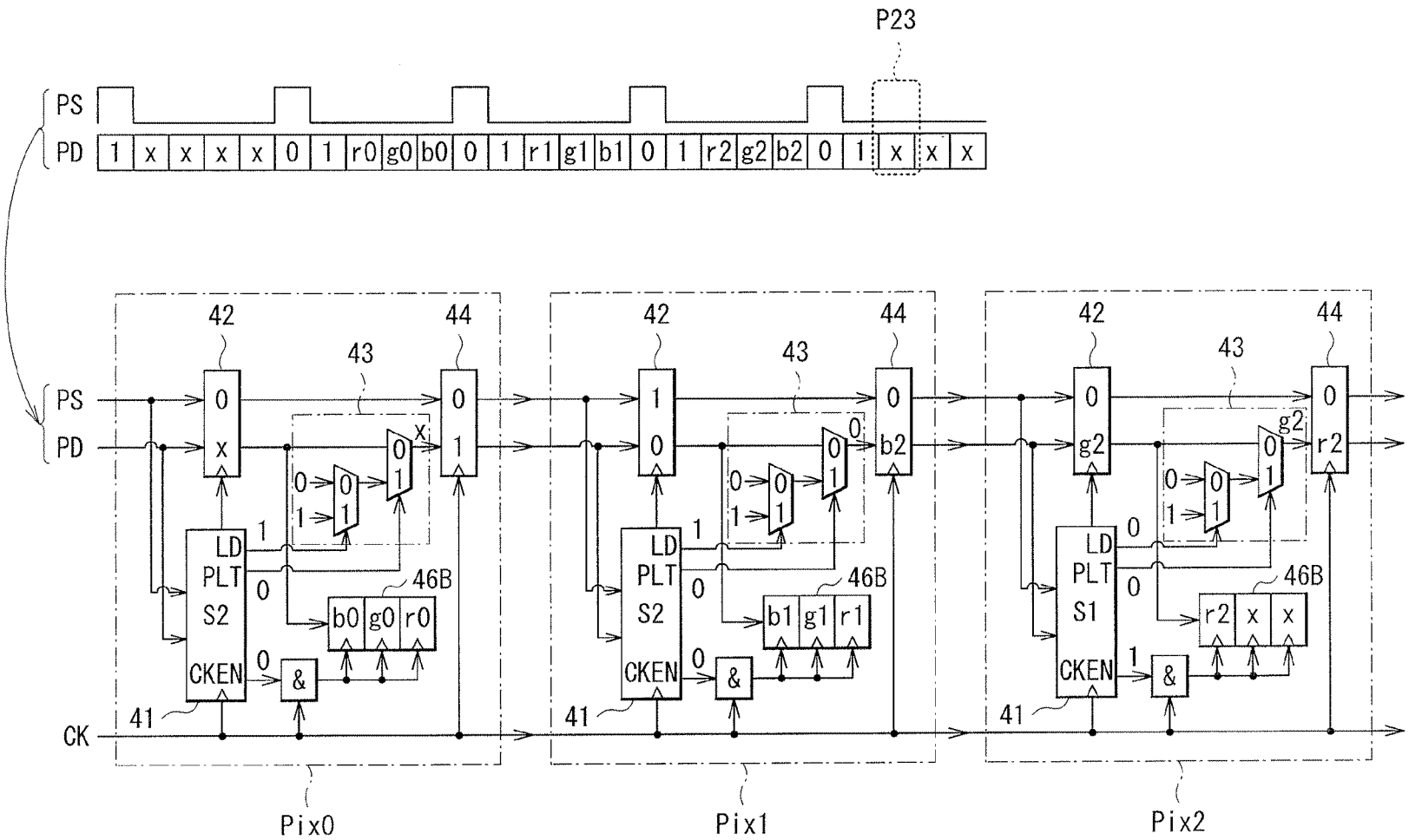

[ FIG. 31 ]
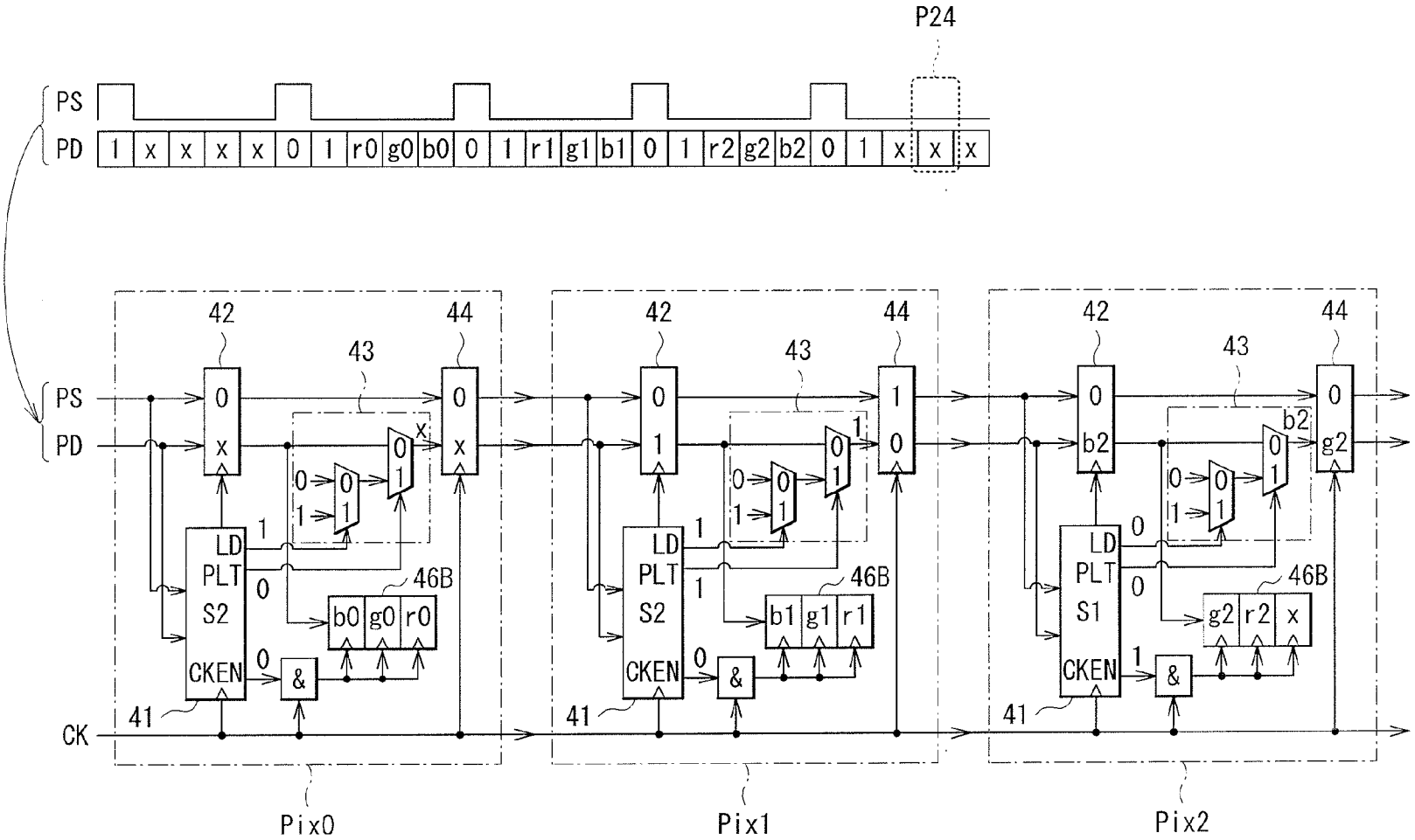

[ FIG. 32 ]
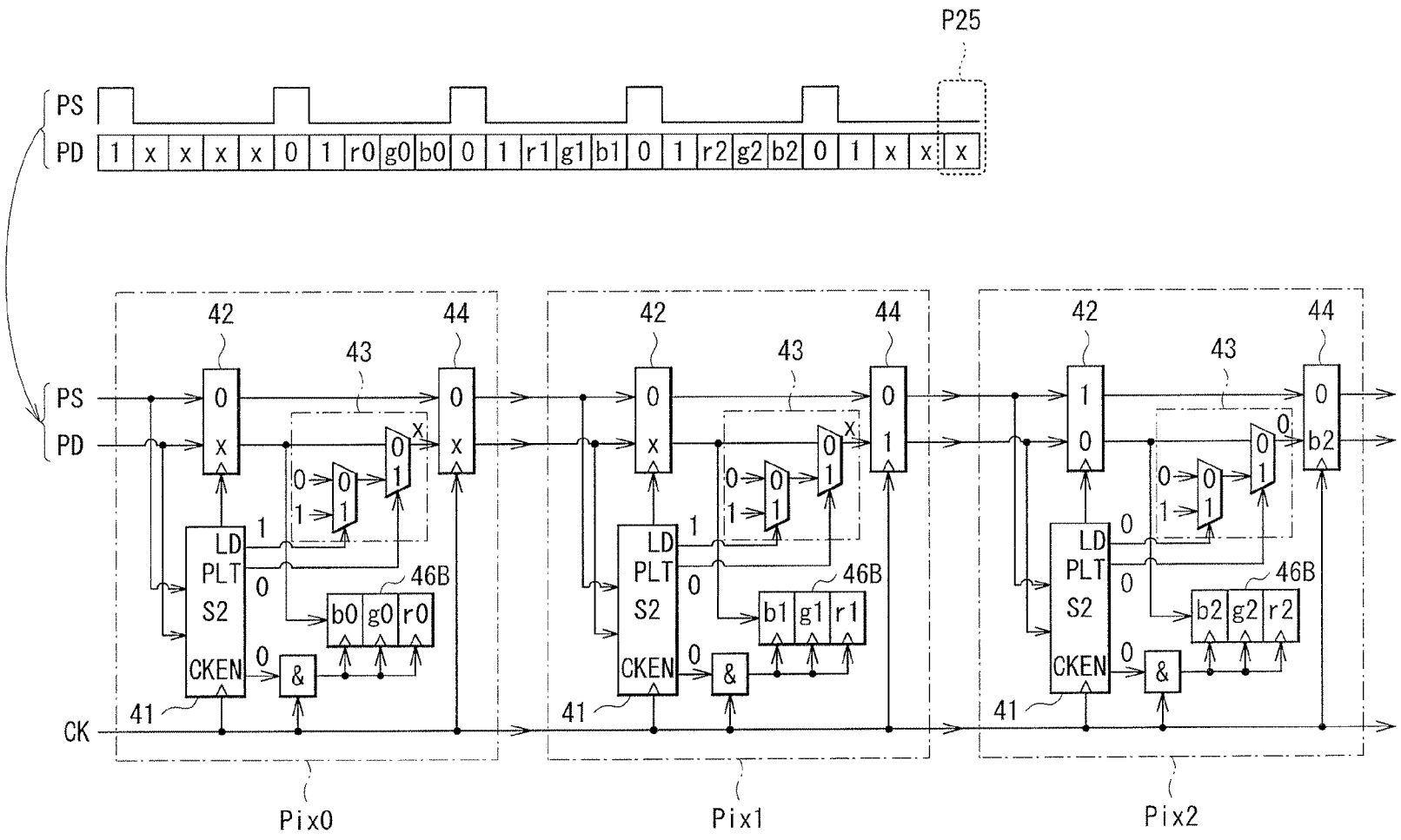

[ FIG. 33 ]
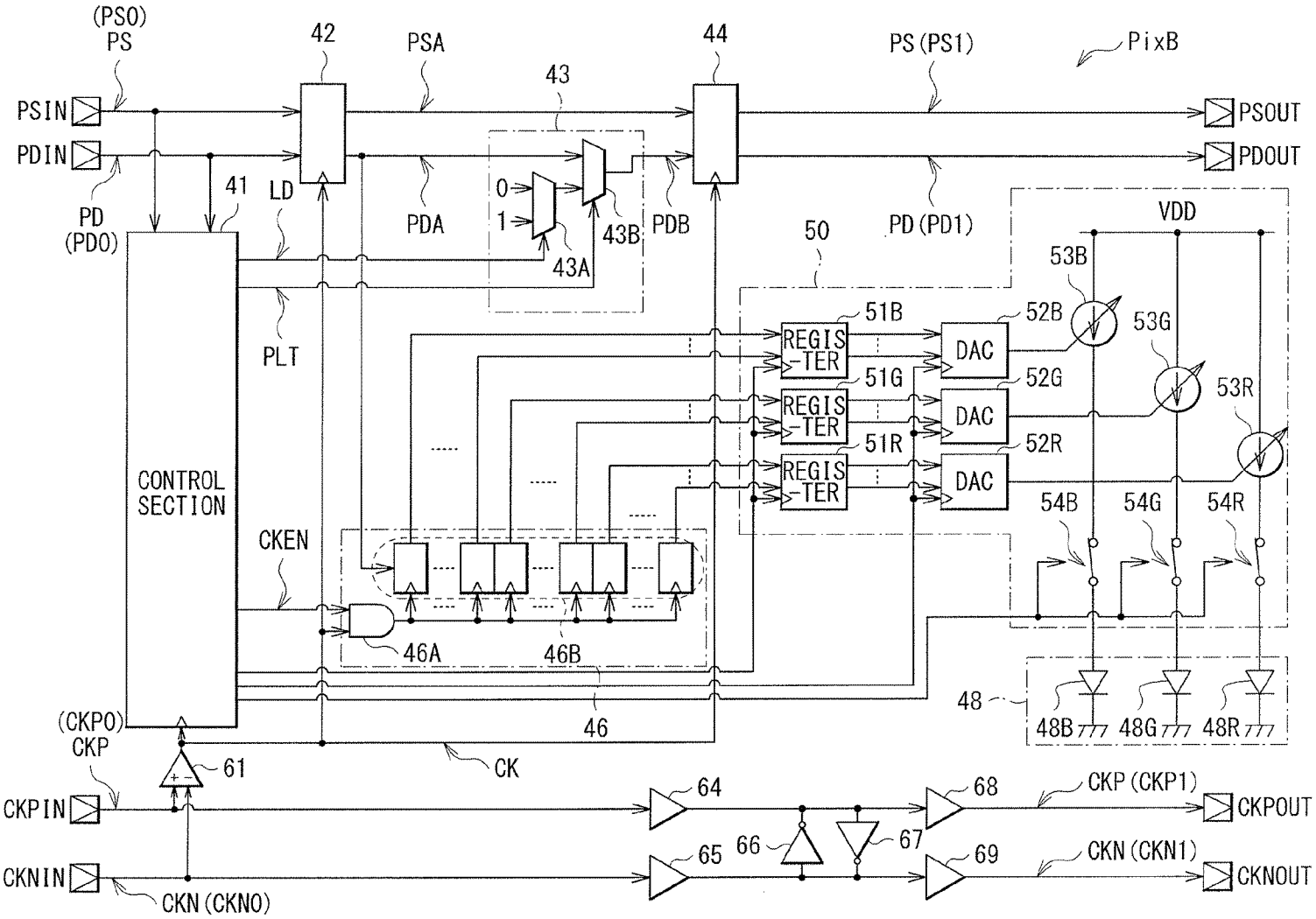

[ FIG. 34 ]
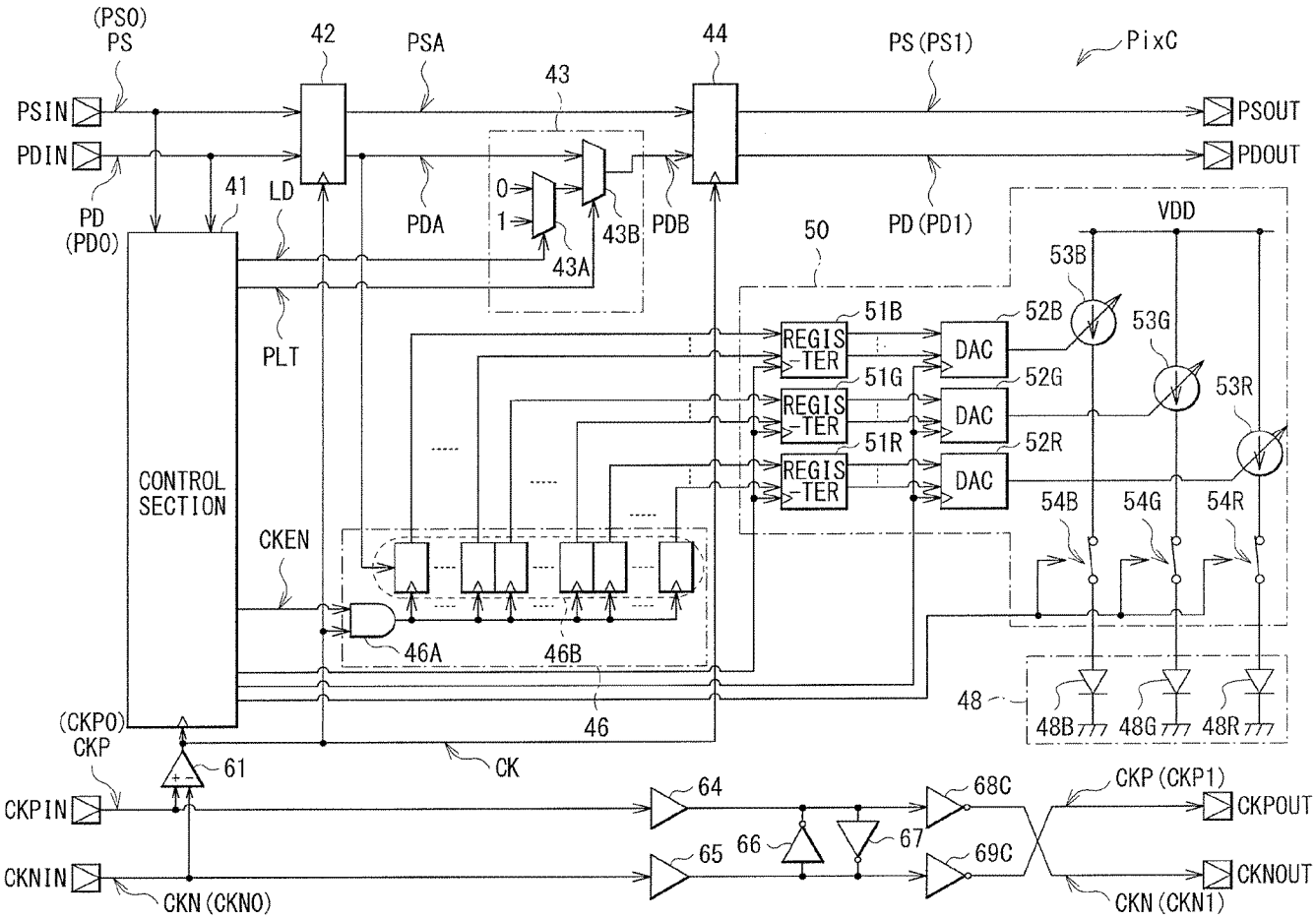

[ FIG. 35 ]
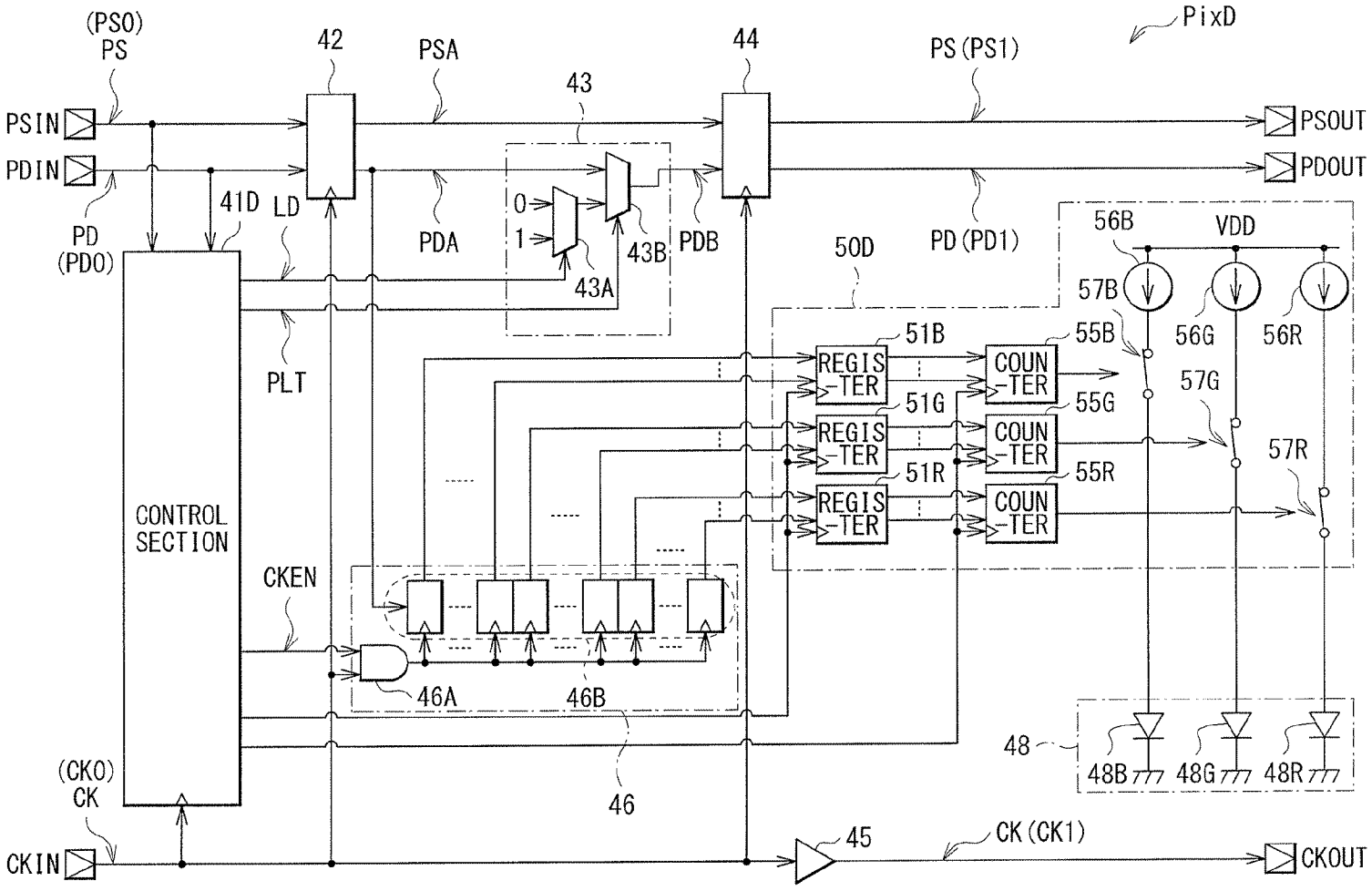

[ FIG. 36 ]
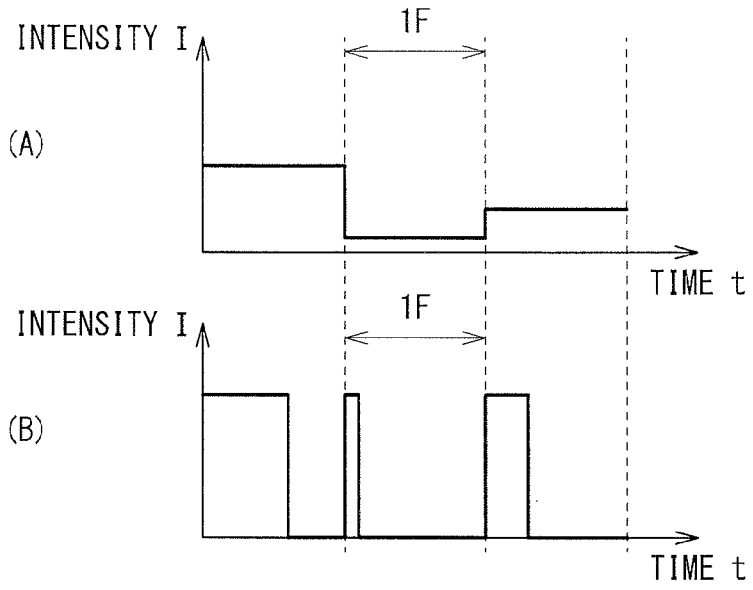

[ FIG. 37 ]
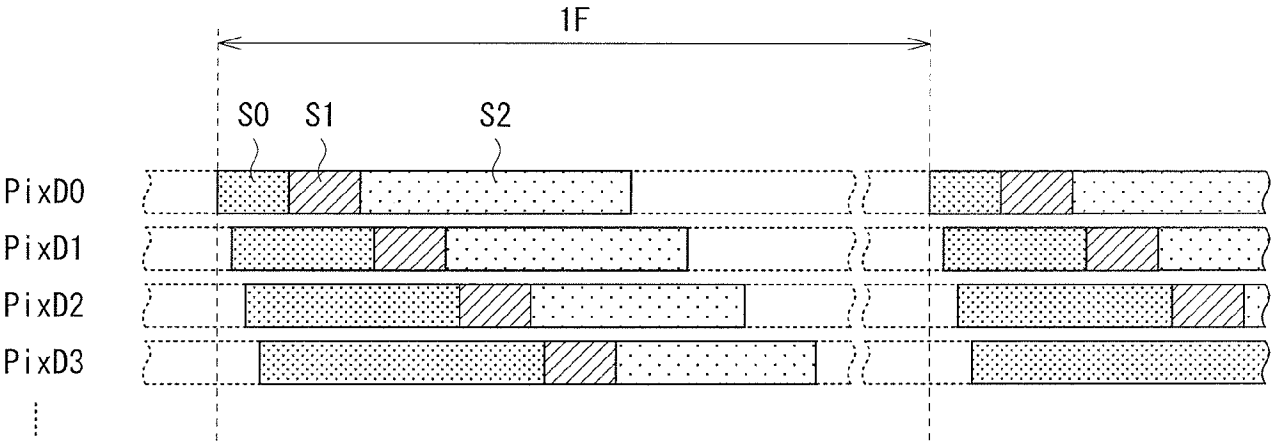

[ FIG. 38 ]
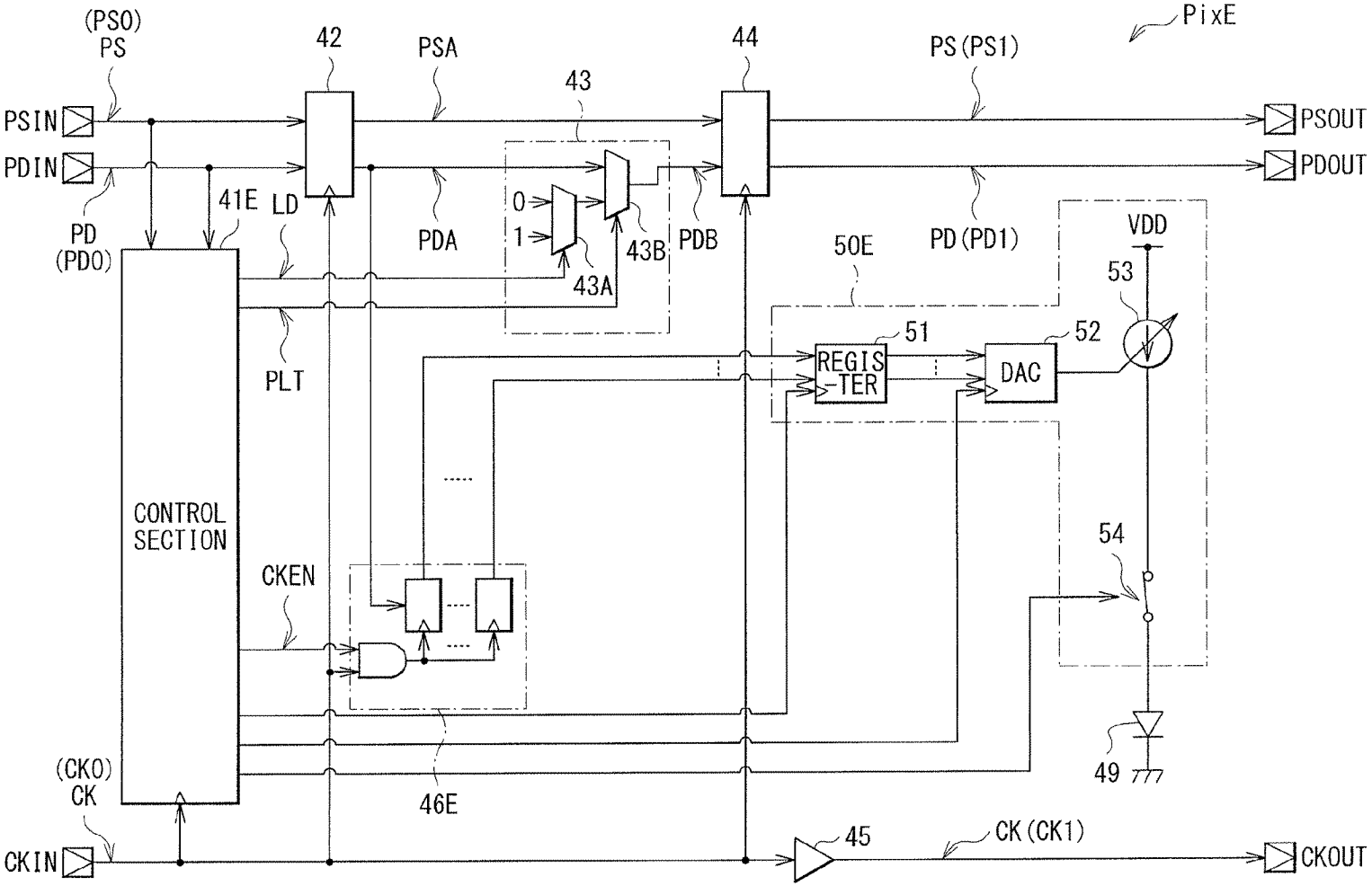

[ FIG. 39 ]
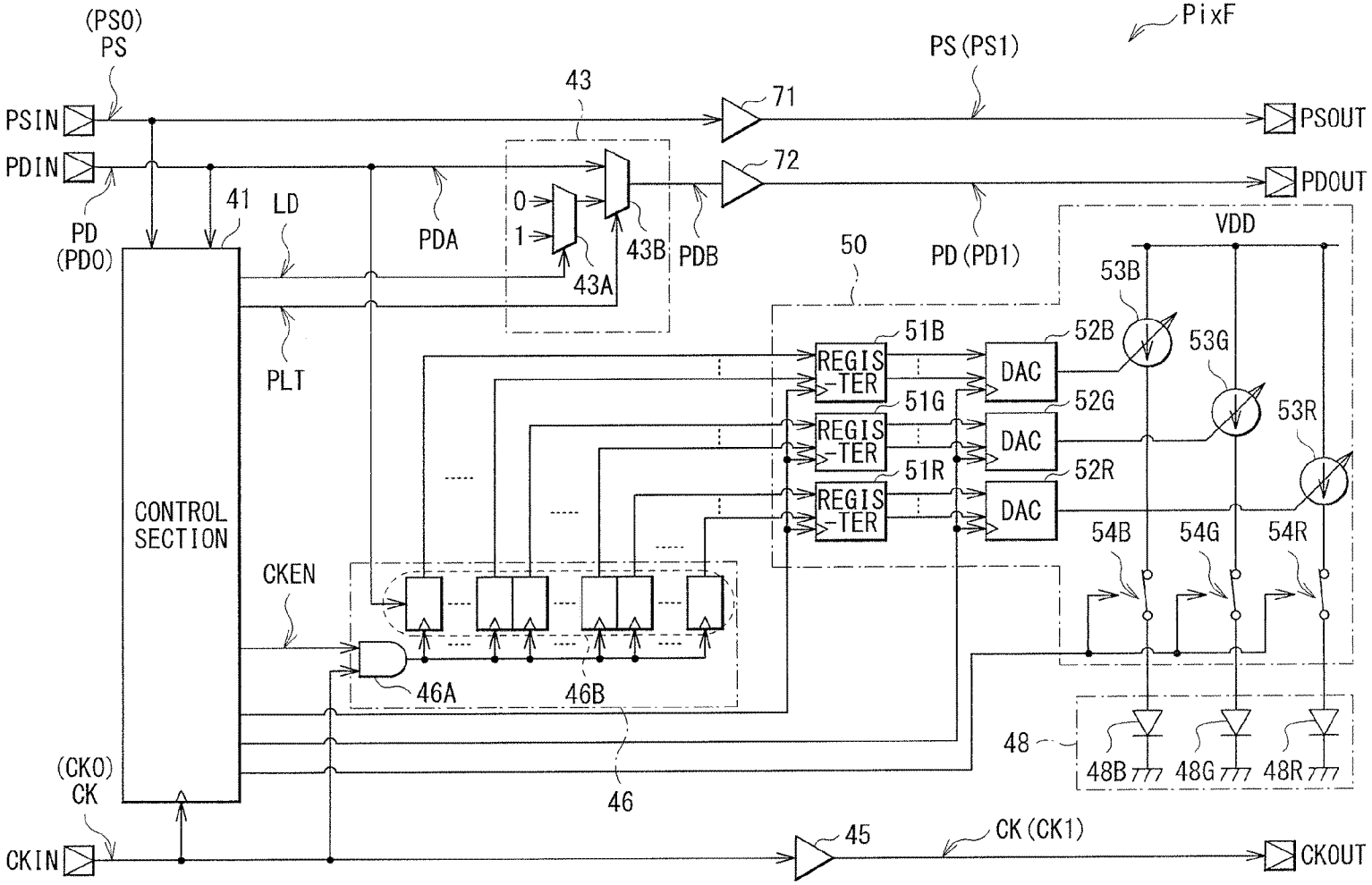

[ FIG. 40 ]
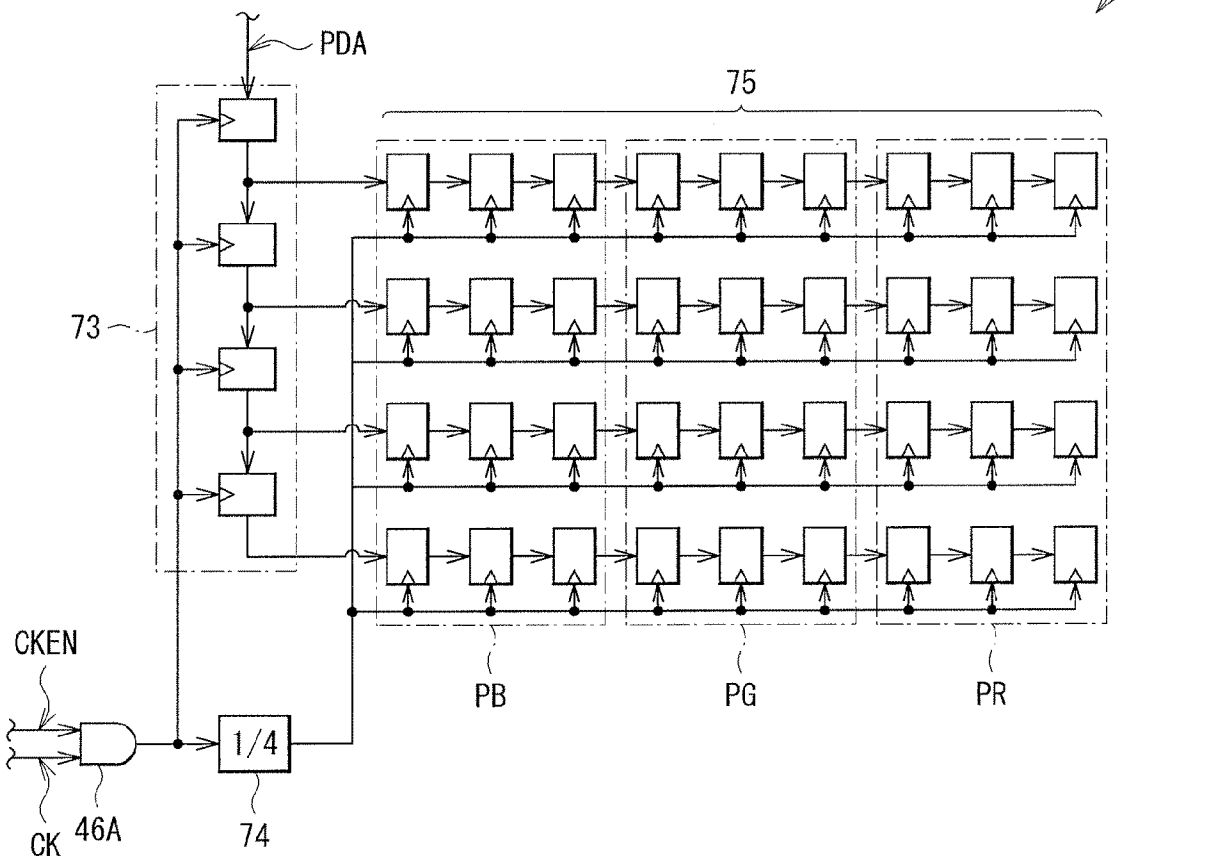

[ FIG. 41 ]
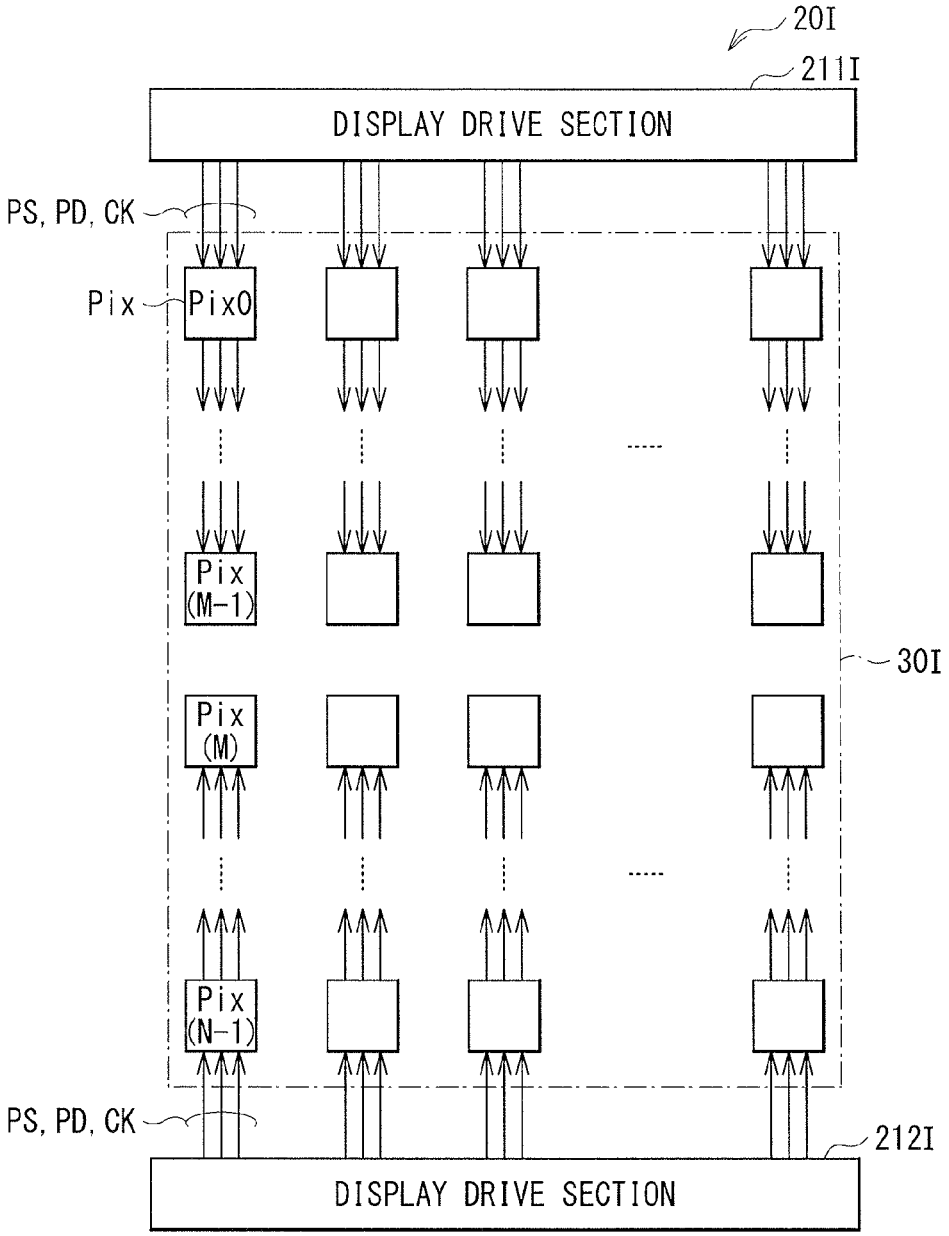

[ FIG. 42 ]
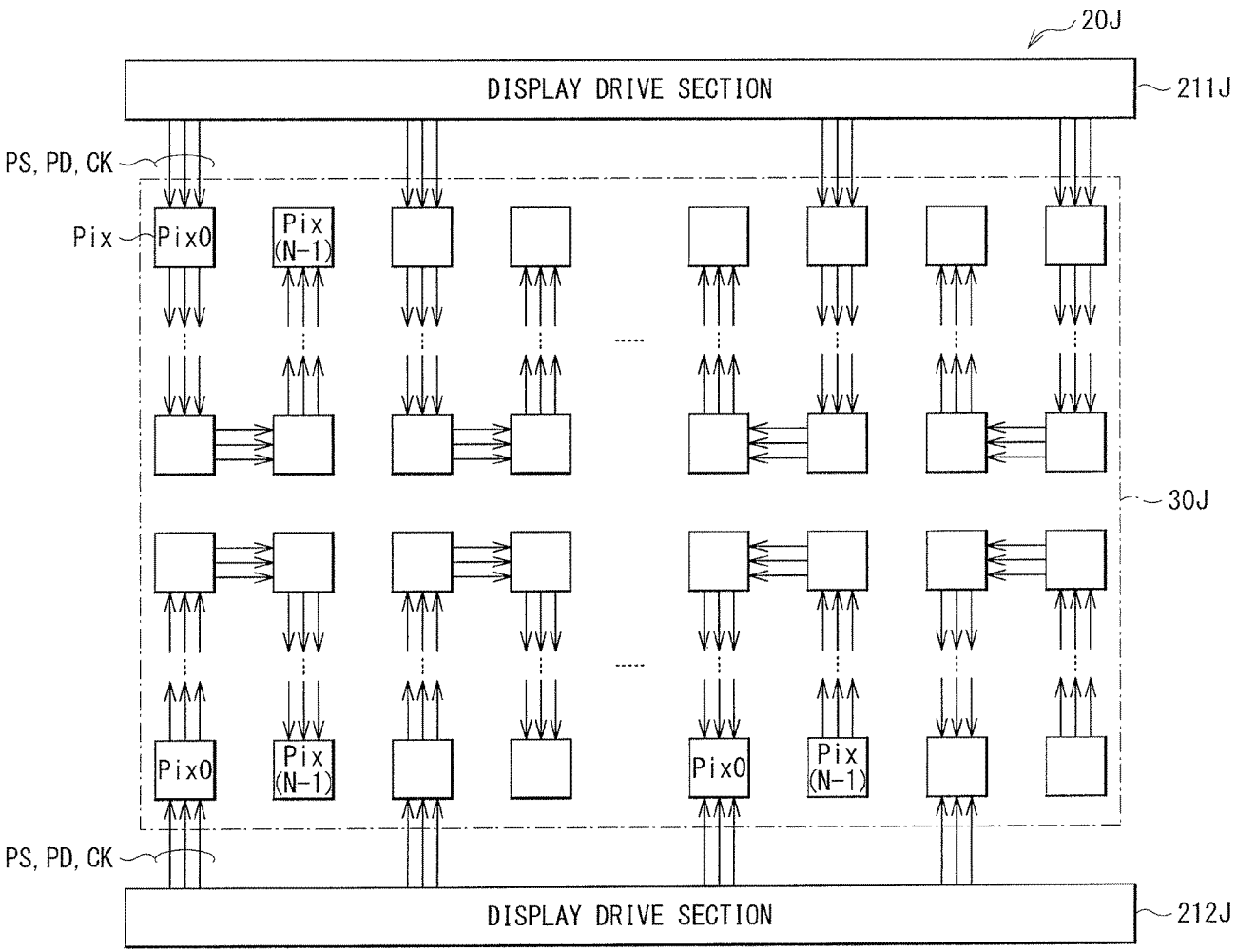

[ FIG. 43 ]
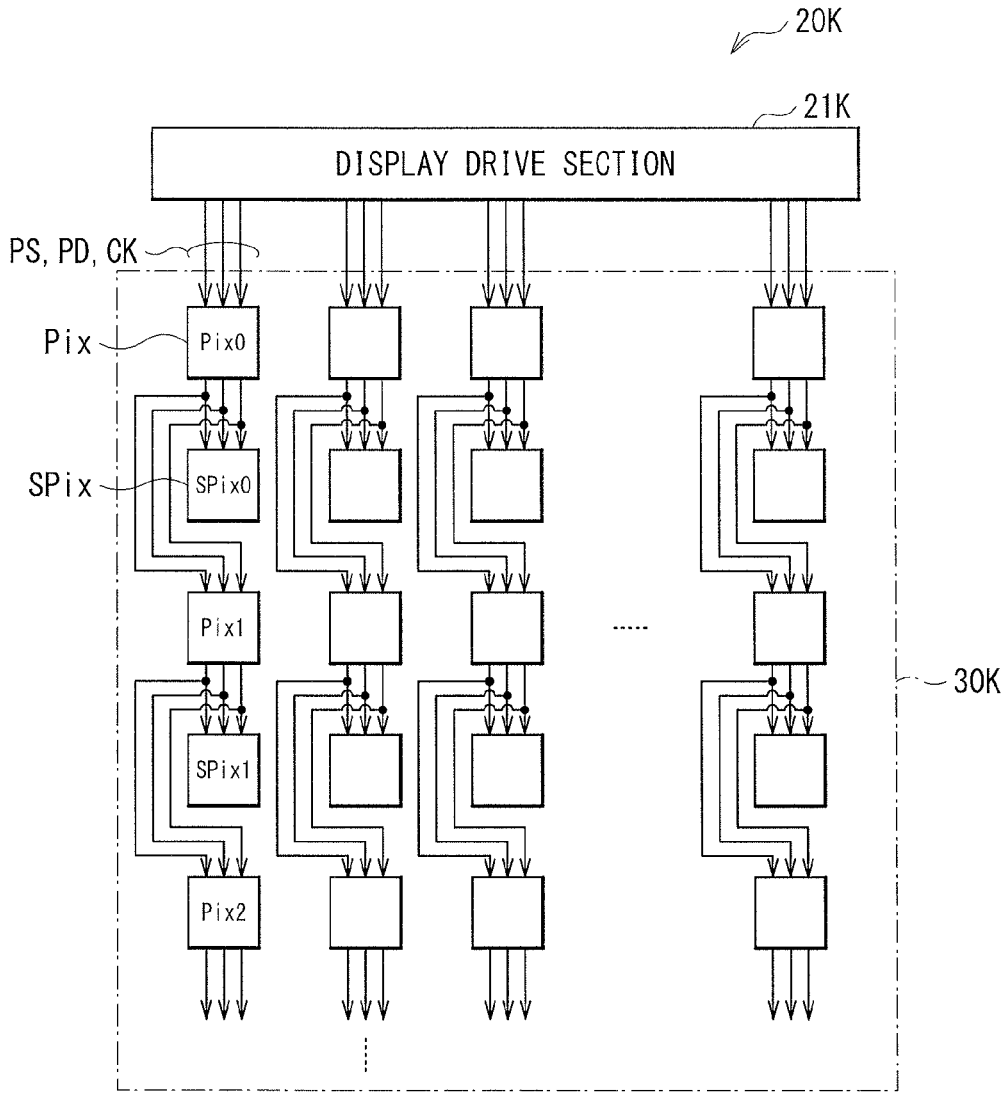

[ FIG. 44 ]
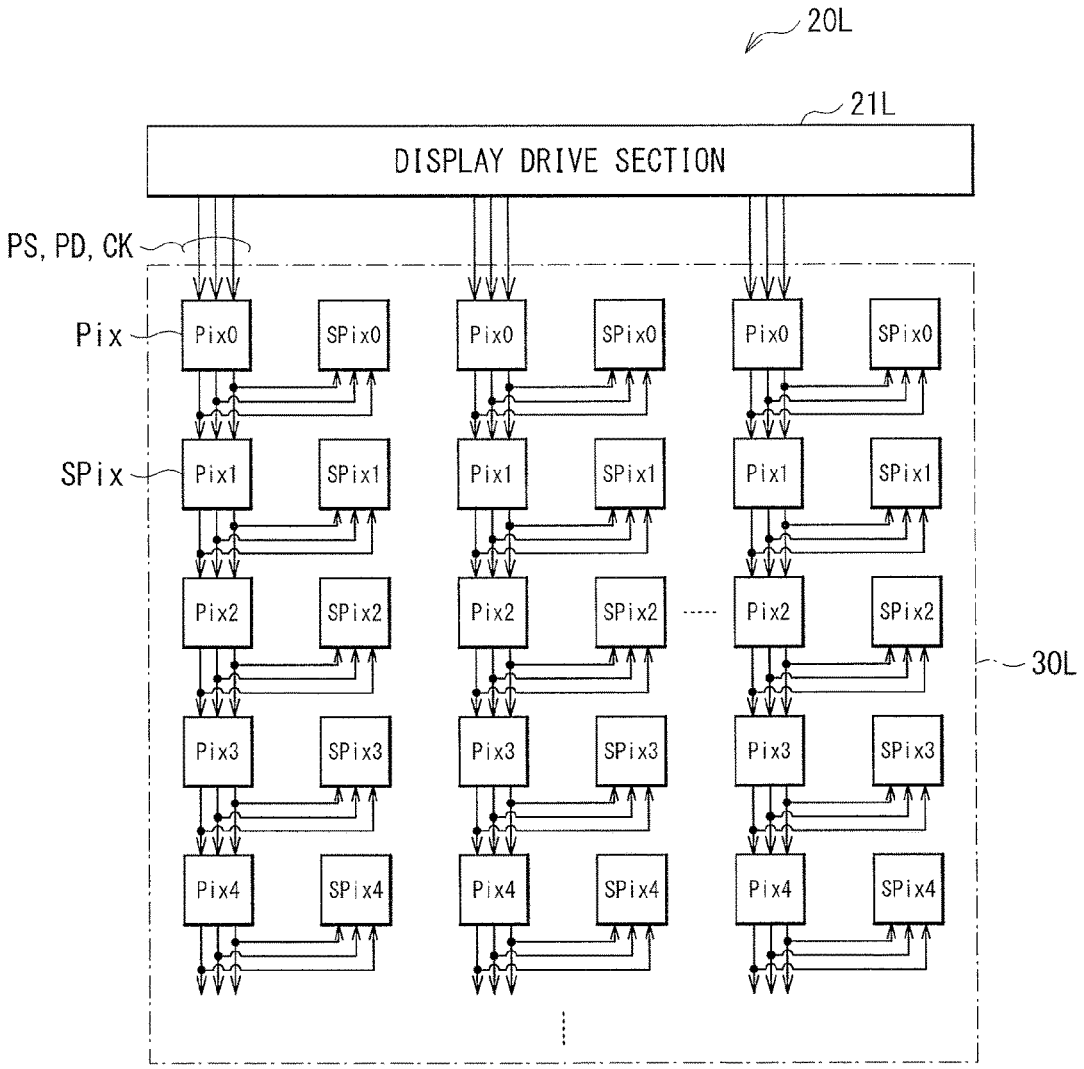

[ FIG. 45 ]
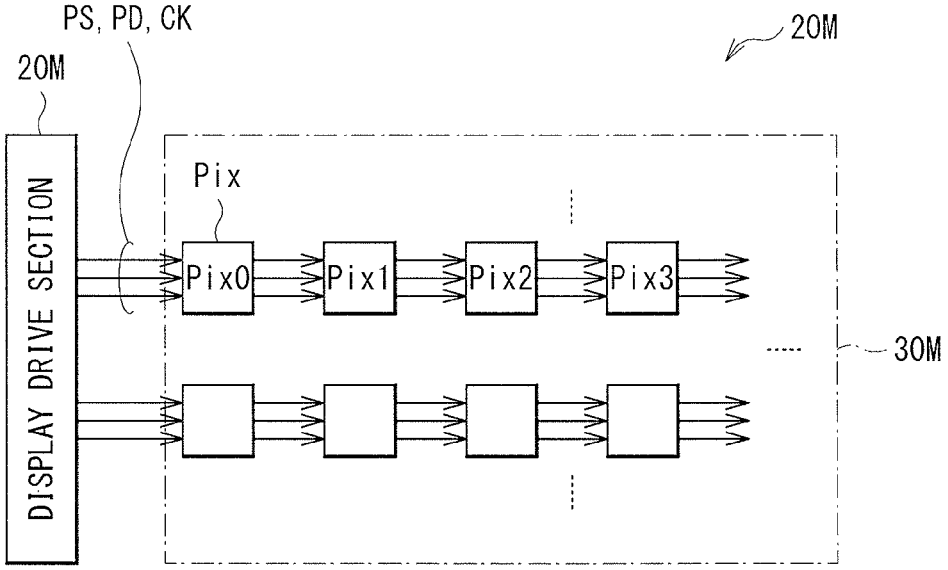

[ FIG. 46 ]
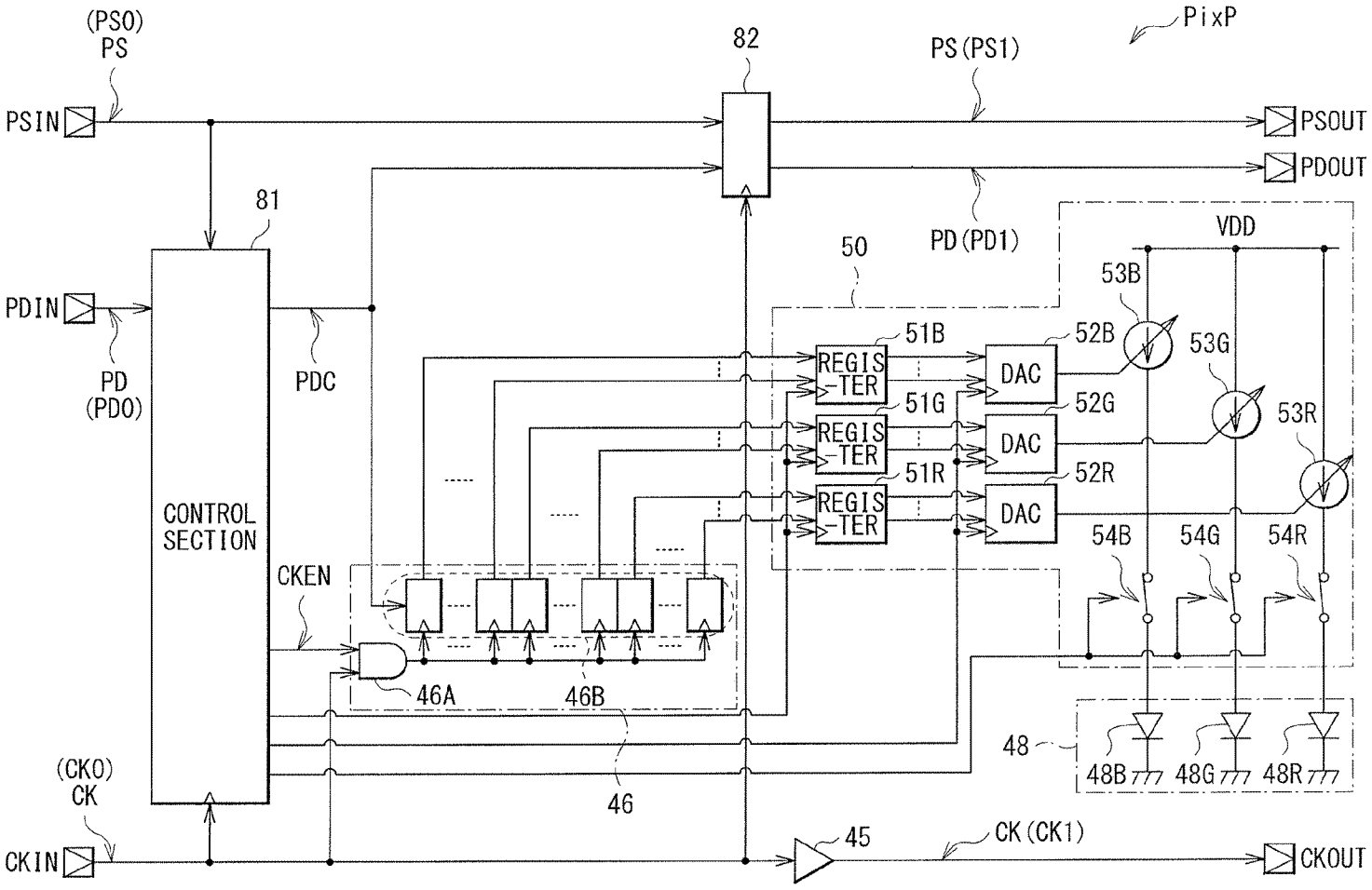

[ FIG. 47 ]
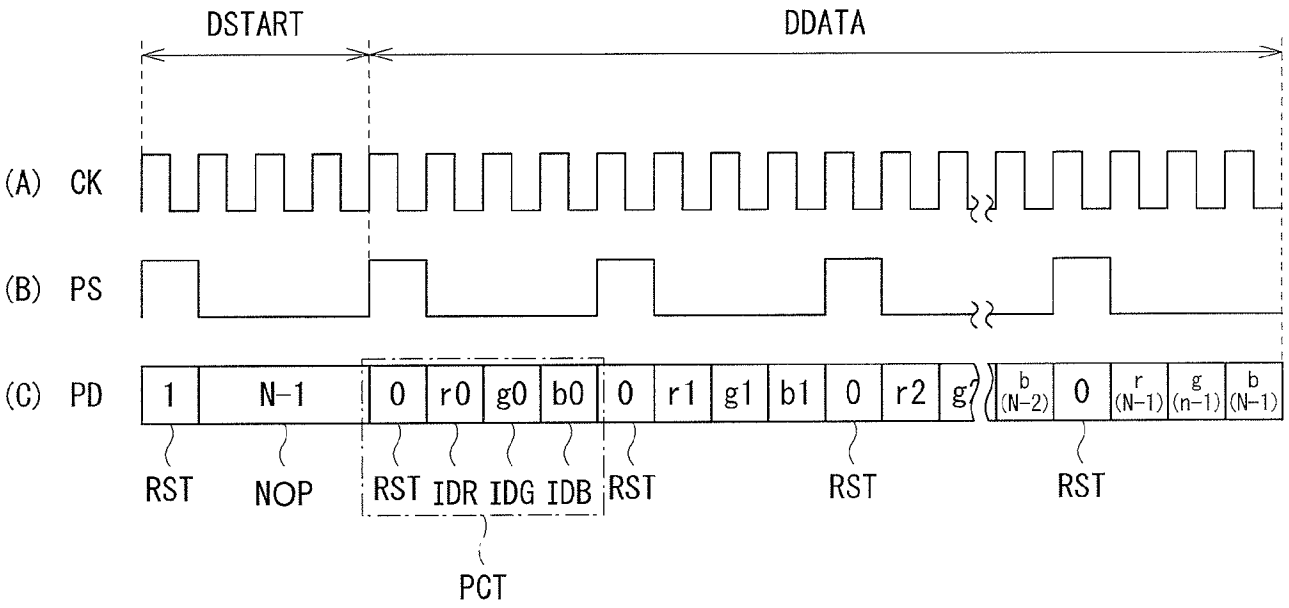

[ FIG. 48 ]
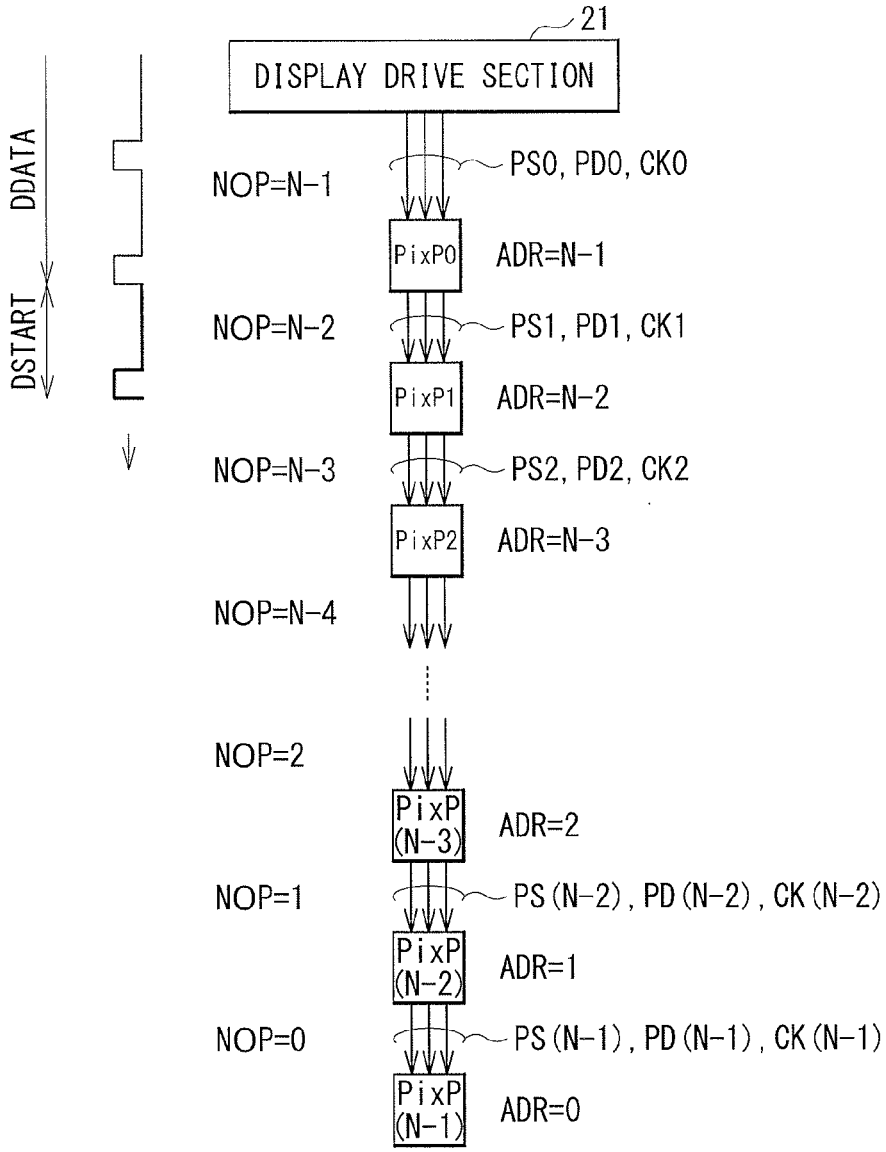

[ FIG. 49 ]
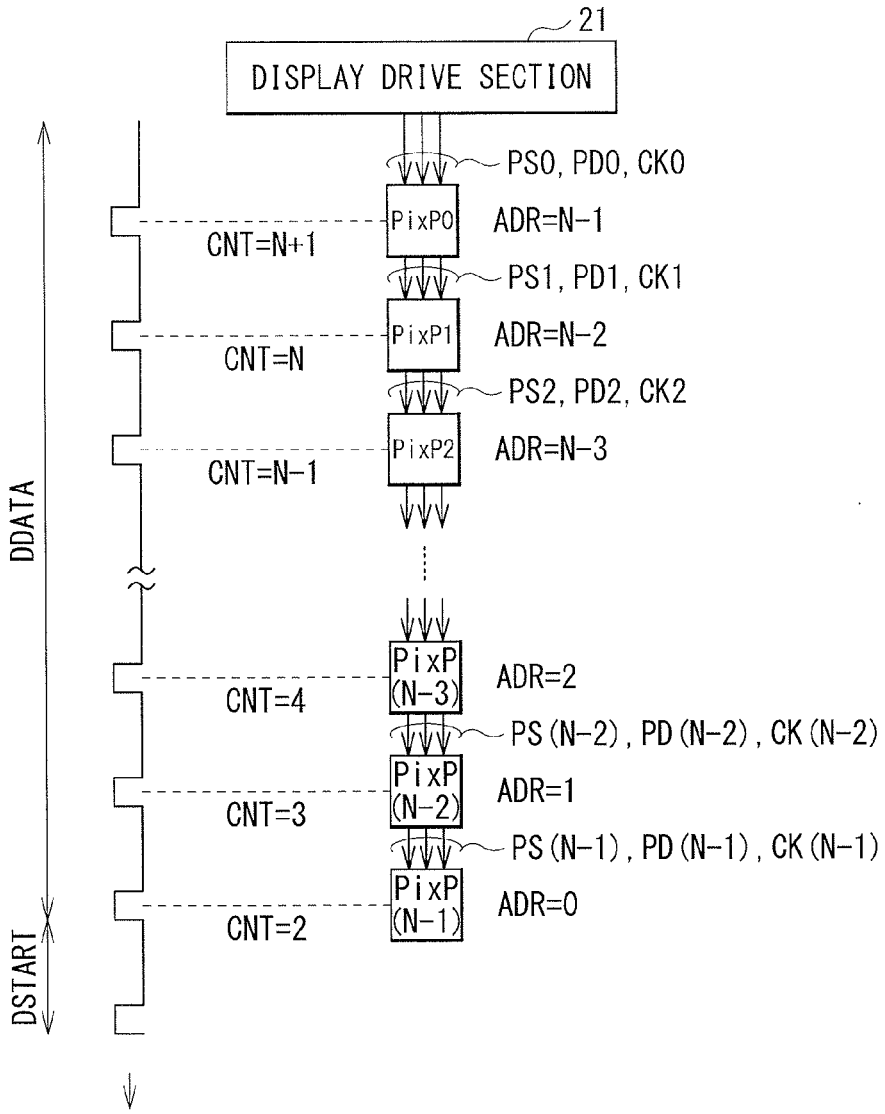

[ FIG. 50 ]
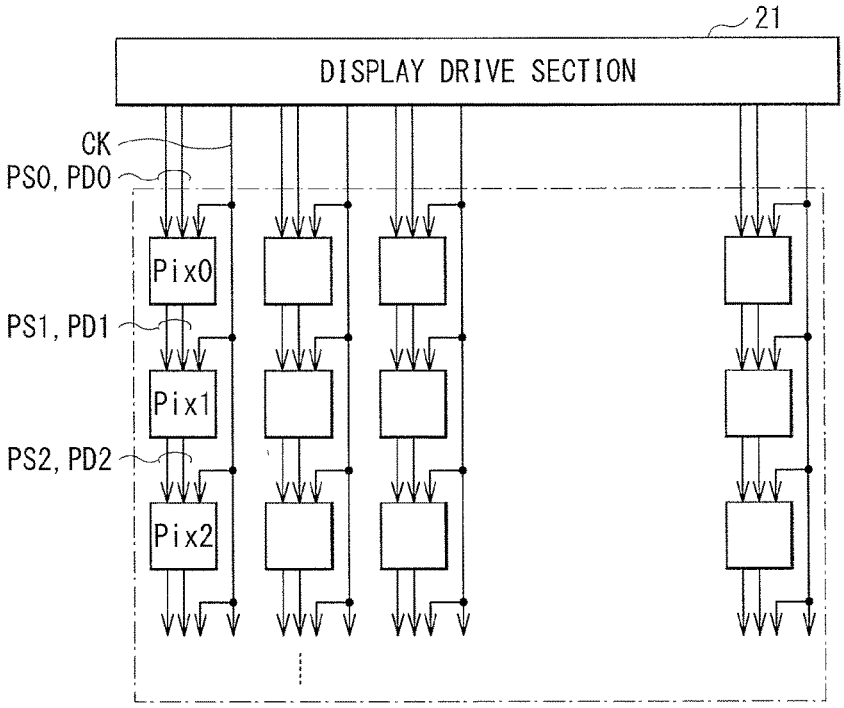

[ FIG. 51 ]
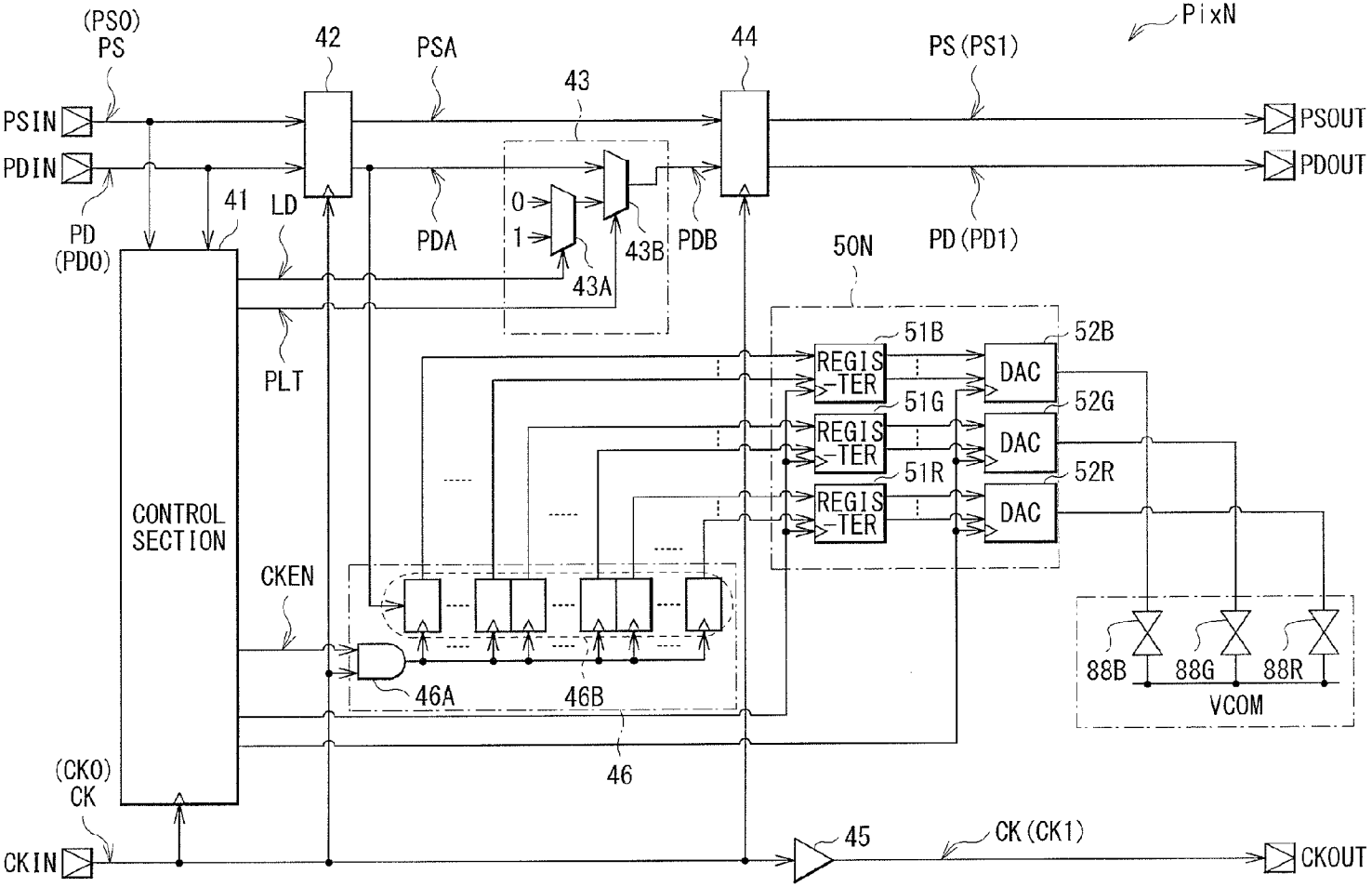

DISPLAY PANEL HAVING DAISY-CHAIN-CONNECTED PIXELS, PIXEL CHIP, AND ELECTRONIC APPARATUS

TECHNICAL FIELD

The present disclosure relates to a display panel configured to display an image, a pixel chip used in the display panel, and an electronic apparatus including the display panel.

BACKGROUND ART

In recent years, in a field of display devices to display images, there has been developed and commercialized a display device (an organic EL display device) using current-driven optical elements, e.g., organic EL (Electro Luminescence) elements, that are configured to be varied in emission intensity according to values of currents flowing therethrough. Unlike liquid crystal elements or the like, organic EL elements are spontaneous light emitting elements, involving no light source (backlight). Therefore, an organic EL display device has features such as higher visible recognizability, lower power consumption, and higher response speed of elements, as compared to those of a liquid crystal display device that involves a light source. Such an organic EL device is often adopted in medium-sized or small-sized display devices.

For example, Patent Literature 1 discloses a so-called active matrix display device in which each pixel is provided with a thin film transistor (TFT) to control light emission of organic EL elements for each pixel. This display device may include a plurality of horizontally extending gate lines and a plurality of vertically extending data lines with pixels provided in the vicinity of respective intersections of the gate lines and the data lines. Thus, pixels are selected line by line based on signals of the gate lines to allow analog pixel voltages to be written in the pixels thus selected.

CITATION LIST

Patent Literature

Patent Literature 1: JP 2012-32828A

SUMMARY OF INVENTION

Now, in a display device, high image quality is desired in general. To be specific, for example, a high definition display device or a display device having a large screen may be frequently desired. Moreover, in some cases, there may be expectation for a display device having high frame rates.

It is therefore desirable to provide a display panel, a pixel chip, and an electronic apparatus that make it possible to enhance image quality.

A display panel according to an embodiment of the present disclosure includes a plurality of first unit pixels. The plurality of first unit pixels each include: a first data input terminal; a first data output terminal; a display element; and a first waveform shaping section, in which the display element is configured to perform display based on first data inputted to the first data input terminal, and the first waveform shaping section is provided on a signal path from the first data input terminal to the first data output terminal.

A pixel chip according to an embodiment of the present disclosure includes: a first data input terminal; a first data output terminal; and a first waveform shaping section. The first waveform shaping section is provided on a signal path from the first data input terminal to the first data output terminal.

An electronic apparatus according to an embodiment of the present disclosure includes the above-described display panel. For example, a television device, a digital camera, a personal computer, a video camera, or a mobile terminal device such as a mobile phone may correspond thereto.

In the display panel, the pixel chip, and the electronic apparatus according to the embodiments of the present disclosure, in each first unit pixel, the first data is inputted to the first data input terminal The first data is waveform shaped in the first waveform shaping section, and is outputted from the first data output terminal.

According to the display panel, the pixel chip, and the electronic apparatus according to the embodiments of the present disclosure, each first unit pixel is provided with the first waveform shaping section on the signal path from the first data input terminal to the first data output terminal. Hence, it is possible to enhance image quality.

BRIEF DESCRIPTION OF DRAWINGS

FIG. 1 is a block diagram illustrating one configuration example of a display device according to an embodiment of the present disclosure.

FIG. 2 is an explanatory diagram illustrating one configuration example of a display panel illustrated in FIG. 1.

FIG. 3 is an explanatory diagram illustrating one configuration example of a data signal.

FIG. 4 is a block diagram illustrating one configuration example of a pixel illustrated in FIG. 2.

FIG. 5 is a state transition diagram illustrating one operation example of a control section illustrated in FIG. 2.

FIG. 6 is an explanatory diagram illustrating one operation example of each pixel illustrated in FIG. 2.

FIG. 7 is an explanatory diagram illustrating one example of signals inputted to a first-stage pixel.

FIG. 8 is an explanatory diagram illustrating one operation example in each pixel.

FIG. 9 is another explanatory diagram illustrating one operation example in each pixel.

FIG. 10 is another explanatory diagram illustrating one operation example in each pixel.

FIG. 11 is another explanatory diagram illustrating one operation example in each pixel.

FIG. 12 is another explanatory diagram illustrating one operation example in each pixel.

FIG. 13 is another explanatory diagram illustrating one operation example in each pixel.

FIG. 14 is another explanatory diagram illustrating one operation example in each pixel.

FIG. 15 is another explanatory diagram illustrating one operation example in each pixel.

FIG. 16 is another explanatory diagram illustrating one operation example in each pixel.

FIG. 17 is another explanatory diagram illustrating one operation example in each pixel.

FIG. 18 is another explanatory diagram illustrating one operation example in each pixel.

FIG. 19 is another explanatory diagram illustrating one operation example in each pixel.

FIG. 20 is another explanatory diagram illustrating one operation example in each pixel.

FIG. 21 is another explanatory diagram illustrating one operation example in each pixel.

FIG. 22 is another explanatory diagram illustrating one operation example in each pixel.

FIG. 23 is another explanatory diagram illustrating one operation example in each pixel.

FIG. 24 is another explanatory diagram illustrating one operation example in each pixel.

FIG. 25 is another explanatory diagram illustrating one operation example in each pixel.

FIG. 26 is another explanatory diagram illustrating one operation example in each pixel.

FIG. 27 is another explanatory diagram illustrating one operation example in each pixel.

FIG. 28 is another explanatory diagram illustrating one operation example in each pixel.

FIG. 29 is another explanatory diagram illustrating one operation example in each pixel.

FIG. 30 is another explanatory diagram illustrating one operation example in each pixel.

FIG. 31 is another explanatory diagram illustrating one operation example in each pixel.

FIG. 32 is another explanatory diagram illustrating one operation example in each pixel.

FIG. 33 is a block diagram illustrating one configuration example of a pixel according to one modification example of the first embodiment.

FIG. 34 is a block diagram illustrating one configuration example of a pixel according to another modification example of the first embodiment.

FIG. 35 is a block diagram illustrating one configuration example of a pixel according to another modification example of the first embodiment.

FIG. 36 is an explanatory diagram to illustrate an operation of the pixel illustrated in FIG. 35.

FIG. 37 is an explanatory diagram illustrating one operation example of each pixel illustrated in FIG. 36.

FIG. 38 is a block diagram illustrating one configuration example of a pixel according to another modification example of the first embodiment.

FIG. 39 is a block diagram illustrating one configuration example of a pixel according to another modification example of the first embodiment.

FIG. 40 is a block diagram illustrating one configuration example of a memory section according to another modification example of the first embodiment.

FIG. 41 is an explanatory diagram illustrating one configuration example of a display panel according to another modification example of the first embodiment.

FIG. 42 is an explanatory diagram illustrating one configuration example of a display panel according to another modification example of the first embodiment.

FIG. 43 is an explanatory diagram illustrating one configuration example of a display panel according to another modification example of the first embodiment.

FIG. 44 is an explanatory diagram illustrating one configuration example of a display panel according to another modification example of the first embodiment.

FIG. 45 is an explanatory diagram illustrating one configuration example of a display panel according to another modification example of the first embodiment.

FIG. 46 is a block diagram illustrating one configuration example of a pixel according to a second embodiment.

FIG. 47 is an explanatory diagram illustrating one example of signals inputted to a first-stage pixel.

FIG. 48 is an explanatory diagram illustrating one operation example in each pixel.

FIG. 49 is another explanatory diagram illustrating one operation example in each pixel.

FIG. 50 is a block diagram illustrating one configuration example of a pixel according to one modification example.

FIG. 51 is a block diagram illustrating one configuration example of a pixel according to one modification example.

DESCRIPTION OF EMBODIMENTS

In the following, some embodiments of the present disclosure will be described with reference to the drawings. It is to be noted that description will be made in the following order.

1. First Embodiment
2. Second Embodiment

<1. First Embodiment>

[Configuration Example]

(Overall Configuration Example)

FIG. 1 illustrates one configuration example of a display device according to a first embodiment. The display device 1 may be a television device including an active matrix display panel using an LED (Light Emitting Diode) as a display element. It is to be noted that, since a display panel and a pixel chip according to the embodiments of the present disclosure are embodied by the present embodiment, description thereof will be made together.

The display device 1 may include an RF (Radio Frequency) section 11, a demodulation section 12, a demultiplexer section 13, a decoder section 14, a signal conversion section 15, and a display panel 20.

The RF section 11 is configured to perform processing such as, but not limited to, down conversion on a broadcast wave (an RF signal) received in an antenna 9. The demodulation section 12 is configured to perform demodulation processing on a signal supplied from the RF section 11. The demultiplexer section 13 is configured to separate a video signal and an audio signal from a signal (stream) which is supplied from the demodulation section 12 and in which the video signal and the audio signal are multiplexed.

The decoder section 14 is configured to decode a signal (i.e., the video signal and the audio signal) supplied from the demultiplexer section 13. Specifically, in this example, the signal supplied from the demultiplexer section 13 may be a signal encoded by an MPEG2 (Moving Picture Experts Group phase 2), and the decoder section 14 may perform decoding processing on this signal.

The signal conversion section 15 is configured to perform format conversion of a signal. Specifically, in this example, a signal supplied from the decoder section 14 may be a signal in a YUV format, and the signal conversion section 15 may convert the format of the signal to an RGB format. Then, the signal conversion section 15 may output the signal thus format-converted as a picture signal Sdisp.

The display panel 20 may be an active matrix display panel with use of an LED as a display element. The display panel 20 may include a display drive section 21 and a display section 30.

The display drive section 21 is configured to control light emission in each pixel Pix (which will be described later) of the display section 30, based on the picture signal Sdisp supplied from the signal conversion section 15. Specifically, as will be described later, the display drive section 21 may control light emission in each pixel Pix by supplying each column of the pixels Pix of the display section 30 with data signals PS and PD, and a clock signal CK.

FIG. 2 illustrates one configuration example of the display section 30. In the display section 30, a plurality of the pixels Pix may be arrayed in a matrix. Specifically, in this example, the M pixels Pix may be arrayed horizontally (laterally), and the N pixels Pix vertically (longitudinally).

The pixels Pix (Pix0, Pix1, Pix2, . . . , and Pix (N−1)) arrayed vertically may be daisy-chain-connected. The display drive section 21 may supply a first-stage pixel Pix0 in one column of the daisy-chain-connected pixels Pix with the data signals PS and PD (PS0 and PD0), and the clock signal CK (CK0). The pixel Pix0 may generate the data signals PS and PD (PS1 and PD1), and the clock signal CK (CK1), based on the data signals PS0 and PD0, and the clock signal CK0. The pixel Pix0 may supply a next-stage pixel Pix1 with the generated signals. The next-stage pixel Pix1 may generate the data signals PS and PD (PS2 and PD2), and the clock signal CK (CK2), based on the data signals PS1 and PD1, and the clock signal CK1. The pixel Pix1 may supply a next pixel Pix2 after next with the generated signals. The same may apply to the subsequent pixels Pix2 to Pix (N−2). Then, a last-stage pixel Pix (N−1) may receive the data signals PS and PD (PS(N−1) and PD(N−1)), and the clock signal CK (CK(N−1)) generated by the preceding-stage pixel Pix(N−2). In this way, the pixels Pix may be daisy-chain-connected with respect to the data signals PS and PD, and also may be daisy-chain-connected with respect to the clock signal CK.

FIG. 3 illustrates one configuration example of the data signals PS and PD. FIG. 3 illustrates the data signals PS and PD concerning one pixel Pix. In other words, the display drive section 21 may supply the daisy-chain-connected N pixels Pix with the data signals PS and PD in which N signals illustrated in FIG. 3 are coupled together. In the following, the data signal PD concerning one pixel Pix will be also called a pixel packet PCT.

The data signal PD may include a flag RST, a flag PL, and intensity data ID. The flag RST may indicate, as will be described later, a first pixel packet in each frame. Specifically, the flag RST may become "1" in the first pixel packet PCT in each frame, and may become "0" in the other pixel packets PCT in the relevant frame. The flag PL may indicate whether the intensity data ID in the relevant pixel packet PCT has been already read by any pixel Pix. Specifically, the flag PL may become "1" when the intensity data ID has not been read yet, and may become "1" when the intensity data ID has been already read. The intensity data ID may define emission intensity in each pixel Pix. The intensity data ID may include intensity data IDR, intensity data IDG, and intensity data IDB. The intensity data IDR may indicate red (R) emission intensity. The intensity data IDG may indicate green (G) emission intensity. The intensity data IDB may indicate blue (B) emission intensity. In this example, the intensity data IDR, IDG, and IDB each may be a 12-bit code.

The data signal PS may be a signal that becomes "1" when the data signal PD indicates the flag RST, and becomes "0" when otherwise indicated. In other words, the data signal PS may be a signal that becomes "1" only at a start of each pixel packet PCT.

Each pixel Pix may receive the data signals PS and PD, and the clock signal CK from the preceding-stage pixel Pix, and may supply the next-stage pixel Pix with the received data signals PS and PD, and the received clock signal CK. Then, each pixel Pix may read, from the data signal PD, the intensity data ID concerning the relevant pixel Pix, and may emit light with emission intensity according to the intensity data ID.

FIG. 4 illustrates one configuration example of the pixel Pix. The pixel Pix may include a control section 41, flip-flops 42 and 44, a selector section 43, a buffer 45, a memory section 46, a drive section 50, and a light emitting section 48.

It is to be noted that, in the following, for convenience of explanation, description will be given with use of the first-stage pixel Pix0 in one column of the daisy-chain-connected pixels Pix; however, the same may apply to the other pixels Pix1 to Pix (N−1).

The pixel Pix0 may generate the data signals PS1 and PD1, and the clock signal CK1, based on the data signal PS0 inputted to an input terminal PSIN, the data signal PD0 inputted to an input terminal PDIN, and the clock signal CK0 inputted to an input terminal CKIN. Then, the pixel Pix0 may output the data signal PS1 from an output terminal PSOUT, may output the data signal PD1 from an output terminal PDOUT, and may output the clock signal CK1 from an output terminal CKOUT.

The control section 41 may be a state machine that is configured to set a state of the pixel Pix0 and to generate signals LD, PLT, and CKEN, based on the data signals PS0 and PD0, and the clock signal CK0. The signal LD and the signal PLT may be, as will be described later, signals to rewrite the flag PL included in the data signal PD. Specifically, the signal LD may be a signal that becomes the flag PL by the rewriting, and the signal PLT may be a control signal to indicate a timing of the rewriting. Moreover, the signal CKEN may be, as will be described later, a control signal to instruct the memory section 46 about a timing of storing the intensity data ID. Further, the control section 41 may also have a function of supplying the drive section 50 with a control signal.

The flip-flop 42 is configured to sample the data signal PS0 based on the clock signal CK0, and to output a result of the sampling as a data signal PSA. Also, the flip-flop 42 is configured to sample the data signal PD0 based on the clock signal CK0, and output a result of the sampling as a data signal PDA. The flip-flop 42 may be configured of, for example, a D-type flip-flop circuit to sample the data signal PS0 and a D-type flip-flop circuit to sample the data signal PD0.

The selector section 43 is configured to generate a data signal PDB, based on the data signal PDA, and the signals LD and PLT. The selector section 43 may include selectors 43A and 43B. In the selector 43A, "0" may be inputted to a first input terminal; "1" may be inputted to a second terminal; and the signal LD may be inputted to a control input terminal. The selector 43A may output "0" inputted to the first input terminal when the signal LD is "0", and may output "1" inputted to the second input terminal when the signal LD is "1". In the selector 43B, the data signal PDA may be inputted to a first input terminal; an output signal from the selector 43A may be inputted to a second input terminal; and the signal PLT may be inputted to a control input terminal. The selector 43B may output the data signal PDA inputted to the first input terminal when the signal PLT is "0", and may output the output signal from the selector 43A, which is inputted to the second input terminal, when the signal PLT is "1". The selector 43 is configured to supply the flip-flop 44 with an output signal from the selector 43B, as the data signal PDB.

With this configuration, the selector section 43 may output, as the data signal PDB, the data signal PDA as it is in a period in which the signal PLT is "0", and may output, as the data signal PDB, the signal LD in a period in which the signal PLT is "1". The signal PLT may be a signal that becomes "1" in a period in which the data signal PDA indicates the flag PL, and becomes "0" in other periods. In other words, the selector section 43 is configured to generate the data signal PDB by replacing the flag PL with the signal LD in the data signal PDA.

The flip-flop 44 is configured to sample the data signal PSA based on the clock signal CK0, and to output a result of the sampling as a data signal PS1. Also, the flip-flop 44 is configured to sample the data signal PDB based on the clock signal CK0, and to output a result of the sampling as the data signal PD1. The flip-flop 44 may be configured of, for example, two D-type flip-flop circuits, similarly to the flip-flop 42.

The buffer 45 is configured to perform waveform shaping on the clock signal CK0 and to output the waveform-shaped clock signal as the clock signal CK1.

The memory section 46 is configured to store the intensity data ID. The memory section 46 may include an AND circuit 46A and a shift register 46B. The AND circuit 46A is configured to obtain a logical product of a signal of a first input terminal and a signal of a second input terminal. In the AND circuit 46A, the signal CKEN supplied from the control section 41 may be inputted to the first input terminal; and the clock signal CK0 may be inputted to the second input terminal. The shift register 46B may be, in this example, a 36-bit shift register. In the shift register 46B, the data signal PDA may be inputted to a data input terminal; and an output signal of the AND circuit 46A may be inputted to a clock input terminal.

With this configuration, the memory section 46 may store data included in the data signal PDA in a period in which the signal CKEN is "1". The signal CKEN may be, as will be described later, a signal that becomes "1" in a period in which the data signal PDA indicates 36-bit pixel data ID concerning the pixel Pix0, and becomes "0" in other periods. In this way, the AND circuit 46A may supply the shift register 46B with the clock signal in the period in which the signal PDA indicates the pixel data ID concerning the pixel Pix0. Thus, the shift register 46B may store the 36-bit pixel data ID concerning the pixel Pix0. At this occasion, in the shift register 46B, a 12-bit portion from a last stage may store the intensity data IDR; a 12-bit portion around a center may store the intensity data IDG; and a 12-bit portion from a first stage may store the intensity data IDB.

The drive section 50 is configured to drive the light emitting section 48 based on the intensity data ID stored in the memory section 46. The drive section 50 may include registers 51R, 51G, and 51B, DACs (D/A converters) 52R, 52G, and 52B, and variable current sources 53R, 53G, and 53B.

The registers 51R, 51G, and 51B each are configured to store 12-bit data based on a control signal supplied from the control section 41. Specifically, the register 51R may store the intensity data IDR stored in the 12-bit portion from the last stage of the shift register 46B; the register 51G may store the intensity data IDG stored in the 12-bit portion around the center; and the register 51B may store the intensity data IDB stored in the 12-bit portion from the first stage.

The DACs 52R, 52G, and 52B are configured to convert 12-bit digital signals stored in the registers 51R, 51G, and 51B to analog signals, respectively, based on a control signal supplied from the control section 41.

The variable current sources 53R, 53G, and 53B are configured to generate drive currents according to the analog signals supplied from the DACs 52R, 52G, and 52B, respectively.

The light emitting section 48 is configured to emit light based on the drive current supplied from the drive section 50. The light emitting section 48 may include light emitting elements 48R, 48G, and 48B. The light emitting elements 48R, 48G, and 48B may be light emitting elements configured with use of LEDs and may emit red (R), green (G) and blue (B) light, respectively.

With this configuration, the DAC 52R may generate an analog voltage based on the intensity data IDR stored in the register 51R. Then, the variable current source 53R may generate the drive current based on the analog voltage, and may supply the light emitting element 48R of the light emitting section 48 with the generated drive current, through a switch 54R. The light emitting element 48R may emit light with emission intensity according to the drive current. Likewise, the DAC 52G may generate an analog voltage based on the intensity data IDG stored in the register 51G The variable current source 53G may generate the drive current based on the analog voltage, and may supply the light emitting element 48G of the light emitting section 48 with the generated drive current, through a switch 54G. The light emitting element 48G may emit light with emission intensity according to the drive current. Moreover, the DAC 52B may generate an analog voltage based on the intensity data IDB stored in the register 51B. The variable current source 53B may generate the drive current based on the analog voltage, and may supply the light emitting element 48B of the light emitting section 48 with the generated drive current, through a switch 54B. The light emitting element 48B may emit light with emission intensity according to the drive current.

It is to be noted that the switches 54R, 54G, and 54B are configured to be on/off controlled by a control signal supplied from the control section 41. This allows the pixel Pix to adjust emission intensity, while maintaining balance among the red (R), green (G), and blue (B) luminous intensity.

In these blocks that constitute each pixel Pix, the blocks except for the light emitting section 48 may be integrated in one chip. In other words, the display panel 20 may be provided with the (M×N) chips and the (M×N) light emitting sections 48 arrayed in a matrix.

Here, the pixel Pix corresponds to one concrete example of a "first unit pixel" in the present disclosure. The input terminal PDIN corresponds to one concrete example of a "first data input terminal" in the present disclosure. The output terminal PDOUT corresponds to one concrete example of a "first data output terminal" in the present disclosure. The data signal PD corresponds to one concrete example of "first data" in the present disclosure. The flip-flops 42 and 44 correspond to one concrete example of a "first waveform shaping section" in the present disclosure. The input terminal PSIN corresponds to one concrete example of a "second data input terminal" in the present disclosure. The output terminal PSOUT corresponds to one concrete example of a "second data output terminal" in the present disclosure. The data signal PS corresponds to one concrete example of "second data" in the present disclosure. The flip-flops 42 and 44 correspond to one concrete example of a "second waveform shaping section" in the present disclosure. The input terminal CKIN corresponds to one concrete example of a "first clock input terminal" in the present disclosure. The output terminal CKOUT corresponds to one concrete example of a "first clock output terminal" in the present disclosure. The buffer 45 corresponds to one concrete example of a "first buffer" in the present disclosure. The light emitting elements 48R, 48G, and 48B correspond to one concrete example of a "display element" in the present disclosure. The DACs 52R, 52G, and 52B correspond to one concrete example of a "converting section" in the present disclosure.

[Operations and Functions]

Next, description will be given on operations and functions of the display device 1 according to the present embodiment.

(Outline of General Operation)

First, referring to FIG. 1 and so forth, an outline of the general operation of the display device 1 will be described. The RF section 11 performs processing such as, but not limited to, down conversion on the broadcast wave (the RF signal) received on the antenna 9. The demodulation section 12 performs demodulation processing on the signal supplied from the RF section 11. The demultiplexer section 13 separates the video signal and the audio signal from these signals multiplexed with the signal (stream) supplied from the demodulation section 12. The decoder section 14 decodes the signal (i.e., the video signal and the audio signal) supplied from the demultiplexer section 13. The signal conversion section 15 performs format conversion of the signal and outputs, as the picture signal Sdisp, the signal thus format-converted.

In the display panel 20, the display drive section 21 controls light emission in each pixel Pix of the display section 30, based on the picture signal Sdisp supplied from the signal conversion section 15. Specifically, the display drive section 21 supplies each column of the pixels Pix of the display section 30 with the data signals PS and PD, and the clock signal CK. Each pixel Pix receives the data signals PS and PD, and the clock signal CK from the preceding-stage pixel Pix, and supplies the next-stage pixel Pix with them. Then, each pixel Pix reads, from the data signal PD. the intensity data ID concerning the relevant pixel Pix, and emits light with emission intensity according to the intensity data ID.

(Detailed Operation of Pixel Pix)

In the pixel Pix, the control section 41 may function as a state machine, and may control an operation of the pixel Pix. In the following, first, detailed description will be given of an operation of the control section 41.

FIG. 5 is a state transition diagram of the control section 41. Referring to FIG. 5, the pixel Pix may take three states S0 to S2.

The state S0 indicates a state in which the relevant pixel Pix has not read the intensity data ID (Unloaded). In the state S0, the control section 41 sets the signal LD to "0". Thus, the pixel Pix replaces the flag PL in the inputted signal PD with "0". Also, the control section 41 sets CKEN to "0".

The state S1 indicates a state in which the relevant pixel Pix is reading the intensity data ID (Loading). In the state S1, the control section 41 sets the signal LD to "0". Thus, the pixel Pix replaces the flag PL in the inputted signal PD with "0". Moreover, the control section 41 sets the signal CKEN to "1" in a period in which the signal PDA indicates the intensity data ID; in other periods, the control section 41 sets the signal CKEN to "0". In this way, the intensity data ID is stored in the memory section 46.

The state S2 indicates a state in which the relevant pixel Pix has read the intensity data ID (Loaded). In the state S2, the control section 41 sets the signal LD to "1". Thus, the pixel Pix replaces the flag PL in the inputted signal PD with "1". Also, the control section 41 sets CKEN to "0".

The transition between the three states S0 to S2 may be carried out based on the flags RST and PL that are included in the data signal PD. First, when "1" is inputted as the flag RST, the control section 41 sets the relevant pixel Pix to the state S0 (Unloaded). In the state S0 (Unloaded), when "1" is inputted as the flag RST (RST=1), or when "0" is inputted as the flag PL (PL=1), the state of the pixel Pix is kept the state S0 (Unloaded).

In the state S0 (Unloaded), when "0" is inputted as the flag RST and "1" is inputted as the flag PL (RST=0 and PL=1), the state of the pixel Pix transits from the state S0 (Unloaded) to the state S1 (Loading). In the state S1 (Loading), when "1" is inputted as the flag RST (RST=1), the state of the pixel Pix transits from the state S1 (Loading) to the state S0 (Unloaded).

On the other hand, in the state S1 (Loading), when "0" is inputted as the flag RST, the state of the pixel Pix transits from the state S1 (Loading) to the state S2 (Loaded). In the state S2 (Loaded), when "0" is inputted as the flag RST (RST=0), the state of the pixel Pix is kept the state S2 (Loaded). Then, in the state S2 (Loaded), when "1" is inputted as the flag RST (RST=1), the state of the pixel Pix transits from the state S2 (Loaded) to the state S0 (Unloaded).

FIG. 6 illustrates the states of the pixels Pix0 to Pix(N−1) in one frame period (1F). At the start of one frame period (1F), "1" is inputted as the flag RST to the first-stage pixel Pix0, allowing the state of the pixel Pix0 to be set to the state S0 (Unloaded). After that, the pixels Pix1 to Pix(N−1) are sequentially set to the state S0 (Unloaded), in the relevant one frame period (1F). At this occasion, timings at which periods of the state S0 (Unloaded) in the adjacent pixels Pix start are shifted by two pulses of the clock signal CK, as will be described later. Next, the states of the pixels Pix0 to Pix(N−1) sequentially transit from the state S0 (Unloaded) to the state S1 (Loading). Periods of the state S1 (Loading) in the adjacent pixels Pix are set not to overlap one another. In the state S1 (Loading), the pixels Pix0 to Pix(N−1) sequentially read the intensity data ID. After that, the states of the pixels Pix0 to Pix(N−1) sequentially transit from the state S1 (Loading) to the state S2 (Loaded). In the state S2 (Loaded), the pixels Pix0 to Pix(N−1) emit light with emission intensity according to the intensity data ID thus read.

Next, description will be given on the operation of the pixel Pix with use of specific examples of the data signals PS and PD.

FIG. 7 illustrates one example of signals inputted to the column of the daisy-chain-connected pixels Pix in one frame period (1F), in which (A) indicates a waveform of the clock signal CK, (B) indicates a waveform of the data signal PS, and (C) indicates a waveform of the data signal PD. In (C) of FIG. 7, "x" may indicate either "1" or "0". Also, in this example, for convenience of description, the intensity data IDR, IDG, and IDB each are 1-bit data, in which "r0", "r1", . . . , "r(N−1)" indicate the intensity data IDR, "g0", "g1", . . . , "g(N−1)" indicate the intensity data IDG, and "b0", "b1", . . . , "b(N−1)" indicate the intensity data IDB.

Referring to FIG. 7, the flag RST is "1" in the first pixel packet PCT in one frame period (1F), and is "0" in the other pixel packets PCT. Moreover, in this example, the flag PL is "1" in the second and subsequent pixel packets PCT in one frame period (1F).

FIGS. 8 to 32 illustrate the states of the pixels Pix0 to Pix2 in a case in which respective bits of the signals illustrated in FIG. 7 are sequentially inputted. In upper portions of these figures, the data signals PS and PD, and signal portions P (P1 to P25) that are being inputted to the first-stage pixels Pix0 are indicated. Moreover, in lower portions of these figures, the states of some blocks in the pixels Pix0 to Pix2, and levels of the signals are indicated by "1", "0", and "x". It is to be noted that the block diagrams of the pixels Pix0 to Pix 2 are simplified for convenience of description.

First, when a first signal portion P1 is inputted to the first-stage pixel Pix0, as illustrated in FIG. 8, the flip-flop 42 of the pixel Pix0 samples the inputted data signals PS and PD. The control section 41 of the pixel Pix0 obtains, from the signal portion P1, "1" as a value of the flag RST, and sets the state of the pixel Pix0 to the state S0 (Unloaded). In other words, the control section 41 sets the signals LD, PLT, and CKEN to "0".

Next, when a signal portion P2 is inputted to the pixel Pix0, as illustrated in FIG. 9, the flip-flops 42 and 44 each sample the inputted data signals. The control section 41 of the pixel Pix0 sets the signal PLT to "1". Thus, the selector section 43 outputs "0" that is same as the signal LD. In other words, the selector section 43 replaces the flag PL ("x") with "0" of the signal LD.

Next, when a signal portion P3 is inputted to the pixel Pix0, as illustrated in FIG. 10, in each pixel Pix, the flip-flops 42 and 44 each sample the inputted data signals. Thus, the signal portion P1 is inputted to the next-stage pixel Pix1.

In the pixel Pix0, the control section 41 sets the signal PLT back to "0". Thus, the selector section 43 selects the data signal PDA from the flip-flop 42, and outputs the selected data signal PDA.

In the pixel Pix 1, the control section 41 obtains, from the signal portion P1, "1" as the value of the flag RST, and sets the status of the pixel Pix1 to the state S0 (Unloaded). In other words, the control section 41 sets the signals LD, PLT, and CKEN to "0".

Next, when a signal portion P4 is inputted to the pixel Pix0, as illustrated in FIG. 11, in each pixel Pix, the flip-flops 42 and 44 each sample the inputted data signals. Thus, the signal portion P2 is inputted to the next-stage pixel Pix1. In the pixel Pix1, the control section 41 sets the signal PLT to "1". Thus, the selector section 43 outputs "0" that is same as the signal LD.

Next, when a signal portion P5 is inputted to the pixel Pix0, as illustrated in FIG. 12, in each pixel Pix, the flip-flops 42 and 44 each sample the inputted data signals. Thus, the signal portion P3 is inputted to the pixel Pix1, while the signal portion P1 is inputted to the pixel Pix2.

In the pixel Pix1, the control section 41 sets the signal PLT back to "0". Thus, the selector section 43 selects the data signal PDA from the flip-flop 42, and outputs the selected data signal PDA.

In the pixel Pix2, the control section 41 obtains, from the signal portion P1, "1" as the value of the flag RST, and sets the status of the pixel Pix2 to the state S0 (Unloaded). In other words, the control section 41 sets the signals LD, PLT, and CKEN to "0".

Next, when a signal portion P6 is inputted to the pixel Pix0, as illustrated in FIG. 13, in each pixel Pix, the flip-flops 42 and 44 each sample the inputted data signals. Thus, the signal portion P4 is inputted to the pixel Pix1, while the signal portion P2 is inputted to the pixel Pix2.

In the pixel Pix0, the control section 41 obtains, from the signal portion P6, "0" as the value of the flag RST.

In the pixel Pix2, the control section 41 sets the signal PLT to "1". Thus, the selector section 43 outputs "0" that is same as the signal LD.

Next, when a signal portion P7 is inputted to the pixel Pix0, as illustrated in FIG. 14, in each pixel Pix, the flip-flops 42 and 44 each sample the inputted data signals. Thus, the signal portion P5 is inputted to the pixel Pix1, while the signal portion P3 is inputted to the pixel P2.

In the pixel Pix0, the control section 41 obtains, from the signal portion P7, "1" as a value of the flag PL. Since the control section 41 has obtained "0" as the value of the flag RST at one timing before, the control section 41 sets the state of the pixel Pix1 to the state S1 (Loading). Also, the control section 41 sets the signal PLT to "1". Thus, the selector section 43 outputs "0" that is same as the signal LD. In other words, the selector section 43 replaces the flag PL ("1") with "0" of the signal LD.

In the pixel Pix2, the control section 41 sets the signal PLT back to "0". Thus, the selector section 43 selects the data signal PDA from the flip-flop 42, and outputs the selected data signal PDA.

Next, when a signal portion P8 is inputted to the pixel Pix0, as illustrated in FIG. 15, in each pixel Pix, the flip-flops 42 and 44 each sample the inputted signals. Thus, the signal portion P6 is inputted to the pixel Pix1, while the signal portion P4 is inputted to the pixel Pix2.

In the pixel Pix0, the control section 41 sets the signal PLT back to "0". Thus, the selector section 43 selects the data signal PDA from the flip-flop 42, and outputs the selected data signal PDA. Also, the control section 41 sets the signal CKEN to "1".

In the pixel Pix1, the control section 41 obtains, from the signal portion P6, "0" as the value of the flag RST.

Next, when a signal portion P9 is inputted to the pixel Pix0, as illustrated in FIG. 16, in each pixel Pix, the flip-flops 42 and 44 each sample the inputted data signals. Thus, the signal portion P7 is inputted to the pixel Pix1, while the signal portion P5 is inputted to the pixel Pix2.

In the pixel Pix0, the shift register 46B stores "r0" as a value of the intensity data IDR.

In the pixel Pix1, the control section 41 obtains, from the signal portion P7, "0" as the value of the flag PL. Accordingly, the state of the pixel Pix1 is kept the state S0 (Unloaded). Also, the control section 41 sets the signal PLT to "1". Thus, the selector section 43 outputs "0" that is same as the signal LD.

Next, when a signal portion P10 is inputted to the pixel Pix0, as illustrated in FIG. 17, in each pixel Pix, the flip-flops 42 and 44 each sample the inputted data signals. Thus, the signal portion P8 is inputted to the pixel Pix1, while the signal portion P6 is inputted to the pixel Pix2.

In the pixel Pix0, the shift register 46B stores "g0" as a value of the intensity data IDG.

In the pixel Pix1, the control section 41 sets the signal PLT back to "1". Thus, the selector section 43 selects the data signal PDA from the flip-flop 42, and outputs the selected data signal PDA.

In the pixel Pix2, the control section 41 obtains, from the signal portion P6, "0" as the value of the flag RST.

Next, when a signal portion P11 is inputted to the pixel Pix0, as illustrated in FIG. 18, in each pixel Pix, the flip-flops 42 and 44 each sample the inputted data signals. Thus, the signal portion P9 is inputted to the pixel Pix1, while the signal portion P7 is inputted to the pixel Pix2.

In the pixel Pix0, the shift register 46B stores "b0" as a value of the intensity data IDB. Thus, the shift register 46B (the memory section 46) has stored all the intensity data IDR, IDG, and IDB concerning the pixel Pix0. Moreover, the control section 41 obtains, from the signal portion P11, "0" as the value of the flag RST, and sets the state of the pixel Pix0 to the state S2 (Loaded). In other words, the control section 41 sets the signal LD to "1".

In the pixel Pix2, the control section 41 obtains, from the signal portion P7, "0" as the value of the flag PL. Accordingly, the state of the pixel Pix1 is kept the state S0

(Unloaded). Also, the control section 41 sets the signal PLT to "1". Thus, the selector section 43 outputs "0" that is same as the signal LD.

Next, when a signal portion P12 is inputted to the pixel Pix0, as illustrated in FIG. 19, in each pixel Pix, the flip-flops 42 and 44 each sample the inputted data signals. Thus, the signal portion P10 is inputted to the pixel Pix1, while the signal portion P8 is inputted to the pixel Pix2.

In the pixel Pix0, the control section 41 sets the signal PLT to "1". Thus, the selector section 43 outputs "1" that is same as the signal LD.

In the pixel Pix2, the control section 41 sets the signal PLT back to "0". Thus, the selector section 43 selects the data signal PDA from the flip-flop 42, and outputs the selected data signal PDA.

Next, when a signal portion P13 is inputted to the pixel Pix0, as illustrated in FIG. 20, in each pixel Pix, the flip-flops 42 and 44 each sample the inputted data signals. Thus, the signal portion P11 is inputted to the pixel Pix1, while the signal portion P9 is inputted to the pixel Pix2.

In the pixel Pix0, the control section 41 sets the signal PLT back to "0". Thus, the selector section 43 selects the data signal PDA from the flip-flop 42, and outputs the selected data signal PDA.

In the pixel Pix1, the control section 41 obtains, from the signal portion P11, "0" as the value of the flag RST.

Next, when a signal portion P14 is inputted to the pixel Pix0, as illustrated in FIG. 21, in each pixel Pix, the flip-flops 42 and 44 each sample the inputted data signals. Thus, the signal portion P12 is inputted to the pixel Pix1, while the signal portion P10 is inputted to the pixel Pix2.

In the pixel Pix1, the control section 41 obtains, from the signal portion P12, "1" as the value of the flag PL. Since the control section 41 has obtained "0" as the value of the flag RST at one timing before, the control section 41 sets the state of the pixel Pix1 to the state S1 (Loading). Also, the control section 41 sets the signal PLT to "1". Thus, the selector section 43 outputs "0" that is same as the signal LD. In other words, the selector 43 replaces the flag PL ("1") with "0" of the signal LD.

Next, when a signal portion P15 is inputted to the pixel Pix0, as illustrated in FIG. 22, in each pixel Pix, the flip-flops 42 and 44 each sample the inputted data signals. Thus, the signal portion P13 is inputted to the pixel Pix1, while the signal portion P11 is inputted to the pixel Pix2.

In the pixel Pix1, the control section 41 sets the signal PLT back to "0". Thus, the selector section 43 selects the data signal PDA from the flip-flop 42, and outputs the selected data signal PDA. Also, the control section 41 sets the signal CKEN to "1".

In the pixel Pix2, the control section 41 obtains, from the signal portion P11, "0" as the value of the flag RST.

Next, when a signal portion P16 is inputted to the pixel Pix0, as illustrated in FIG. 23, in each pixel Pix, the flip-flops 42 and 44 each sample the inputted data signals. Thus, the signal portion P14 is inputted to the pixel Pix1, while the signal portion P12 is inputted to the pixel Pix2.

In the pixel Pix0, the control section 41 obtains, from the signal portion P16, "0" as the value of the flag RST. Accordingly, the state of the pixel Pix0 is kept the state S2 (Loaded).

In the pixel Pix1, the shift register 46B stores "r1" as the value of the intensity data IDR.

In the pixel Pix2, the control section 41 obtains, from the signal portion P12, "0" as the value of the flag PL. Accordingly, the state of the pixel Pix2 is kept the state S0 (Unloaded). Also, the control section 41 sets the signal PLT to "1". Thus, the selector section 43 outputs "0" that is same as the signal LD.

Next, when a signal portion P17 is inputted to the pixel Pix0, as illustrated in FIG. 24, in each pixel Pix, the flip-flops 42 and 44 each sample the inputted data signals. Thus, the signal portion P15 is inputted to the pixel Pix1, while the signal portion P13 is inputted to the pixel Pix2.

In the pixel Pix0, the control section 41 sets the signal PLT to "1". Thus, the selector section 43 outputs "1" that is same as the signal LD.

In the pixel Pix1, the shift register 46B stores "g1" as the value of the intensity data IDG.

In the pixel Pix2, the control section 41 sets the signal PLT back to "0". Thus, the selector section 43 selects the data signal PDA from the flip-flop 42, and outputs the selected data signal PDA.

Next, when a signal portion P18 is inputted to the pixel Pix0, as illustrated in FIG. 25, in each pixel Pix, the flip-flops 42 and 44 each sample the inputted data signals. Thus, the signal portion P16 is inputted to the pixel Pix1, while the signal portion P14 is inputted to the pixel Pix2.

In the pixel Pix0, the control section 41 sets the signal PLT back to "0". Thus, the selector section 43 selects the data signal PDA from the flip-flop 42, and outputs the selected data signal PDA.

In the pixel Pix1, the shift register 46B stores "b1" as the value of the intensity data IDB. Thus, the shift register 46B (the memory section 46) has stored all the intensity data IDR, IDG, and IDB concerning the pixel Pix1. Also, the control section 41 obtains, from the signal portion P18, "0" as the value of the flag RST, and sets the state of the pixel Pix0 to the state S2 (Loaded). In other words, the control section 41 sets the signal LD to "1".

Next, when a signal portion P19 is inputted to the pixel Pix0, as illustrated in FIG. 26, in each pixel Pix, the flip-flops 42 and 44 each sample the inputted data signals. Thus, the signal portion P17 is inputted to the pixel Pix1, while the signal portion P15 is inputted to the pixel Pix2.

In the pixel Pix1, the control section 41 sets the signal PLT to "1". Thus, the selector section 43 outputs "1" that is same as the signal LD.

Next, when a signal portion P20 is inputted to the pixel Pix0, as illustrated in FIG. 27, in each pixel Pix, the flip-flops 42 and 44 each sample the inputted data signals. Thus, the signal portion P18 is inputted to the pixel Pix1, while the signal portion P16 is inputted to the pixel Pix2.

In the pixel Pix1, the control section 41 sets the signal PLT back to "1". Thus, the selector section 43 selects the data signal PDA from the flip-flop 42, and outputs the selected data signal PDA.

In the pixel Pix2, the control section 41 obtains, from the signal portion P16, "0" as the value of the flag RST.

Next, when a signal portion P21 is inputted to the pixel Pix0, as illustrated in FIG. 28, in each pixel Pix, the flip-flops 42 and 44 each sample the inputted data signals. Thus, the signal portion P19 is inputted to the pixel Pix1, while the signal portion P17 is inputted to the pixel Pix2.

In the pixel Pix0, the control section 41 obtains, from the signal portion P21, "0" as the value of the flag RST. Accordingly, the state of the pixel Pix0 is kept the state S2 (Loaded).

In the pixel Pix2, the control section 41 obtains, from the signal portion P17, "1" as the value of the flag PL. Since the control section 41 has obtained "0" as the value of the flag RST at one timing before, the control section 41 sets the state of the pixel Pix2 to the state S1 (Loading). Also, the control section 41 sets the signal PLT to "1". Thus, the selector section 43 outputs "0" that is same as the signal LD. In other words, the selector section 43 replaces the flag PL ("1") with "0" of the signal LD.

Next, when a signal portion P22 is inputted to the pixel Pix0, as illustrated in FIG. 29, in each pixel Pix, the flip-flops 42 and 44 each sample the inputted data signals. Thus, the signal portion P20 is inputted to the pixel Pix1, while the signal portion P18 is inputted to the pixel Pix2.

In the pixel Pix0, the control section 41 sets the signal PLT to "1". Thus, the selector 43 outputs "1" that is same as the signal LD.

In the pixel Pix2, the control section 41 sets the signal PLT back to "0". Thus, the selector 43 selects the data signal PDA from the flip-flop 42, and outputs the selected data signal PDA. Also, the control section 41 sets the signal CKEN to "1".

Next, when a signal portion P23 is inputted to the pixel Pix0, as illustrated in FIG. 30, in each pixel Pix, the flip-flops 42 and 44 each sample the inputted data signals. Thus, the signal portion P21 is inputted to the pixel Pix1, while the signal portion P19 is inputted to the pixel Pix2.

In the pixel Pix0, the control section 41 sets the signal PLT back to "0". Thus, the selector section 43 selects the data signal PDA from the flip-flop 42, and outputs the selected data signal PDA.

In the pixel Pix1, the control section obtains, from the signal portion P21, "0" as the value of the flag RST. Accordingly, the state of the pixel Pix0 is kept the state S2 (Loaded).

In the pixel Pix2, the shift register 46B stores "r2" as the value of the intensity data IDR.

Next, when a signal portion P24 is inputted to the pixel Pix0, as illustrated in FIG. 31, in each pixel Pix, the flip-flops 42 and 44 each sample the inputted data signals. Thus, the signal portion P22 is inputted to the pixel Pix1, while the signal portion P20 is inputted to the pixel Pix2.

In the pixel Pix1, the control section 41 sets the signal PLT to "1". Thus, the selector section 43 outputs "1" that is same as the signal LD.

In the pixel Pix2, the shift register 46B stores "g2" as the value of the intensity data IDG.

Next, when a signal portion P25 is inputted to the pixel Pix0, as illustrated in FIG. 32, in each pixel Pix, the flip-flops 42 and 44 each sample the inputted data signals. Thus, the signal portion P23 is inputted to the pixel Pix1, while the signal portion P21 is inputted to the pixel Pix2.

In the pixel Pix1, the control section 41 sets the signal PLT back to "0". Thus, the selector section 43 selects the data signal PDA from the flip-flop 42, and outputs the selected data signal PDA.

In the pixel Pix2, the shift register 46B stores "b2" as the value of the intensity data IDB. Thus, the shift register 46B (the memory section 46) has stored all the intensity data IDR, IDG, and IDB concerning the pixel Pix2. Also, the control section 41 obtains, from the signal portion P21, "0" as the value of the flag RST, and sets the state of the pixel Pix0 to the state S2 (Loaded). In other words, the control section 41 sets the signal LD to "1".

In this way, in the display device 1, each pixel Pix receives the data signals PS and PD, and the clock signal CK from the preceding-stage pixel Pix, and supplies the next-stage pixel Pix with them. Then, each pixel Pix reads, from the data signal PD, the intensity data ID concerning the relevant pixel Pix, and emits light with emission intensity according to the intensity data ID.

As described above, in the display device 1, since the pixels Pix are daisy-chain-connected, it is possible to enhance image quality. Specifically, for example, in the display device described in Patent Literature 1, a drive section drives each pixel through the gate lines and the data lines. The gate lines and the data lines each are connected to one column or one row of a plurality of pixels, respectively. That is, the gate lines and the data lines are global wirings. Accordingly, for example, in pursuing a display device having a large screen, these wirings become long. This may cause an increase in resistance of the wiring or an increase in parasitic capacitance, which may hinder driving each pixel sufficiently. Also, for example, in pursuing a high definition display device, which involves driving more lines in each frame period, the time to be assigned for one horizontal period (1H) is shortened. This may hinder driving each pixel sufficiently. Moreover, for example, also in pursuing a higher frame rate, the time to be assigned for one horizontal period (1H) is shortened, which may hinder driving each pixel sufficiently.

On the other hand, in the display device 1 according to the present embodiment, the pixels Pix are daisy-chain-connected. In other words, each pixel Pix drives the next-stage pixel Pix through local wirings between the pixels Pix, instead of the above-mentioned global wirings. Accordingly, it is possible for each pixel Pix to drive the next-stage pixel Pix relatively easily through these short wirings. Hence, it is possible to achieve a display device having a large screen. Moreover, since the wirings are short, it is possible for each pixel Pix to increase a speed of transferring the data signals PS and PD and so forth relatively easily. Hence, it is possible to achieve a high definition display device or a display device having a high frame rate.

Moreover, since the pixels Pix are daisy-chain-connected as described above, it is possible to simplify a configuration of the display device 1. Specifically, for example, the display device described in Patent Literature 1 is provided with the plurality of gate lines extending horizontally (laterally), the plurality of data lines extending vertically (longitudinally), a so-called gate driver connected to the gate lines, and a so-called data driver connected to the data lines. This may lead to a possibility of a complicated configuration. On the other hand, in the display device 1 according to the present embodiment, the pixels Pix are daisy-chain-connected, which involves, as illustrated in FIG. 1, only wirings extending vertically (longitudinally). Thus, wirings extending horizontally (laterally) or drive sections to drive the wirings may be eliminated. This makes it possible to simplify the configuration of the display device 1.

Moreover, in the display device 1, light emission of each pixel Pix is controlled with use of digital signals (i.e., the data signals PS and PD, and the clock signal CK). Hence, it is possible to restrain influences of noises on image quality. For example, the display device described in Patent Literature 1 utilizes analog signals, which may cause a possibility of degradation in image quality due to noises. Moreover, there may be a possibility of even greater influences of noises on image quality, in particular, in display devices having a large screen, high definition, or a high frame rate. On the other hand, the display device 1 according to the present embodiment utilizes digital signals, which makes it possible to reduce influences of noises on image quality.

Moreover, the use of digital signals as mentioned above allows for reduction in radiation. Specifically, for example, the use of analog signals may cause a possibility of an increase in signal amplitude in view of gradation expression, resistance against noises, and so forth. This may result in an increase in radiation. On the other hand, the display device 1 according to the present embodiment utilizes digital signals. This makes it possible to reduce signal amplitude, allowing for reduction in radiation.

Further, in the display device 1, each pixel Pix includes the flip-flops 42 and 44, and the buffer 45. Hence, it is possible to reduce signal amplitude of the data signals PS and PD, and so forth. Specifically, for example, in the case without the flip-flops 42 and 44, and the buffer 45, a possibility may arise that the signal amplitude attenuates, as goes farther from the display drive section. In this case, the display drive section may have to generate the data signals PS and PD having large signal amplitude. On the other hand, in the display device 1, the data signals PS and PD, and the clock signal CK are waveform shaped at each time of passing through the pixel Pix, which allows the signal amplitude to be maintained. In other words, it is possible to reduce a possibility of attenuation of the signal amplitude, which makes it possible to reduce the signal amplitude of the data signals PS and PD. This allows for a lower power supply voltage and lower power consumption, as well as the reduction in radiation as mentioned above.

Also, in the display device 1, each pixel Pix is provided with the memory section 46. Thus, no data transfer is involved in displaying, for example, a still image. This allows for lower power consumption.

Moreover, in the display device 1, each pixel is provided the flip-flops 42 and 44 that are configured to sample the data signals PS and PD based on the clock signal CK. This makes it possible to maintain a relative phase relation between the data signals PS and PD, and the clock signal CK.

(Effects)

As described above, in the present embodiment, the pixels are daisy-chain-connected. Hence, it is possible to achieve a display device having, for example, a large screen, high definition, or a high frame rate, leading to enhancement in image quality and simplified configuration of a display device.

In the present embodiment, light emission of each pixel is controlled with use of digital signals. Hence, it is possible to reduce influences of noises on image quality and to reduce radiation.

In the present embodiment, each pixel is provided with the flip-flop and the buffer. Hence, it is possible to make signal amplitude smaller, allowing for reduction in radiation and lower power consumption.

In the present embodiment, each pixel is provided with the memory section. Therefore, no data transfer is involved in displaying, for example, a still image. This allows for lower power consumption.

In the present embodiment, each pixel is provided with the flip-flop that is configured to sample the data signal based on the clock signal. Hence, it is possible to maintain a relative phase relation between the data signal and the clock signal.

[Modification Example 1-1]

In the above-described example embodiment, the clock signal CK is supplied to each pixel Pix, but this is not limitative. Instead, for example, differential clock signals may be supplied to each pixel. In the following, description will be made on the present modification example by giving several examples.

FIG. 33 illustrates one configuration example of a pixel PixB according to the present modification example. The pixel PixB may include buffers 61, 64, 65, 68, and 69, and inverters 66 and 67. It is to be noted that, in the following, for convenience of explanation, description will be given with use of the first-stage pixel PixB0 in one column of the daisy-chain-connected pixels PixB; however, the same may apply to the other pixels PixB1 to PixB(N−1).

The pixel PixB0 may generate the data signals PS1 and PD1, and clock signals CKP1 and CKN1, based on the data signals PS0 and PD0, a clock signal CKP0 inputted to an input terminal CKPIN, and a clock signal CKN0 inputted to an input terminal CKNIN. Then, the pixel PixB0 may output the data signal PS1 from the output terminal PSOUT, may output the data signal PD1 from the output terminal PDOUT, may output the clock signal CKP1 from an output terminal CKPOUT, and may output the clock signal CKN1 from an output terminal CKNOUT. Here, the clock signal CKP and the clock signal CKN are inverted signals to each other. In other words, the pixel PixB0 according to the present modification example is configured to operate with the differential clock signals CKP and CKN.

The buffer 61 may be a circuit configured to convert differential signals to a single end signal. Specifically, the buffer 61 may convert the clock signals CKP0 and CKN0 as differential signals to the clock signal CK as a single end signal.

The buffers 64 and 65 are configured to perform waveform shaping on an inputted signal and to output the waveform-shaped signal. Specifically, the buffer 64 may perform waveform shaping on the clock signal CKP0, while the buffer 65 may perform waveform shaping on the clock signal CKN0.

The inverters 66 and 67 may be an inversion circuit configured to invert an inputted signal and to output the inverted signal. An input terminal of the inverter 66 may be connected to an output terminal of the inverter 67 and to an output terminal of the buffer 65. An output terminal of the inverter 66 may be connected to an input terminal of the inverter 67 and to an output terminal of the buffer 64. Moreover, the input terminal of the inverter 67 may be connected to the output terminal of the inverter 66 and to the output terminal of the buffer 64. The output terminal of the inverter 67 may be connected to the input terminal of the inverter 66 and to the output terminal of the buffer 65. With this configuration, the inverters 66 and 67 may constitute a latch circuit.

The buffer 68 may perform waveform shaping on an output signal from the buffer 64, and may output the waveform-shaped signal as the clock signal CKP1. The buffer 69 may perform waveform shaping on an output signal from the buffer 65, and may output the waveform-shaped signal as the clock signal CKN1.

Here, the input terminal CKPIN corresponds to one concrete example of a "first clock input terminal" in the present disclosure. The output terminal CKPOUT corresponds to one concrete example of a "first clock output terminal" in the present disclosure. The clock signal CKP corresponds to one concrete example of a "first clock signal" in the present disclosure. The input terminal CKNIN corresponds to one concrete example of a "second clock input terminal" in the present disclosure. The output terminal CKNOUT corresponds to one concrete example of a "second clock output terminal" in the present disclosure. The clock signal CKN corresponds to one concrete example of a "second clock signal" in the present disclosure.

As described above, the use of the differential clock signals CKP and CKN makes it possible to reduce a possibility of degradation in waveform of the clock signal due to transfer. Specifically, as in the above-described example embodiment, the use of the single end clock signal CK may cause a possibility of, for example, a change in a duty ratio of the clock signal CK after passing through the plurality of buffers 45. Such a phenomenon may occur, for example, when transistors that constitute the buffers 45 have variation in characteristics. In the case with such a change in a duty ratio, for example, normal clock transfer may be inhibited, or timing of sampling in the flip-flop 42 in the pixel Pix may be deviated, causing a possibility that normal operations may be inhibited. On the other hand, the pixel PixB according to the present modification example utilizes the differential clock signals CKP and CKN, and allows the inverters 66 and 67 to perform a latch operation. This makes it possible to restrain a change in a duty ratio.

Moreover, for example, one configuration as illustrated in FIG. 34 may be also possible, in a case with asymmetry between a transfer route of the clock signal CKP and a transfer route of the clock signal CKN. Non-limited examples of such asymmetry may include a case in which a length of the transfer route of the clock signal CKP is different from a length of the transfer route of the clock signal CKN, and a case in which the transfer routes of the clock signals CKP and CKN are different in load (capacitance). A pixel PixC may include inverters 68C and 69C. An input terminal of the inverter 68C may be connected to the output terminal of the buffer 64. An output terminal of the inverter 68C may be connected to the output terminal CKNOUT. An input terminal of the inverter 69C may be connected to the output terminal of the buffer 65. An output terminal of the inverter 69C may be connected to the output terminal CKPOUT. It is to be noted that this configuration is not limitative; instead, for example, in FIG. 34, the inverters 66 and 67 may be omitted.

In the pixel PixC, the clock signal CKN1 may be generated based on the clock signal CKP0, while the clock signal CKP1 may be generated based on the clock signal CKN0. Thus, even in the case with the asymmetry between the transfer route of the clock signal CKP and the transfer route of the clock signal CKN, influences of the asymmetry may be corrected, allowing for more reliable transfer of the clock signals CKP and CKN.

[Modification Example 1-2]

In the above-described example embodiment, the DACs 52R, 52G, and 52B are used to constitute the drive section 50, but this is not limitative. Instead, for example, a counter may be used to constitute the drive section. In the following, detailed description will be given on a pixel PixD according to the present modification example.

FIG. 35 illustrates one configuration example of the pixel PixD. The pixel PixD may include a control section 41D and a drive section 50D. The drive section 41D may have similar functions to those of the control section 41 in the above-described example embodiment, and is configured to serve as a state machine and to supply the drive section 50D with a control signal.

The drive section 50D may include counters 55R, 55G, and 55B, and current sources 56R, 56G, and 56B, and switches 57R, 57G, and 57B. The counters 55R, 55G, and 55B may be counters each configured to count clock pulses of a control signal (a counter clock signal) supplied from the control section 41D by using the control signal as a reference, and to generate a pulse signal having a pulse width according to the intensity data IDR, IDG, and IDB stored in the registers 51R, 51G, and 51B. The current sources 56R, 56G, and 56B are each configured to generate a constant drive current. The switches 57R, 57G, and 57B are configured to be turned on and off based on the pulse signals supplied from the counters 55R, 55G, and 55B.

With this configuration, for example, the counter 55R generates the pulse signal having the pulse width according to the intensity data IDR stored in the register 51R. Then, the switch 57R is turned on and off based on the pulse signal and supplies the light emitting element 48R with the drive current generated by the current source 57R.

(A) in FIG. 36 illustrates the operation of the pixel Pix according to the above-described example embodiment, while (B) in FIG. 36 illustrates an operation of the pixel PixD according to the present modification example. The pixel Pix according to the above-described example embodiment is configured to change intensity I to change the emission intensity (intensity×time, or a product of intensity and time), while the pixel PixD according to the present modification example is configured to change a time width of light emission to change the emission intensity (intensity×time).

FIG. 37 illustrates states of the pixels PixD0 to PixD(N−1) in one frame period (1F). At the start of one frame period (1F), a state of the first-stage pixel PixD0 is set to the state S0 (Unloaded). After this, the pixels PixD1 to PixD(N−1) are sequentially set to the state S0 (Unloaded) in the relevant one frame period (1F). After this, the states of the pixels PixD0 to PixD(N−1) sequentially transit from the state S0 (Unloaded) to the state S1 (Loading), and then, sequentially transit further to the state S2 (Loaded). In the state S2 (Loaded), the pixels PixD0 to PixD(N−1) each emit light during periods according to the intensity data ID thus read. Then, after the periods end, the pixels PixD0 to PixD(N−1) extinct.

It is to be noted that, in this example, the drive section 50D is provided with the three counters 53R, 53G, and 53B, but this is not limitative. For example, there may be provided one counter and a pulse signal generating circuit. The one counter is configured to keep on counting constantly. The pulse signal generating circuit is configured to generate pulse signals having pulse widths according to their respective intensity data IDR, IDG, and IDB.

Moreover, in this example, each pixel Pix receives the clock signal CK from a preceding stage, generates the counter clock signal based on the clock signal CK, and supplies the counters 55R, 55G, and 55B with the generated counter clock signal. However, this is not limitative. Instead, for example, the display drive section 21 may generate the counter clock signal. Then, each pixel Pix may receive the counter clock signal from the preceding stage, and may supply the counters 55R, 55G, and 55B with the counter clock signal. Such daisy-chain-connection of the pixels Pix with respect to the counter clock signal as well allows a frequency of the counter clock signal to be set independently of a frequency of the clock signal CK. This makes it possible to enhance a degree of freedom in setting a light emission time of the light emitting elements 48R, 48G, and 48B.

[Modification Example 1-3]

In the above-described example embodiment, the pixel Pix is provided with the three light emitting elements 48R, 48G, and 48B in red (R), green (G) and blue (B), but this is not limitative. Instead, for example, four light emitting elements in red (R), green (G), blue (B), and white (W) may be provided. Moreover, as illustrated in FIG. 38, a pixel PixE may be provided with one light emitting element in either one of red (R), green (G), and blue (B). The pixel PixE may include a memory section 46E, a drive section 50E, a light emitting element 49, and a control section 41E. The drive section 50E may include only one system of the three systems provided in the drive section 50 according to the above-described example embodiment. Moreover, the number of bits in the memory section 46E may be one third (⅓) of the number of bits in the memory section 46 according to the above-described example embodiment.

[Modification Example 1-4]

In the above-described example embodiment, the pixel Pix is provided with the flip-flops 42 and 44, but this is not limitative. Instead, for example, as illustrated in FIG. 39, buffers 71 and 72 may be provided. In a pixel PixF, the data signal PS0 may be inputted to an input terminal of the buffer 71, and the data signal PS1 may be outputted from an output terminal thereof. Moreover, the data signal PDB may be inputted to an output terminal of the buffer 72, and the data signal PD1 may be outputted from an output terminal thereof. Also, the buffers 71 and 72 are not limitative, and any device to compensate a waveform may be adopted.

[Modification Example 1-5]

In the above-described example embodiment, the memory section 46 is configured with use of the 36-bit shift register 46B, but this is not limitative. Instead, for example, one configuration as illustrated in FIG. 40 may be possible. The memory section 46B may include a shift register 73, a divider circuit 74, and a shift register block 75. The shift register 73 may be a 4-bit shift register, to whose data input terminal the data signal PDA may be inputted, and to whose clock input terminal an output signal of the AND circuit 46A may be inputted. The divider circuit 74 is configured to apply one quarter (¼) frequency division to an inputted signal. To an input terminal of the divider circuit 74, the output signal of the AND circuit 46A may be inputted. The shift register block 75 may include four 9-bit shift registers. To the four shift registers, four signals that are outputted from respective stages of the shift register 73 may be inputted. In this configuration, the intensity data ID (IDR, IDG, and IDB) included in the data signal PDA is serial/parallel converted by the shift register 73, and then, the serial/parallel converted intensity data ID (IDR, IDG, and IDB) is stored in the shift register block 75. At this occasion, the intensity data IDR may be stored in a portion PR near a last stage in the shift register block 75; the intensity data IDG may be stored in a portion PG near a center; and the intensity data IDB may be stored in a portion PB near a first stage. This configuration makes it possible to quarter (¼) a clock frequency in storing the intensity data ID in the shift register block 75.

[Modification Example 1-6]

In the above-described example embodiment, among the blocks that constitute the pixel Pix, the blocks other than the light emitting element 48 are integrated in one chip, but this is not limitative. For example, the blocks other than the light emitting elements 48 may be formed with use of TFTs on a substrate of the display panel 20.

[Modification Example 1-7]

In the above-described example embodiment, the N pixels Pix are daisy-chain-connected vertically from the uppermost pixel Pix0 to the lowermost pixel Pix(N−1). However, this is not limitative. Instead, for example, referring to FIG. 41, among the N pixels Pix, M pixels Pix may be daisy-chain-connected from the first-stage pixel Pix0 to the pixel (M−1). A display drive section 211 may be provided in an upper portion of a display section 301. The display drive section 211 may supply the M pixels Pix with the data signals PS and PD, and the clock signal CK. In the meanwhile, the (N−M) pixels Pix may be daisy-chain-connected from the pixel Pix(M) to the pixel Pix(N−1). A display drive section 212 may be provided in a lower portion of the display section 301. The display drive section 212 may supply the (N−M) pixels Pix with the data signals PS and PD, and the clock signal CK.

Further, in the above-described example embodiment, the daisy-chain-connected N pixels Pix are arranged vertically in line, but this is not limitative. Instead, for example, as illustrated in FIG. 42, the daisy-chain-connected N pixels Pix may be arranged so as to turn back near a center in the vertical direction of a display section 30J.

Moreover, in the above-described example embodiment, each of the daisy-chain-connected pixels Pix drives one pixel Pix. However, this is not limitative. Instead, for example, as illustrated in FIGS. 43 and 44, each of the daisy-chain-connected pixels Pix may drive a plurality of (two, in this example) pixels Pix. In this example, each of the daisy-chain-connected pixels Pix (for example, Pix0) may drive the daisy-chain-connected following-stage pixel Pix (for example, Pix1) and another pixel Spix (for example, SPix0) that is separate from the daisy-chain-connected following-stage pixel Pix. In a display panel 20K as illustrated in FIG. 43, the series of pixels Pix and a series of pixels SPix may be arranged in a same line. In a display panel 20L as illustrated in FIG. 44, the series of pixels Pix and the series of pixels SPix may be in adjacent lines to each other. In these configurations, in the pixel SPix, for example, the output terminals PSOUT, PDOUT, and CKOUT may be in a high impedance state, so as to prevent the data signals PS and PD, and the clock single CK from being outputted.

In addition, in the above-described example embodiment, the daisy-chain-connected pixels Pix are arranged vertically in line. However, this is not limitative. Instead, for example, as illustrated in FIG. 45, the daisy-chain-connected pixels Pix may be arranged horizontally in line.

<2. Second Embodiment>

Next, description will be given on a display device 2 according to a second embodiment. The present embodiment involves assignment of an address ADR to daisy-chain-connected N pixels PixP to allow each pixel PixP to obtain the intensity data ID concerning the relevant pixel PixP based on the address ADR. It is to be noted substantially same constituent parts as those in the display device 1 according to the above-described first embodiment are denoted by same reference numerals, and description thereof will be omitted appropriately.

The display device 2 may include, as illustrated in FIG. 1, a display panel 90. The display panel 90 may include a display section 80 including the daisy-chain-connected N pixels PixP.

FIG. 46 illustrates one configuration example of the pixel PixP. The pixel PixP may include a control section 81 and a flip-flop 82. It is to be noted that, in the following, for convenience of explanation, description will be given with use of the first-stage pixel PixP0 in one column of the daisy-chain-connected pixels PixP; however, the same may apply to the other pixels PixP1 to PixP(N−1).

The control section 81 is configured to obtain the address ADR of the pixel PixP0, to maintain the obtained address ADR, and to generate data signal PDC and the signal CKEN, based on the data signals PS0 and PD0, and the clock signal CK. Specifically, as will be described later, the control section 81 may obtain the address ADR based on data NOP included in a portion DSTART of the data signal PD0, may replace the data NOP with a value obtained by subtracting 1 from a value of the data NOP, and may output, as the data signal PDC, the value thus obtained. Then, as will be described later, the control section 81 may generate the clock CKEN based on the address ADR and the data signal PS0, and may obtain, from the data signal PD0, the intensity data ID concerning the relevant pixel PixP0. Also, the control section 81 may have a function of supplying the drive section 50 with a control signal, similarly to the control section 41 according to the above-described first embodiment.

The flip-flop 82 is configured to sample the data signal PS0 based on the clock signal CK0, to output a result of the sampling as a data signal PS1. The flip-flop 82 is configured to sample the data signal PDC based on the clock signal CK0, and to output a result of the sampling as a data signal PD1. The flip-flop 82 may be configured of, for example, two D-type flip-flop circuits, similarly to the flip-flop 42 and so forth according to the above-described first embodiment.

FIG. 47 illustrates one example of signals inputted to the first-stage pixel PixP0 in one frame period (1F), in which (A) indicates the waveform of the clock signal CK, (B) indicates the waveform of the data signal PS, and (C) indicates data of the data signal PD. The series of data signal PD may be configured of two portions DSTART and DDATA.

The portion DSTART is a so-called header portion, and may include the flag RST and data NOP. The flag RST may be set to "1" only in the portion DSTART. The data NOP may indicate a number (N−1) obtained by subtracting 1 from the number N of the daisy-chain-connected pixels PixP. Moreover, the data NOP may decrease by 1 at each time of passing through the pixel PixP.

The portion DDATA may be configured of the N pixel packets PCT that correspond to the respective daisy-chain-connected N pixels PixP. Each pixel packet PCT may include the flag RST and the intensity data ID. The flag RST may be set to "0" in the portion DDATA. The intensity data IDR, IDG, and IDB each may be, for example, a 12-bit code. It is to be noted that, in this example, for convenience of description, it is assumed that the intensity data IDR, IDG, and IDB each are 1-bit data.

FIG. 48 schematically illustrates an operation of obtaining the address ADR in each pixel PixP. The data signals PS and PD, and the clock signal CK illustrated in FIG. 47 are inputted to the first-stage pixel PixP0. Then, first, each pixel PixP obtains the address ADR based on the portion START in the data signal PD. Specifically, the first-stage pixel PixP0 obtains the data NOP from the portion START of the inputted data signal PD0, and allows the value (N−1) of the data NOP to be the address ADR. Then, the pixel PixP0 replaces the data NOP of the data signal PD0 with a value (N−2) obtained by subtracting 1 from the value (N−1), and outputs the replaced value (N−2) as the data signal PD1. Likewise, the next-stage pixel PixP1 obtains the data NOP from the portion START of the data signal PD1 supplied from the preceding-stage pixel PixP0, and allows the value (N−2) of the data NOP to be the address ADR. Then, the pixel PixP1 replaces the data NOP of the data signal PD1 with a value (N−3) obtained by subtracting 1 from the value (N−2), and outputs the replaced value (N−3) as the data signal PD1. The same applies to the subsequent pixels PixP2 to PixP(N−2). Then, the last-stage pixel PixP(N−1) obtains the data NOP from the portion START of the data signal PD(N−2) supplied from the preceding-stage pixel PixP(N−2), and allows the data 0 (zero) of the data NOP to be the address ADR.

FIG. 49 schematically illustrates an operation of obtaining the intensity data ID in each pixel PixP. Each pixel PixP counts the number of pulses in the data signal PS. When a counted value CNT becomes equal to a value (ADR+2 or a sum of ADR and 2) obtained by adding 2 to a value of the address ADR of the relevant pixel PixP, each pixel PixP obtains the intensity data ID from the data signal PD. Specifically, for example, referring to FIG. 49, the last-stage pixel PixP(N−1) obtains the intensity data ID from the data signal PD(N−1) when the counted value CNT of pulses of the data signal PS(N−1) becomes 2. In other words, since the address ADR of this pixel PixP(N−1) is 0 (zero), the pixel PixP(N−1) obtains the intensity data ID from the data signal PD(N−1) when the counted value CNT becomes equal to the value (i.e., 2) obtained by adding 2 to the value of the address ADR. Likewise, for example, referring to FIG. 49, the first-stage pixel PixP0 obtains the intensity data ID from the data signal PD0 when the counted value CNT of the pulses of the data signal PS0 becomes (N+1). In other words, since the address ADR of this pixel pixP0 is (N−1), the pixel PixP0 obtains the intensity data ID from the data signal PD0 when the counted value CNT becomes equal to the value (i.e., N+1) obtained by adding 2 to the value of the address ADR.

In this way, each pixel PixP sequentially obtains the intensity data ID, starting at the last-stage pixel PixP(N−1). Specifically, for example, the last-stage pixel PixP(N−1) obtains the intensity data ID concerning the pixel PixP(N−1); next, the preceding-stage pixel PixP(N−2) obtains the intensity data ID concerning the pixel PixP(N−2). Likewise, the pixels PixP(N−2) to PixP0 obtain the intensity data ID in this order. Then, the pixels PixP emit light with respective emission intensity according to the intensity data ID thus obtained.

Thus, in the display device 2, each pixel PixP is assigned with the address ADR. Hence, it is possible to enhance the degree of freedom of transfer of the intensity data ID to each pixel PixP. In other words, for example, in the display device 1 according to the above-described first embodiment, the intensity data ID is sequentially read, starting at the first-stage pixel Pix of the plurality of daisy-chain-connected pixels Pix. On the other hand, in the display device 2 according to the present embodiment, each pixel PixP is assigned with the address ADR. Hence, it is possible to change the order in which the pixels PixP read the intensity data ID, by changing appropriately the way of assignment of the address ADR.

As described above, in the present embodiment, each pixel is assigned with the address. Hence, it is possible to enhance the degree of freedom of transfer of the intensity data to each pixel.

[Modification Example 2-1]

In the above-described example embodiment, it is assumed that the data NOP decreases by 1 at each time of passing through the pixel PixP. However, this is not limitative. Instead, for example, the data NOP in the data signal PD inputted to the first-stage pixel PixP0 may be set to "0", and the data NOP may increase by 1 at each time of passing through the pixel PixP. In this case, each pixel PixP may sequentially obtain the intensity data ID, starting at the first-stage pixel PixP0. Specifically, for example, the first-stage pixel PixP0 obtains the intensity data ID concerning the pixel PixP0; next, the next-stage pixel PixP1 obtains the intensity data ID concerning the pixel PixP1. Likewise, the pixels PixP2 to PixP(N−1) obtain the intensity data ID in this order. In other words, it is possible to read the intensity data ID in a reversed order to that in the above-described example embodiment.

[Modification Example 2-2]

The modification examples 1-1 to 1-7 of the display device 1 according to the above-described first embodiment may be applied to the display device 2 according to the above-described example embodiment.

Although description has been made by giving the example embodiments and the modification examples, the contents of the present technology are not limited to the above-mentioned example embodiments and so forth, and may be modified in a variety of ways.

For example, in the above-described example embodiments and so forth, the pixels Pix are daisy-chain-connected with respect to the data signals PS and PD, and also with respect to the clock signal CK as well. However, this is not limitative. Instead, for example, as illustrated in FIG. 50, the pixels Pix may be daisy-chain-connected only with respect to the data signals PS and PD. In this case, the clock signal CK may be supplied to each pixel Pix, for example, through global wirings.

Moreover, for example, in the above-described example embodiments and so forth, an LED is used as the display element, but this is not limitative. Instead, an organic EL element may be used as the display element. Alternatively, as illustrated in FIG. 51, a liquid crystal element may be used as the display element. A pixel PixN may include liquid crystal elements 88R, 88G, and 88B, and a drive section 50N. The drive section 50N is configured to drive the liquid crystal elements 88R, 88G, and 88B. The output terminals of the DACs 52R, 52G, and 52B may be connected to one ends of the liquid crystal elements 88R, 88G, and 88B, respectively. To another end thereof, a voltage Vcom may be supplied.

Further, in the above-described example embodiments and so forth, the present technology is applied to a television device, but this is not limitative. The present technology may be applied to various apparatuses configured to display an image. Specifically, the present technology may be applied to, for example, a large-sized display device installed in a soccer stadium, a baseball stadium, and so forth.

It is to be noted that the present technology may have the following configurations.

(1) A display panel, including a plurality of first unit pixels each including: a first data input terminal; a first data output terminal; a display element; and a first waveform shaping section, the display element being configured to perform display based on first data inputted to the first data input terminal, and the first waveform shaping section being provided on a signal path from the first data input terminal to the first data output terminal.

(2) The display panel according to (1), further including a drive section, wherein the first data input terminal of one first unit pixel of the plurality of first unit pixels is connected to the first data output terminal of another first unit pixel, and the drive section is configured to supply the first data to a first-stage first unit pixel of the plurality of the first unit pixels.

(3) The display panel according to (2), wherein the plurality of first unit pixels each further include:

a first clock input terminal;

a first clock output terminal; and a first buffer provided on a first clock signal path from the first clock input terminal to the first clock output terminal.

(4) The display panel according to (3), wherein the plurality of first unit pixels each further include:

a second clock input terminal;

a second clock output terminal; and a second buffer provided on a second clock signal path from the second clock input terminal to the second clock output terminal, and a first clock and a second clock are inverted in signal level to each other, the first clock being inputted to the first clock input terminal, and the second clock being inputted to the second clock input terminal.

(5) The display panel according to (2), wherein the plurality of first unit pixels each further include:

a first clock input terminal;

a second clock input terminal;

a first clock output terminal to be connected to the first clock input terminal in a following-stage first unit pixel;

a second clock output terminal to be connected to the second clock input terminal in the following-stage first unit pixel;

a first inverter provided on a first clock signal path from the first clock input terminal to the second clock output terminal; and a second inverter provided on a second clock signal path from the second clock input terminal to the first clock output terminal.

(6) The display panel according to (4) or (5), wherein a latch circuit is interposed between the first clock signal path and the second clock signal path.

(7) The display panel according to any one of (2) to (6), wherein the plurality of first unit pixels each include:

a second data input terminal;

a second data output terminal; and a second waveform shaping section provided on a signal path from the second data input terminal to the second data output terminal, and second data includes a data portion to discriminate, for each first unit pixel, intensity data in the first data, the second data being inputted to the second data input terminal.

(8) The display panel according to any one of (2) to (7), further including a second unit pixel connected to the first output terminal in the one first unit pixel of the plurality of first unit pixels.

(9) The display panel according to any one of (1) to (8), wherein the first data includes intensity data that defines emission intensity in the display element, the plurality of first unit pixels each further include a memory section that stores the intensity data, and the display element is configured to perform display with intensity according to the intensity data stored in the memory section.

(10) The display panel according to (9), wherein the plurality of first unit pixels each further include a pulse generating section that is configured to generate a pulse signal having a pulse width according to the intensity data stored in the memory section, and the display element is configured to perform display based on the pulse signal.

(11) The display panel according to (10), wherein the pulse generating section is configured with use of a counter.

(12) The display panel according to (10), wherein the first waveform shaping section, the memory section, and the pulse generating section constitute a chip for each first unit pixel.

(13) The display panel according to (9), wherein the plurality of first unit pixels each further include a converting section that is configured to D/A-convert the intensity data stored in the memory section, and the display element is configured to perform display based on the D/A-converted intensity data.

(14) The display panel according to any one of (9) to (13), wherein the first data includes a flag, the first data being inputted to one first unit pixel, and the flag indicating whether the intensity data has been read in a first unit pixel arranged anteriorly to the one first unit pixel of the plurality of first unit pixels, and the plurality of first unit pixels each are configured to distinguish, based on the flag, intensity data concerning the relevant first unit pixel from the intensity data concerning the plurality of first unit pixels included in the first data.

(15) The display panel according to any one of (9) to (13), wherein the plurality of first unit pixels are each assigned with an address, and the plurality of first unit pixels each are configured to distinguish, based on the address, intensity data concerning the relevant first unit pixel from the intensity data concerning the plurality of first unit pixels included in the first data.

(16) The display panel according to any one of (1) to (15), wherein the first waveform shaping section is a flip-flop.

(17) The display panel according to any one of (1) to (15), wherein the first waveform shaping section is a buffer.

(18) The display panel according to any one of (1) to (17), wherein the plurality of first unit pixels each include the display element in a plurality, and the plurality of display elements are configured to perform display in different colors from one another.

(19) The display panel according to any one of (1) to (18), wherein the display element is an LED display element.

(20) A pixel chip, including:

a first data input terminal;

a first data output terminal; and a first waveform shaping section provided on a signal path from the first data input terminal to the first data output terminal.

(21) An electronic apparatus, including:

a display panel; and a control section configured to perform operation control on the display panel, wherein the display panel includes a plurality of first unit pixels each including: a first data input terminal; a first data output terminal; a display element; and a first waveform shaping section, the display element being configured to perform display based on first data inputted to the first data input terminal, and the first waveform shaping section being provided on a signal path from the first data input terminal to the first data output terminal.

This application claims the benefit of Japanese Priority Patent Application JP 2013-3646 filed on Jan. 11, 2013, the entire contents of which are incorporated herein by reference.

It should be understood by those skilled in the art that various modifications, combinations, sub-combinations and alterations may occur depending on design requirements and other factors insofar as they are within the scope of the appended claims or the equivalents thereof.

The invention claimed is:

1. A display panel, comprising:

a plurality of first unit pixels, each of the plurality of first unit pixels including:

a first data input terminal;

a first data output terminal;

a display element, wherein the display element is configured to display based on first data and second data, wherein the first data is inputted to the first data input terminal, and wherein the first data comprises a header portion and a ddata portion;

a first waveform shaping section, wherein the first waveform shaping section is on a first signal path from the first data input terminal to the first data output terminal;

a second data input terminal;

a second data output terminal; and a second waveform shaping section on a second signal path from the second data input terminal to the second data output terminal, wherein the second data includes a data portion to discriminate, for each first unit pixel, intensity data in the first data, and wherein the second data is inputted to the second data input terminal.

2. The display panel according to claim 1, wherein the first waveform shaping section is a flip-flop.

3. The display panel according to claim 1, wherein the first waveform shaping section is a buffer.

4. The display panel according to claim 1, wherein each of the plurality of first unit pixels further includes a plurality of display elements, and wherein the plurality of display elements are configured to display in different colors.

5. The display panel according to claim 1, wherein the display element is an LED display element.

6. The display panel according to claim 1, further comprising a drive section, wherein the first data input terminal of a first unit pixel of the plurality of first unit pixels is connected to the first data output terminal of a second unit pixel of the plurality of first unit pixels, and wherein the drive section is configured to supply the first data to a first-stage first unit pixel of the plurality of first unit pixels.

7. The display panel according to claim 6, further comprising a plurality of second unit pixels, wherein a first unit pixel of the plurality of second unit pixels is connected to the first data output terminal in the first unit pixel of the plurality of first unit pixels.

8. The display panel according to claim 1, wherein each of the plurality of first unit pixels further includes:

a first clock input terminal;

a first clock output terminal; and a first buffer, wherein the first buffer is provided on a first clock signal path from the first clock input terminal to the first clock output terminal.

9. The display panel according to claim 8, wherein each of the plurality of first unit pixels further includes:

a second clock input terminal;

a second clock output terminal; and a second buffer, wherein the second buffer is provided on a second clock signal path from the second clock input terminal to the second clock output terminal, and wherein a first signal level of a first clock is an inverse of a second signal level of a second clock, wherein the first clock is inputted to the first clock input terminal, and wherein the second clock is inputted to the second clock input terminal.

10. The display panel according to claim 9, wherein a latch circuit is between the first clock signal path and the second clock signal path.

11. The display panel according to claim 1, wherein each of the plurality of first unit pixels further includes:

a first clock input terminal;

a second clock input terminal;

a first clock output terminal to be connected to the first clock input terminal in a subsequent-stage first unit pixel;

a second clock output terminal to be connected to the second clock input terminal in the subsequent-stage first unit pixel;

a first inverter on a first clock signal path from the first clock input terminal to the second clock output terminal; and a second inverter on a second clock signal path from the second clock input terminal to the first clock output terminal.

12. The display panel according to claim 11, wherein a first length of the first clock signal path is different from a second length of the second clock signal path.

13. The display panel according to claim 1, wherein the ddata portion includes intensity data that defines emission intensity in the display element, and wherein each of the plurality of first unit pixels further includes a memory section, wherein the memory section is configured to store the intensity data, and wherein the display element is further configured to display based on the stored intensity data.

14. The display panel according to claim 13, wherein each of the plurality of first unit pixels further includes a converting section that is configured to execute digital-to-analog (D/A) conversion of the stored intensity data, and wherein the display element is further configured to display based on the D/A-converted intensity data.

15. The display panel according to claim 13, wherein the ddata portion further includes a flag, wherein the ddata portion is inputted to a first unit pixel of the plurality of first unit pixels, wherein the flag indicates that the intensity data has been read in a second unit pixel arranged anteriorly to the first unit pixel, and wherein each of the plurality of first unit pixels is configured to distinguish, based on the flag, the intensity data of a relevant first unit pixel from the intensity data of the plurality of first unit pixels included in the ddata portion.

16. The display panel according to claim 13, wherein each of the plurality of first unit pixels is associated with an address, and wherein each of the plurality of first unit pixels is configured to distinguish, based on the address, the intensity data of a relevant first unit pixel from the intensity data of the plurality of first unit pixels included in the ddata portion.

17. The display panel according to claim 13, wherein each of the plurality of first unit pixels further includes a pulse generating section that is configured to generate a pulse signal having a pulse width based on the stored intensity data, and wherein the display element is further configured to display based on the generated pulse signal.

18. The display panel according to claim 17, wherein the pulse generating section is configured with a counter.

19. The display panel according to claim 17, wherein the first waveform shaping section, the memory section, and the pulse generating section constitute a chip for each first unit pixel.

20. An electronic apparatus, comprising:

a display panel; and a control section configured to control display on the display panel, wherein the display panel includes:

a plurality of first unit pixels, each of the plurality of first unit pixels including:

a first data input terminal;

a first data output terminal;

a display element, wherein the display element is configured to display based on first data and second data, wherein the first data is inputted to the first data input terminal, and wherein the first data comprises a header portion and a ddata portion;

a first waveform shaping section, wherein the first waveform shaping section is on a first signal path from the first data input terminal to the first data output terminal;

a second data input terminal;

a second data output terminal; and a second waveform shaping section on a second signal path from the second data input terminal to the second data output terminal, wherein the second data includes a data portion to discriminate, for each first unit pixel, intensity data in the first data, and wherein the second data is inputted to the second data input terminal.

* * * * *